US009502201B2

(12) United States Patent
Nakabayashi et al.

(10) Patent No.: US 9,502,201 B2
(45) Date of Patent: Nov. 22, 2016

(54) TUNGSTEN ELECTRODE MATERIAL AND THERMIONIC EMISSION CURRENT MEASURING DEVICE

(75) Inventors: Seiji Nakabayashi, Toyama (JP); Masahiro Katoh, Toyama (JP); Yoshiharu Yamamoto, Toyama (JP); Toshihiko Yoshida, Toyama (JP); Norihiko Hasegawa, Toyama (JP)

(73) Assignee: A.L.M.T. Corp., Tokyo (JP)

( * ) Notice: Subject to any disclaimer, the term of this patent is extended or adjusted under 35 U.S.C. 154(b) by 217 days.

(21) Appl. No.: 13/133,338

(22) PCT Filed: Dec. 8, 2009

(86) PCT No.: PCT/JP2009/070503

§ 371 (c)(1),
(2), (4) Date: Jun. 7, 2011

(87) PCT Pub. No.: WO2010/067781

PCT Pub. Date: Jun. 17, 2010

(65) Prior Publication Data

US 2011/0243184 A1 Oct. 6, 2011

(30) Foreign Application Priority Data

| | | |
|---|---|---|
| Dec. 8, 2008 | (JP) | 2008-312158 |
| Dec. 8, 2008 | (JP) | 2008-312355 |
| Nov. 19, 2009 | (JP) | 2009-263771 |
| Dec. 2, 2009 | (JP) | 2009-274346 |

(51) Int. Cl.
*H01B 1/08* (2006.01)
*H01J 1/146* (2006.01)
(Continued)

(52) U.S. Cl.
CPC ..... *H01J 1/146* (2013.01); *H01J 9/42* (2013.01); *H01J 61/0735* (2013.01); *H01J 61/0737* (2013.01); *H01B 1/08* (2013.01)

(58) Field of Classification Search
CPC ..... H01B 1/08
USPC ..... 252/518.1, 521.1, 515
See application file for complete search history.

(56) References Cited

U.S. PATENT DOCUMENTS 5,530,317 A 6/1996 Willemsen et al.
6,051,165 A 4/2000 Billings
(Continued)

FOREIGN PATENT DOCUMENTS

CN 1112285 A 11/1995
CN 1506490 A 6/2004
(Continued)

OTHER PUBLICATIONS

Brown, F.H., and Duwez, P., "The Systems Zirconia-Lanthana and Zirconia-Neodymia," J. Am. Ceramic Soc., 1955, vol. 38(3), pp. 95-101.*
(Continued)

*Primary Examiner* — William Young
(74) *Attorney, Agent, or Firm* — Sughrue Mion, PLLC

(57) ABSTRACT

Provided is a tungsten electrode material that can improve the life of an electrode than conventional by the use of a material in place of thorium oxide. The tungsten electrode material includes a tungsten base alloy and oxide particles dispersed in the tungsten base alloy, wherein the oxide particle is an oxide solid solution in which a Zr oxide and/or a Hf oxide and an oxide of at least one or more kinds of rare earth elements selected from Sc, Y, La, Ce, Pr, Nd, Sm, Eu, Gd, Tb, Dy, Ho, Er, Tm, Yb, and Lu are solid-dissolved.

6 Claims, 26 Drawing Sheets

(51) Int. Cl.
*H01J 9/42* (2006.01)
*H01J 61/073* (2006.01)

(56) References Cited

U.S. PATENT DOCUMENTS

| | | | | |
|---|---|---|---|---|
| 6,133,679 | A | 10/2000 | Terui et al. | |
| 7,569,994 | B2 | 8/2009 | Ikeuchi | |
| 2005/0104521 | A1 | 5/2005 | Berndanner et al. | |
| 2005/0109735 | A1 | 5/2005 | Flood | |
| 2006/0220559 | A1* | 10/2006 | Ikeuchi | 313/633 |
| 2007/0120482 | A1 | 5/2007 | Michael et al. | |

FOREIGN PATENT DOCUMENTS

| | | | |
|---|---|---|---|
| CN | 1841642 | A | 10/2006 |
| GB | 2 084 395 | A | 4/1982 |
| JP | 1021873 | A | 1/1998 |
| JP | 11-094780 | A | 4/1999 |
| JP | 11-152534 | A | 6/1999 |
| JP | 2001-050916 | A | 2/2001 |
| JP | 2005-519435 | A | 6/2005 |
| JP | 2005-285676 | A | 10/2005 |
| JP | 2006-120354 | A | 5/2006 |
| JP | 2006-286236 | A | 10/2006 |
| JP | 2007-517664 | A | 7/2007 |
| JP | 2007-327766 | A | 12/2007 |

OTHER PUBLICATIONS

Rendtorff, N.M., et al, "Mechanochemical stabilization and sintering of nanocrystalline the (ZrO2)0.97 (Y2O3)0.03 solid solution from pure oxides," IOP Conf. Ser. Materials Sci. and Eng., 2011, 18(6).*

Roth, R.S., J. Research Nat'l Burearu Standards, vol. 56, No. 1, 1956, pp. 17-25.*

Keler, E. K., et al., "Formation and Properties of Solid Solutions of Zirconium Dioxide With Oxides of Rare Earth Elements," Translated from Ogneupory, No. 5, pp. 243-251, May 1963.*

The American Ceramics Society (ACerS) and The National Institute of Standards and Technology (NIST): ACerS-NIST Phase Equilbria Diagrams CD-ROM Database Version 3.1.

Hoshiai, Masaharu, et al., "Electron Tube," Radio Technology Lecture, Ohmsha, 1959, pp. 14-25, vol. 2.

Tsukada, Masaru, "Work Function," Kyoritsu Shuppan, Jun. 1, 1983, pp. 42-89.

Chinese Office Action dated Jun. 8, 2013, issued in Chinese Patent Application No. CN200980149187.9.

Communication dated Aug. 1, 2014, from the State Intellectual Property Office of the People's Republic of China in counterpart Application No. 200980149187.9.

Communication dated Jan. 28, 2016, from the State Intellectual Property Office of People's Republic of China in counterpart Application No. 200980149187.9.

* cited by examiner (a)

(b)

(a)

| | 2θ/θ | Relative Intensity |
|---|---|---|
| Peak ① | 30.0° | 100% |
| Peak ② | 28.2° | less than 1% |
| Peak ③ | 31.5° | less than 1% |
| Peak ④ | 29.7° | 100% |
| Peak ⑤ | 29.9° | 100% |
| Peak ⑥ | 29.6° | 100% |
| Peak ⑦ | 28.2° | 22% |
| Peak ⑧ | 31.5° | 14% |

(b)

(a)

(b)

① Peak of (220) Plane of $ZrO_2$-$Y_2O_3$ Oxide Solid Solution (a)

② Left Arrow : Peak of (220) Plane of $Y_2O_3$
Right Arrow : Peak of (022) Plane of $ZrO_2$ (b)

(a)

(b)

(c)

| Sample No. | Comparative Example 14 | Example 3 |
|---|---|---|
| Average | 0.362 | 0.332 |
| Maximum | 0.401 | 0.351 |
| Minimum | 0.306 | 0.314 |
| Standard Deviation | 0.028 | 0.012 |

(a)

(b)

(Example 3)

(c)

(Comparative Example 14)

(d)

(a)

(b)

Example 3

(c)

Comparative Example 14

(d)

(a)

(b)

(a)

(b)

Example 6

(a)

Example 17

(b)

(a)

(b)

(c)

※Ia : Anode Current, Ig : Guard Ring Current (a)

(b)

(a)

(b)

(c)

TUNGSTEN ELECTRODE MATERIAL AND THERMIONIC EMISSION CURRENT MEASURING DEVICE

CROSS REFERENCE TO RELATED APPLICATION

This application is a National Stage of International Application No. PCT/JP2009/070503 filed Dec. 8, 2009, claiming priority based on Japanese Patent Application Nos. 2008-312158, filed Dec. 8, 2008, JP 2008-312355 filed Dec. 8, 2008, JP 2009-263771 filed Nov. 19, 2009 and JP 2009-274346 filed Dec. 2, 2009, the contents of all of which are incorporated herein by reference in their entirety.

TECHNICAL FIELD

This invention relates to a tungsten electrode material and a thermionic emission current measuring device suitable for evaluating the thermionic emission properties of the tungsten electrode material.

BACKGROUND ART

Conventionally, in the case of a tungsten electrode (hereinafter also referred to as a "tungsten electrode material", an "electrode material", or simply an "electrode") which requires the phenomenon of thermionic emission, thorium oxide is contained in the electrode for use as, for example, the cathode of a discharge lamp or the like with a high heat load for the purpose of improving the thermionic emission properties at a high temperature.

However, thorium is a radioactive element and thus, in terms of safety management, there has been proposed a number of techniques that aim to optimize the selection and composition ratio of a thermionic emission substance adapted to replace thorium oxide.

For example, Patent Document 1 discloses an electron emission material containing W, Ta, Re, or an alloy thereof and, as a thermionic emission substance, a ternary oxide of a Group IIIB metal selected from Sc, Y, and the lanthanides La through Lu and a Group IVB metal selected from Hf, Zr, and Ti, a ternary oxide of a Group IVB metal selected from Hf, Zr, and Ti and a Group IIA metal selected from Be, Mg, Ca, Sr, and Ba, a mixture thereof, or a compound thereof.

It is described that the electron emission material is produced by blending a high-purity tungsten powder or another refractory alloy powder with an additive powder, consolidating the blended powder into a rod form at a high pressure, sintering the rod to a required density at a high temperature, swaging or forging the rod into a rod form with a higher density and smaller diameter, and then machining the rod to the size of an electrode.

Patent Document 2 discloses a short-arc high-pressure discharge lamp in which at least a material of a cathode tip portion contains tungsten and, additionally, as a thermionic emission substance, lanthanum oxide $La_2O_3$ and at least one kind of another oxide selected from the group of hafnium oxide $HfO_2$ and zirconium oxide $ZrO_2$.

Further, Patent Document 3 discloses a discharge lamp electrode whose recrystallization temperature is 2000° C. or higher, wherein the cathode or anode comprises one or more kinds of tungsten with a purity of 99.95% or more, doped tungsten in which an alkali metal is added at 100 ppm or less (excluding 0 ppm) to tungsten, and a tungsten-based material in which at least one kind of oxides of cerium, lanthanum, yttrium, strontium, calcium, zirconium, and hafnium is added at 4 wt % or less (excluding 0 wt %) to tungsten. These oxides are cited as thermionic emission substances.

This electrode is produced by applying CIP treatment to a powder in which cerium oxide is added to a tungsten powder, to thereby obtain a compact, processing this compact into a shape close to a final shape of the electrode, then sintering the compact in a hydrogen atmosphere at 1800° C., then performing HIP treatment in an argon gas atmosphere at 2000 atm and 1950° C., and then grinding the obtained sintered body.

Patent Document 4 discloses a high-load and high-intensity discharge lamp, wherein its cathode has a structure in which an oxide of at least one kind of metal selected from lanthanum, cerium, yttrium, scandium, and gadolinium and an oxide of at least one kind of metal selected from titanium, zirconium, hafnium, niobium, and tantalum are coexistent in a high melting point metal base composed mainly of tungsten, and wherein the conversion particle size of the coexisting substance is 15 μm or greater and the plurality of coexisting substances are present in the high melting point metal base.

It is disclosed that the cathode is produced by the following processes. That is, first, a lanthanum-metal oxide powder having an average particle size of 20 μm or less and a zirconium-metal oxide powder having the same average particle size of 20 μm or less are mixed in a ball mill and sintered in the atmosphere at about 1400° C. after pressing. Then, the sintered body is again pulverized to obtain an oxide powder in which the lanthanum-metal oxide and the zirconium-metal oxide are coexistent. Then, the obtained oxide powder is classified to obtain a powder having a particle size of 10 to 20 μm. This powder and a tungsten powder having a purity of 99.5 wt % or more and an average particle size of 2 to 20 μm are mixed together, pressed, presintered in hydrogen, and then normally sintered by applying electric current, thereby producing the cathode.

Herein, conventionally, there are several techniques for measuring the work function which is a value representing the electron emission properties of a material.

Roughly classified, there are known a method of measurement from electron emission by light and a method of measurement from electron emission by heat (hereinafter referred to as thermionic emission).

The method of measurement from electron emission by light is a method of obtaining the work function as average information of the entire emission surface by the phenomenon of photoelectric effect in which electrons are emitted upon irradiation of ultraviolet light or X-ray on the solid surface. This measuring method obtains the work function by the photoelectric effect in the atmosphere at ordinary temperature and thus is intended for a semiconductor or an organic compound which is used around the ordinary temperature (Patent Document 5).

According to Non-Patent Document 1, the photoelectric effect is given by the following equation (Non-Patent Document 1).

$$(mv^2)/2=h\nu-\phi$$

where m is the mass of an electron, v is the maximum speed of the emitted electron, υ is the frequency of irradiated light, h=2πh is the Planck's constant, and ϕ is the work function. Herein, the photoelectric effect represents the behavior of a particle having an energy of hν.

On the other hand, the method of measurement from thermionic emission is a method of measuring a current by thermionic emission (hereinafter referred to as a thermionic emission current) and deriving the work function of a material from a current value thereof. For example, in Patent Document 6, a fluorescent lamp is produced and the work function of its cathode is evaluated from the phenomenon of thermionic emission (Patent Document 6).

Herein, the work function serves as a criterion for judging whether or not it is possible to obtain facility of thermionic emission, i.e. excellent properties for a cathode (also called a negative electrode).

The thermionic emission current density J ($A/cm^2$) of a metal is derived from the following equation (Richardson-Dushman equation).

$$J=AT^2\exp(-e\phi/kT)$$

where $A=4\pi mk^2e/h^3=1.20\times10^2$ ($A/cm^2K^2$): Richardson constant, $e=1.60\times10^{-19}$ (J), $k=1.38\times10^{-23}$ (J/K): Boltzmann constant, and $\phi$(eV): work function. T is the absolute temperature of a thermionic emission substance.

According to the Richardson-Dushman equation, for example, the thermionic emission current density of pure tungsten is $4.52\times10^{-5}$ $A/cm^2$ at 1773K, which is a practically unmeasurable level, while, it is 0.052 $A/cm^2$ at 2273K, 0.15 $A/cm^2$ at 2373K, and 0.40 $A/cm^2$ at 2473K and thus the thermionic emission current does not reach a measurable level unless the temperature is raised.

Accordingly, in order to measure the thermionic emission current of pure tungsten, a cathode temperature of about 2200K or higher is required in terms of normal current measurement accuracy.

As a means for obtaining a high temperature so as to obtain a measurable thermionic emission current, there is, for example, a method of carrying out electric heating using a fine line (Non-Patent Document 2).

Further, other than the measuring methods described above, Non-Patent Document 1 discloses a work function measurement technique using field emission.

PRIOR ART DOCUMENT

Patent Document

Patent Document 1: U.S. Pat. No. 6,051,165 Specification
Patent Document 2: JP-A-2005-519435
Patent Document 3: JP-A-2005-285676
Patent Document 4: JP-A-2006-286236
Patent Document 5: JP-A-H11-94780
Patent Document 6: JP-A-2006-120354

Non-Patent Document

Non-Patent Document 1: Masaru Tsukada, "Work Function", Kyoritsu Shuppan, Published Jun. 1, 1983, pp. 42-89

Non-Patent Document 2: Masaharu Hoshiai, Sogo Okamura, "Electron Tube (1959) (Radio Technology Lecture <Volume 2>)", Ohmsha, 1959, pp. 14-25

SUMMARY OF THE INVENTION

Problem to be Solved by the Invention

The techniques for replacing thorium have been proposed in large numbers as described above so that a certain improvement in electrode life has been achieved.

However, recently, a further improvement in electrode life has been required and, for this, the techniques described in Patent Documents 1 to 4 are insufficient.

Further, in order to accurately evaluate such thorium replacing techniques, it is necessary to accurately evaluate the work function and life of the electrode, but there have been the following problems in the above-mentioned work function measuring methods.

First, Patent Document 5 discloses the technique of measuring the work function of the solid surface in the atmosphere at ordinary temperature as described before and, further, its measurement principle is that oxygen in the atmosphere is ionized by photoelectrons and that the resulting oxygen ions are detected. Accordingly, there is a problem that it is not possible to accurately measure the work function at an actual operating temperature of the cathode for use in the discharge lamp.

Naturally, the cathode using the substitute material for thorium cannot be accurately evaluated unless the work function of a cathode using a conventional material containing thorium is measured and compared.

However, since thorium is the radioactive substance as described before and emits β-rays, oxygen is ionized by the β-rays regardless of the emission of photoelectrons and thus the photoelectron emission cannot be accurately measured.

That is, the work function deriving method based on the photoelectric effect, which is described in Patent Document 5, is a technique that is not applicable to the evaluation and comparison of the properties of a cathode material whose operating temperature is high and which contains a radioactive substance and, further, there is a problem that it is not possible to obtain the thermionic emission properties which are important as the properties of a cathode of a discharge lamp, and information of temporal changes thereof.

On the other hand, the measuring method of Patent Document 6 is a measuring method such that the fluorescent lamp for actual use is produced and that the work function of its cathode is evaluated from the phenomenon of thermionic emission. Since the measurement tends to be affected by various factors, other than the electrode material properties, such as the area of the cathode, the assembling accuracy of the lamp, the shape of an electrode coil, a noble gas as an atmosphere, and the degree of vacuum, it is actually difficult to accurately measure only the electron emission properties of the cathode material by eliminating the influences of these factors.

That is, there is a problem that, in order to derive the work function from the thermionic emission current, it is necessary to obtain the current density as seen from the Richardson-Dushman equation and that while it is necessary to accurately define the area and temperature of a portion where the thermionic emission is occurring, it is difficult to accurately define the lamp structure and to accurately control and measure the temperature. In particular, for the temperature, it is necessary to define the emissivity of a substance to be measured. Metal surfaces may have various emissivities of 0.2 to 0.8. If the measurement is carried out using a wrong emissivity, there occurs a difference between an obtained measurement temperature and a true temperature so that a large error occurs in the derivation of the work function.

On the other hand, there have been the following problems in the method of carrying out electric heating using a fine line, of Non-Patent Document 2.

1. Since it is not easy to accurately measure the line diameter and thus the surface area of an electron emission surface cannot be accurately defined, the influence of the measurement error is large.

2. Since the line diameter is small, it is difficult to heat and maintain a necessary portion at a high temperature.

3. Since the line diameter is small, it is difficult for both contact-type and noncontact-type temperature measurements to accurately measure the cathode temperature. In the contact type (thermocouple etc.), heat is lost through a contact so that it is difficult to raise the temperature. In the noncontact type (radiation thermometer etc.), it is difficult to determine the emissivity of a surface of the fine line and thus the true temperature cannot be obtained.

4. There is a possibility that the inter-electrode distance between anode and cathode changes due to suspension or deformation of the fine line so that the inter-electrode distance cannot be accurately defined.

Further, the work function measurement technique using field emission, described in Non-Patent Document 1, has a drawback that a strong electric field of $10^7$ to $10^8$V/cm or more is required and thus a special device is required so that the work function cannot be obtained easily. Further, since this measurement technique uses the phenomenon of electron emission based on the principle different from that of thermionic emission, there is a drawback that it is not possible to obtain information of the thermionic emission properties which are important as the properties of a cathode for use in a discharge lamp or the like.

As described above, under the present circumstances, the thorium replacing techniques are insufficient in terms of the prolongation of the electrode life and, further, more than anything else, the techniques themselves for evaluating the thorium replacing techniques are insufficient in terms of the accuracy.

This invention has been made in view of the above-mentioned points and has a technical object to provide, using a material in place of thorium oxide, a tungsten electrode material that can improve the life of an electrode than conventional, and further to provide a thermionic emission current measuring device which is necessary for accurately grasping the work function of only a cathode, a measuring method thereof, and a work function calculation method.

Means for Solving the Problem

In order to solve the above-mentioned problems, the present inventors, as a result of an intensive study, have paid attention to the fact that the correlation between the life of an electrode (temporal changes of thermionic emission and thermionic emission properties) and the existing form of an oxide in the electrode has not conventionally been studied technically, and have carried out X-ray diffraction for the oxide mixture powder before being mixed with the tungsten powder, which is shown in each of Patent Documents 1 to 4 described above.

As a result, it has been confirmed that, in each Patent Document, the oxide mixture powder is a mixture powder in which different oxides are simply mixed together.

In order to confirm how the existing form becomes when a compact, in which the mixture powder of the different oxides being simply mixed together and the tungsten powder are mixed together, is sintered, the present inventors have conducted an additional test using a method of electric current sintering of tungsten which carries out solid-phase sintering just below the melting point while maintaining the shape.

As a result, as will be explained in later-described Comparative Examples, it has been confirmed that the respective oxides are individually present in the tungsten base alloy (hereinafter referred to as "in the tungsten material").

As a result of a further study based on the above-mentioned additional test results, the present inventors have reached the conclusion that a further improvement in electrode life can be realized by causing oxide particles dispersed in the tungsten material to take the form of an oxide solid solution and achieving an increase in the melting point of the oxide.

The present inventors have judged that the reason that an oxide solid solution is not obtained in the above-mentioned prior arts is because the different oxides are in a state of being individually dispersed in the tungsten compact and, therefore, even if, for example, the above-mentioned electric current sintering is carried out, it is difficult for all the oxide particles to cause mass transport so as to take the form of a solid solution.

Further, based on the above-mentioned additional test results and study results and so on, the present inventors have made various studies about a method of forming oxides as a solid solution and about a combination of oxides that enables an increase in the melting point.

As a result, for example, according to a $ZrO_2$—$Er_2O_3$ binary phase diagram shown at (a) in FIG. 1, the phase of solid solutions C is stable in a wide temperature range particularly in a composition range of M to N in the diagram and the present inventors have considered that it is theoretically possible to obtain a powder of a desired oxide solid solution by selecting the composition in this composition range of the solid solutions C, mixing the respective oxides together, heating the mixture to a temperature of a region of liquid phase L to melt it, uniformly stirring the melt, and then solidifying it.

As a result of repeating studies based on the knowledge described above, the present inventors have found that it is possible to provide, using a material in place of thorium oxide, a tungsten electrode material that can improve the life of an electrode than conventional, by creating a new means such that oxide particles (hereinafter each also referred to as an "oxide solid solution") in which a Zr oxide and/or a Hf oxide and at least one or more kinds of rare earth oxides selected from Sc, Y, and lanthanoids (La, Ce, Pr, Nd, Sm, Eu, Gd, Tb, Dy, Ho, Er, Tm, Yb, and Lu (in this invention, Pm being a radioactive element is excluded (hereinafter referred to as "lanthanoids")) are solid-dissolved are produced in advance and mixed with a tungsten powder or a mixture powder in which the oxide solid solutions are formed in the tungsten powder is produced in advance and that the mixture powder is pressed and sintered to thereby disperse the oxide solid solutions into the tungsten material.

According to a first aspect of this invention based on the knowledge described above, there is provided a tungsten electrode material characterized by comprising a tungsten base alloy, and oxide particles dispersed in the tungsten base alloy, wherein each oxide particle is an oxide solid solution in which a Zr oxide and/or a Hf oxide and at least one or more kinds of rare earth oxides selected from Sc, Y, La, Ce, Pr, Nd, Sm, Eu, Gd, Tb, Dy, Ho, Er, Tm, Yb, and Lu are solid-dissolved.

According to a second aspect of this invention, there is provided the method of manufacturing the tungsten electrode material according to the first aspect, characterized by comprising the steps of producing a hydroxide precipitate from a solution in which a Zr salt and/or a Hf salt and at least one or more kinds of rare earth salts selected from Sc, Y, La, Ce, Pr, Nd, Sm, Eu, Gd, Tb, Dy, Ho, Er, Tm, Yb, and Lu are dissolved in water, drying the hydroxide precipitate to produce a hydroxide powder, heating the hydroxide powder at a temperature of 500° C. or more and less than a melting point of the oxide solid solution to produce an oxide solid solution powder, mixing the oxide solid solution powder with a tungsten powder to produce a mixture powder, pressing the mixture powder to produce a compact, sintering the compact in a non-oxidizing atmosphere to produce a sintered body, and plastic working (also called drawing) to the sintered body to produce a tungsten rod material.

According to a third aspect of this invention, there is provided the method of manufacturing the tungsten electrode material according to the first aspect, characterized by comprising the steps of producing a hydroxide precipitate from a solution in which a Zr salt and/or a Hf salt and at least one or more kinds of rare earth salts selected from Sc, Y, La, Ce, Pr, Nd, Sm, Eu, Gd, Tb, Dy, Ho, Er, Tm, Yb, and Lu are dissolved in water, drying the hydroxide precipitate to produce a hydroxide powder, mixing the hydroxide powder with a tungsten oxide to produce a mixture, heating the mixture in a hydrogen atmosphere at a temperature of 500° C. or more and less than a melting point of the oxide solid solution to produce a mixture powder in which an oxide solid solution powder is formed in a tungsten powder, pressing the mixture powder to produce a compact, sintering the compact in a non-oxidizing atmosphere to produce a sintered body, and plastic working to the sintered body to produce a tungsten rod material.

According to a fourth aspect of this invention, there is provided the method of manufacturing the tungsten electrode material according to the first aspect, characterized by comprising the steps of producing a solution in which a Zr salt and/or a Hf salt and at least one or more kinds of rare earth salts selected from Sc, Y, La, Ce, Pr, Nd, Sm, Eu, Gd, Tb, Dy, Ho, Er, Tm, Yb, and Lu are dissolved in water, mixing the mixture solution with a tungsten oxide powder, drying the mixture to produce a dried powder, heating the dried powder in a hydrogen atmosphere at a temperature of 500° C. or more and less than a melting point of the oxide solid solution to produce a mixture powder in which an oxide solid solution powder is formed in a tungsten powder, pressing the mixture powder to produce a compact, sintering the compact in a non-oxidizing atmosphere to produce a sintered body, and plastic working to the sintered body to produce a tungsten rod material.

Further, as a result of repeating intensive studies about a method of evaluating the cathode properties of the above-mentioned tungsten electrode material, the present inventors have found that, using electron bombardment heating as a method of heating a cathode, it is possible to obtain a thermionic emission current from the cathode and to accurately calculate the work function of the cathode from this thermionic emission current and specifically that it is possible to evaluate and compare the cathode properties between a cathode material whose operating temperature is high and which contains a radioactive substance such as thorium and a substitute material for thorium.

According to a fifth aspect of this invention on the basis of above-described discovery, there is provided a thermionic emission current measuring device characterized by comprising electron bombardment heating means for electron bombardment heating of a cathode, and thermionic emission current measuring means for measuring a thermionic emission current generated by the electron bombardment heating of the cathode by the electron bombardment heating means.

According to a sixth aspect of this invention, there is provided a thermionic emission current measuring method characterized by comprising (a) electron bombardment heating of a cathode, and (b) measuring a thermionic emission current generated by the electron bombardment heating of the cathode by the electron bombardment heating means.

According to a seventh aspect of this invention, there is provided a work function calculation method characterized by comprising (d) determining two or more maintaining temperatures of a cathode to carry out electron bombardment heating of the cathode, thereby obtaining thermionic emission currents to derive current densities, (e) linearly approximating the two or more maintaining temperatures to obtain a straight line and deriving a slope and an intercept thereof by extrapolation using the method of least squares, and (f) using an equation 1 which is an equation representing a logarithm of a thermionic emission current density, deriving a work function $\phi$ from the slope of the straight line, which is a first term on a ride side of the equation 1:

$$\ln(J/T^2)=-e\phi/k\times(1/T)+\ln A \quad \text{(Equation 1)}$$

$\phi$: work function (eV), $-e$: electron charge, k: Boltzmann constant, T: cathode temperature (K), J: thermionic emission current density ($A/cm^2$), A: Richardson constant ($A/cm^2K^2$).

Effect of the Invention

In this invention, using a material in place of thorium oxide, it is possible to provide a tungsten electrode material that can improve the life of an electrode than conventional.

Further, in this invention, it is possible to provide a thermionic emission current measuring device which is necessary for accurately grasping the work function of only a cathode, a measuring method thereof, and a work function calculation method and, as a consequence, the electrode properties of the material in place of thorium oxide can be evaluated more accurately than conventional.

MODE FOR CARRYING OUT THE INVENTION

Hereinbelow, an embodiment of this invention will be described in detail.

First, the structure of an electrode material according to this embodiment will be briefly described.

The electrode material of this invention comprises a tungsten base alloy and oxide particles dispersed in the tungsten base alloy.

Herein, the oxide particles dispersed in the electrode material of this invention are each an oxide solid solution in which an oxide of Sc, Y, or a lanthanoid excellent in thermionic emission properties and a high melting point Zr oxide and/or Hf oxide are uniformly dissolved.

As will be described later, the present inventors have confirmed by a test that, as a means for causing the oxide solid solutions to be present in the tungsten electrode material, it is necessary to cause the oxide solid solutions to be present in a tungsten powder before press-forming the tungsten powder, i.e. in advance.

Figure 2:
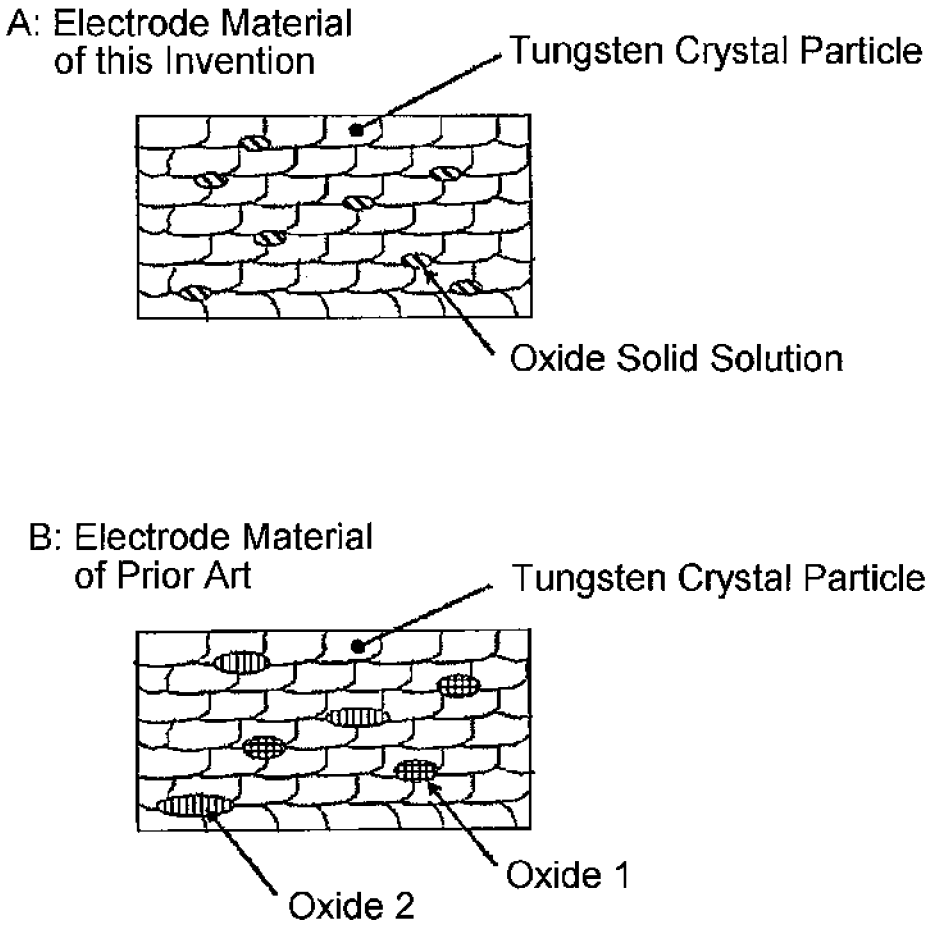
FIG. 2 shows conceptual diagrams of electrode materials of this invention and the prior art.

Herein, the electrode material of this invention in which the oxide solid solutions are present represents an electrode material in which, as shown at A in FIG. 2, one or more kinds of oxide solid solutions (in the case of the same figure, one kind of oxide solid solution) are dispersed at the grain boundaries of tungsten crystal particles or in the tungsten crystal particles in a cross-sectional structure of the electrode material.

"Oxide solid solution" referred to in this invention represents a state of a solid particle in which two or more kinds of oxides are uniformly dissolved at an arbitrary composition ratio. That is, if this state is compared to liquids, it is not a state (mixture) in which the liquids have no solubility in each other, such as water and oil, and thus are separated into two phases, but is a state (solution) in which the liquids are dissolved in each other to form a homogenous single-phase composition, such as water and ethanol. The latter corresponds to a solid solution in the case of solids.

Accordingly, the oxide solid solution of this invention represents a state where the oxide of Zr or Hf and the oxide of Sc, Y, or the lanthanoid are uniformly dissolved in a single phase.

<Kinds of Oxides for Use in this Invention>

Next, the kinds of oxides for use in this invention will be described.

As described before, in order to obtain the oxide solid solution of this invention, the phase of the solid solution should be stable in the wide temperature range, that is, the oxide should have a high melting point.

A description will be given below by citing the Zr oxide and/or the Hf oxide as an example of an oxide for achieving an increase in the melting point of an oxide of a rare earth element.

Figure 1:
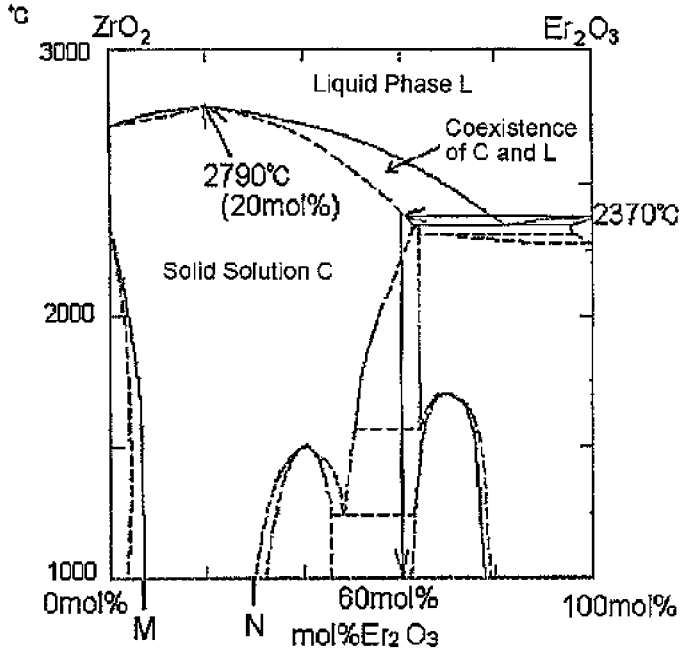
FIG. 1 shows (a) a $ZrO_2$—$Er_2O_3$ binary phase diagram and (b) a $ZrO_2$—$Sm_2O_3$ binary phase diagram.
Figure 1:
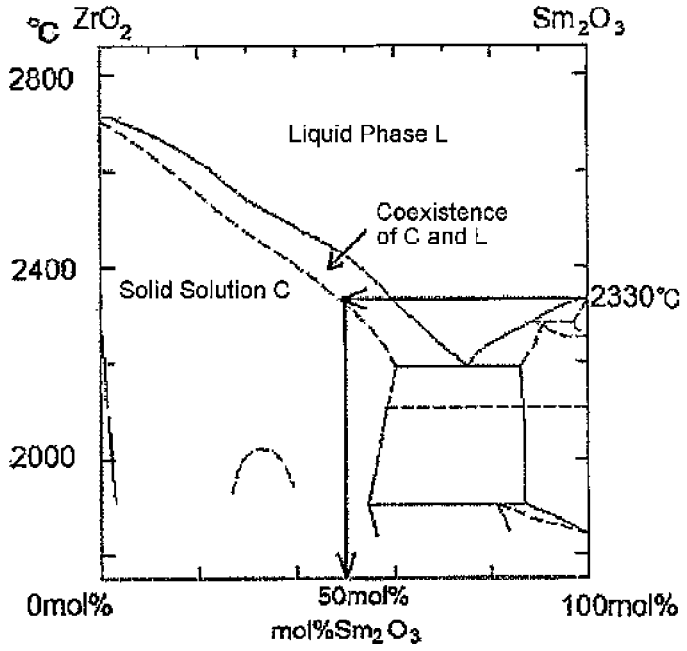

FIG. 1(*a*) (Source: Published by The American Ceramics Society (ACerS) and the National Institute of Standards and Technology (NIST): ACerS-NIST Phase Equilibria Diagrams CD-ROM Database Version 3.1, hereinafter referred to as "Non-Patent Document 3") shows a $ZrO_2$—$Er_2O_3$ binary phase diagram as an example in which the Zr oxide or the Hf oxide and the oxide of Sc, Y, or the lanthanoid are solid-dissolved.

In FIG. 1(*a*), a region of "Solid Solution C" is a range in which the Zr oxide and the Er oxide are solid-dissolved. A region of "Liquid Phase L" is a range in which the Zr oxide and the Er oxide are in the form of a liquid. In a region of "Coexistence of C and L", the solid solution C (solid) and the liquid phase L (liquid) coexist and, therefore, upon entering this region, the liquid phase appears and melting starts.

From FIG. 1(*a*), the melting point of $Er_2O_3$ alone is 2370° C. In the case of the solid solution of $ZrO_2$ and $Er_2O_3$ with a composition of about 60 mol % $Er_2O_3$, a boundary line between the region of "Coexistence of C and L" and the region of "Solid Solution C", i.e. the boundary line where the liquid phase appears, shows 2370° C. which is equal to the melting point of $Er_2O_3$ alone.

Then, as mol % of $Er_2O_3$ decreases, the boundary line rises above the melting point of $Er_2O_3$ alone. The boundary line is the highest at 2790° C. with a composition in which about 20 mol % $Er_2O_3$ is solid-dissolved. This is the composition with the highest melting point.

FIG. 1(*b*) is a $ZrO_2$—$Sm_2O_3$ binary phase diagram. Like in FIG. 1(*a*), a region of "Solid Solution C" is a range in which the Zr oxide and the Sm oxide are in the form of a solid solution and a region of "Liquid Phase L" is a range in which the Zr oxide and the Sm oxide are in the form of a liquid. Upon entering a region of "Coexistence of C and L", melting starts.

From the same figure, the melting point of $Sm_2O_3$ alone is 2330° C. In the case of the solid solution of $ZrO_2$ and $Sm_2O_3$ with a composition of about 50 mol % $Sm_2O_3$, a boundary line where the liquid phase appears shows 2330° C. which is equal to the melting point of $Sm_2O_3$ alone. Then, as mol % of $Sm_2O_3$ decreases, the boundary line rises and, when the solid solution approaches a composition of 0 mol % $Sm_2O_3$, it shows a maximum of 2710° C.

As described above, the solid solution has a melting point above that of the Sc, Y, or lanthanoid oxide alone and, further, may have a melting point above that of the Zr or Hf oxide alone. When the enthalpy change across the solid dissolution becomes negative, the melting point of the oxide solid solution exceeds the melting points of the respective combined oxides alone. That is, an increase in the melting point is determined by the combination of the oxides and the composition ratio thereof.

From phase diagrams shown in Non-Patent Document 3, the present inventors have read the melting points of the oxides alone and, in solid solutions in which the Zr oxide and the oxides of Sc, Y, and the lanthanoids are combined, respectively, within the scope of this invention, have read the composition ranges where the melting point of the solid solution becomes higher than that of the Sc, Y, or lanthanoid oxide alone, and the melting point increase upper limits. For each lanthanoid oxide, a chemical formula with the most stable oxidation number is shown. These are collectively shown in Table 1 along with the melting points of the Zr oxide alone and the Hf oxide alone. (In Table 1, the oxides of Sc, Y, and the lanthanoids are shown as rare earth oxides)

TABLE 1

| Rare Earth Oxide | Composition Range where Melting Point of Rare Earth Oxide increases | Melting Point of Rare Earth Oxide alone | Melting Point Increase Upper Limit |
|---|---|---|---|
| $Sc_2O_3$ | 0-55 mol % | 2440° C. | 2800° C. |
| $Y_2O_3$ | 0-65 mol % | 2430° C. | 2805° C. |
| $La_2O_3$ | 0-15 mol % | 2320° C. | 2700° C. |
| $CeO_2$ | 0-15 mol % | 2490° C. | 2710° C. |
| $Pr_2O_3$ | 0-40 mol % | 2300° C. | 2700° C. |
| $Nd_2O_3$ | 0-40 mol % | 2300° C. | 2710° C. |
| $Sm_2O_3$ | 0-50 mol % | 2330° C. | 2710° C. |
| $Eu_2O_3$ | 0-45 mol % | 2340° C. | 2700° C. |
| $Gd_2O_3$ | 0-45 mol % | 2400° C. | 2720° C. |
| $Tb_2O_3$ | 0-55 mol % | 2420° C. | 2700° C. |
| $Dy_2O_3$ | 0-55 mol % | 2400° C. | 2745° C. |
| $Ho_2O_3$ | 0-55 mol % | 2400° C. | 2760° C. |
| $Er_2O_3$ | 0-60 mol % | 2370° C. | 2790° C. |
| $Tm_2O_3$ | 0-55 mol % | 2420° C. | 2860° C. |
| $Yb_2O_3$ | 0-65 mol % | 2430° C. | 2825° C. |
| $Lu_2O_3$ | 0-55 mol % | 2500° C. | 2890° C. |

TABLE 1-continued

| Oxide | Melting Point of Oxide alone |
|---|---|
| $ZrO_2$ | 2700° C. |
| $HfO_2$ | 2780° C. |

Note:
0 mol % is not included in the range. (Source: Non-Patent Document 3)

According to Non-Patent Document 3, in phase diagrams of the Hf oxide and the oxides of Sc, Y, and the lanthanoids, the liquid phase appearing temperatures are equal to or higher than those of the combinations of the Zr oxide and the oxides of Sc, Y, and the lanthanoids, respectively.

Therefore, in the composition ranges of the table given above, solid solutions of the Hf oxide and the oxides of Sc, Y, and the lanthanoids can also have melting points higher than those of the Sc, Y, and lanthanoid oxides alone, respectively.

In later-described Examples, there are exemplified oxide solid solutions each comprising the Zr oxide and/or the Hf oxide and the oxide of one kind selected from La, Sm, Er, Yb, and Y. However, since oxide solid solutions, other than exemplified, each comprising the Zr oxide and/or the Hf oxide and an oxide of at least one or more kinds selected from Sc, Y, La, Ce, Pr, Nd, Sm, Eu, Gd, Tb, Dy, Ho, Er, Tm, Yb, and Lu can also have high melting points as in the Examples, these oxide solid solutions may also be used.

It is difficult to specify the oxidation number of the rare earth element contained in the oxide solid solution. Each chemical formula of Table 1 shows the most stable oxidation number, but the element may take another oxidation number. Accordingly, a rare earth oxide with an oxidation number other than those in Table 1 may also be used because it is still an oxide of the rare earth element.

<Content of Oxide Solid Solutions in Electrode Material of this Invention>

In the electrode material of this invention, the content of the oxide solid solutions in the total amount of the electrode material is preferably 0.5 mass % to 5 mass % (the balance is substantially tungsten).

This is because if it is less than 0.5 mass %, there is a possibility that the effect of dispersing the oxide solid solutions is not obtained so that the electrode life is not improved, while, if it exceeds 5 mass %, there is a possibility that the processability is degraded so that an electrode cannot be formed.

<Anisotropy in Shape of Oxide Solid Solutions in Electrode Material of this Invention>

In the electrode material of this invention, it is preferable that, in a cross-section in an axial direction of the electrode material, the cross-sectional area of those oxide solid solutions, each having a cross-section whose long axis direction forms an angle of 20° or less with the axial direction, be 50% or more of the cross-sectional area of all the oxide solid solutions.

That is, it is preferable that the directions of the long axes of the oxide solid solutions be aligned with the axial direction.

This is considered to be because, in the case of the oxide solid solution whose long axis is oriented in the center axis direction, only part of its cross-section for use as an electrode is exposed on an electron emission surface and, therefore, the oxide solid solution for electron emission is gradually supplied in the depth direction, i.e. the long axis direction, so that the exhaustion time of the electrode is improved.

The electrode material satisfying such a condition can be obtained by, for example, adjusting the average particle size and the processing ratio (area reduction ratio after the processing) of the oxide solid solutions. Specifically, the processing ratio and the particle size are complementary to each other such that if the particle size is large, the directions are easily aligned even if the processing ratio is low, while, if the processing ratio is high, the directions are easily aligned even if the particle size is small.

"Axial direction" referred to herein represents a center axis direction when the electrode material is formed in a columnar shape, while, "cross-section in an axial direction" represents a cross-section when the electrode material is cut so as to be parallel to the center axis and to include the center axis.

Further, "long axis" referred to herein represents a major axis of an ellipse equivalent to the cross-sectional shape of the oxide solid solution and, specifically, a major axis of an ellipse having the same area and the same first and second moments as those of the cross-sectional shape of the oxide solid solution. Even when a hole (void) exists in the cross-sectional shape, the cross-sectional area represents an area including the hole.

Herein, the structure of the oxide solid solution in the cross-section in the axial direction of the electrode material can be observed by, for example, a general metallurgical microscope or an electron probe microanalyzer (EPMA) that specifies the position and shape of an oxide.

The size of the oxide solid solution can be evaluated by binarizing an image, taken by the EPMA, using an image processing software such as, for example, Image Pro Plus manufactured by Media Cybernetics, Inc. and standardizing the area of the oxide solid solution particle as a tungsten area ratio along with the results of quantitative analysis by ICP emission spectral analysis according to JIS H 1403.

<Aspect Ratio of Oxide Solid Solutions in Electrode Material of this Invention>

In the electrode material of this invention, it is preferable that, in a cross-section in an axial direction of the electrode material, the area ratio of those oxide solid solutions, each having a cross-section with an aspect ratio of 6 or more, be 4% or more of the cross-sectional area of all the oxide solid solutions.

This is considered to be because, in the case of the oxide solid solution whose aspect ratio is 6 or more, the oxide solid solution for electron emission is gradually supplied in the depth direction so that the exhaustion time of the electrode is improved.

The electrode material satisfying such a condition can be obtained by, for example, removing those oxide solid solution particles with a particle size of 5 μm or less and setting the processing ratio to 20% or more. The processing ratio and the particle size are complementary to each other such that if the particles are coarse, the particles with the aspect ratio of 6 or more are easily formed even if the processing ratio is low, while, if the processing ratio is high, the particles with the aspect ratio of 6 or more are easily formed even if the particles are fine.

"Aspect ratio" referred to herein represents a (major axis/minor axis) ratio of an ellipse equivalent to the cross-sectional shape of the oxide solid solution. The meanings of "axial direction", "cross-section in an axial direction", and "cross-sectional area" are the same as those described in <Anisotropy in Shape of Oxide Solid Solutions in Electrode Material of this Invention>.

<Particle Size of Oxide Solid Solutions in Electrode Material of this Invention>

In the electrode material of this invention, it is preferable that, in a cross-section in an axial direction of the electrode material, the total area of those oxide solid solutions, each having a cross-section with a circle-converted particle size of 5 μm or less, be less than 50% of the area of all the oxide solid solutions.

This is considered to be because the oxide solid solution having the particle size of 5 μm or less does not contribute to thermionic emission. "particle size" referred to herein represents a diameter when the cross-section of the oxide solid solution is converted into a perfect circle having the same area. The meanings of "axial direction", "cross-section in an axial direction", and "cross-sectional area" are the same as those described in <Anisotropy in Shape of Oxide Solid Solutions in Electrode Material of this Invention>.

The electrode material satisfying such a condition can be obtained by, for example, a method of controlling the size of the oxide solid solution powder through screening and, more specifically, it can be obtained by a method of removing the powder of the oxide solid solutions of 5 μm or less by screening, a method of, conversely, setting the powder of primary particles (high-frequency particle size on the fine particle size side in a distribution obtained by laser particle size distribution) to 1 μm or less to thereby increase aggregated particles so as to increase the size of the oxide solid solutions in an electrode as a result, a method of setting the powder of secondary particles to 3 μm or less to thereby promote sintering of the oxide solid solutions so as to increase the size of the oxide solid solutions in an electrode, or the like.

<Deviation of Element Ratios in Oxide Solid Solutions in Electrode Material of this Invention>

In the electrode material of this invention, the standard deviation of the molar ratios of the rare earth element to all the metal elements in the oxide solid solutions is 0.025 or less.

More specifically, the electrode material of this invention contains the oxide solid solutions which show a relationship where, in the elements forming the oxide solid solutions, the standard deviation a of the ratios of the total moles of Sc, Y, La, Ce, Pr, Nd, Sm, Eu, Gd, Tb, Dy, Ho, Er, Tm, Yb, and Lu to the total moles of the elements in the oxide solid solutions excluding oxygen is $\sigma \leq 0.025$.

This is because if the standard deviation $\sigma$ exceeds 0.025, most of the obtained oxides are present not in the form a solid solution, but in the form of a mixture as in the prior arts and thus the prolongation of the electrode life cannot be achieved.

The electrode material satisfying such a condition can be obtained by one of the above-mentioned manufacturing methods.

<Oxide Solid Solution Confirmation Method>

Using X-ray diffraction, it is possible to identify whether the existing state of an oxide before being mixed with a tungsten powder is an oxide solid solution of this invention or an oxide (an oxide alone, a mixture of oxides, or an oxide obtained by stoichiometric combination at a predetermined molar ratio) of the above-mentioned prior arts. The reason is that the lattice constant, the crystal structure, and so on differ depending on the existing state of the oxide so that unique X-ray diffraction peaks appear according to that existing state.

Hereinbelow, a description will be given of differences between the oxide solid solution of this invention and various oxides of the prior arts additionally tested by the present inventors.

First, the measurement of the existing state of an oxide will be described using Zr and Yb as an example.

An oxide comprising Zr, Yb, and O and obtained by stoichiometrically combining at a predetermined molar ratio, i.e. chemically bonded oxide, represents, for example, $Zr_3Yb_4O_{12}$. In X-ray diffraction, the peaks unique to $Zr_3Yb_4O_{12}$ are observed as shown in the powder X-ray diffraction file (JCPDS).

Figure 3:
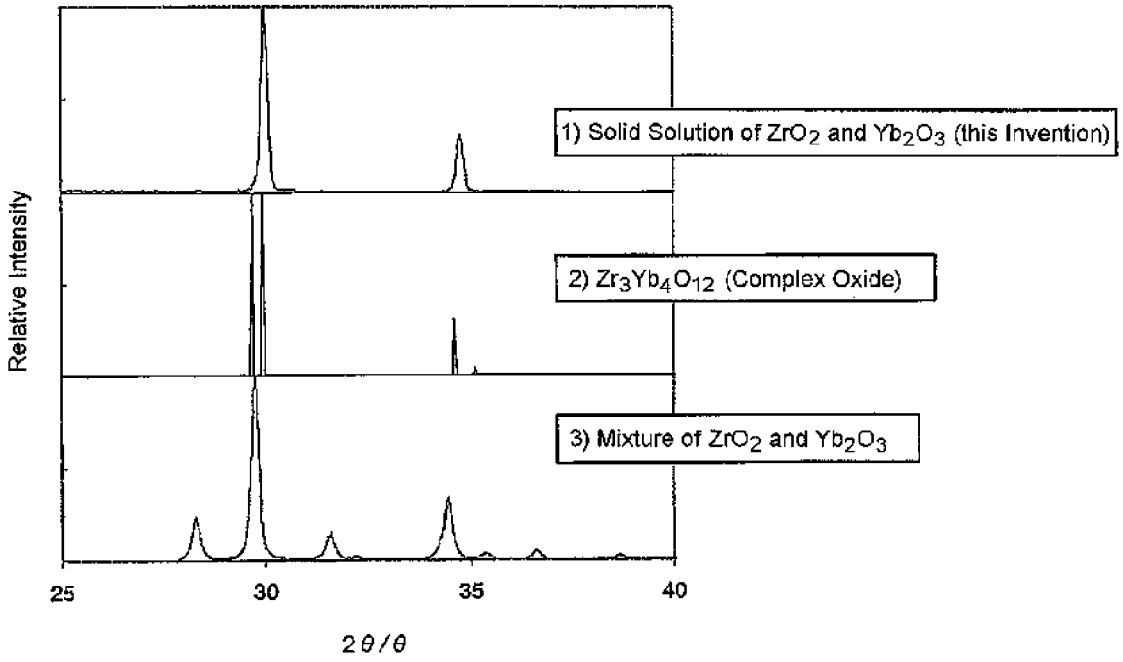
FIG. 3 is a diagram showing the results of X-ray diffraction of a solid solution of $ZrO_2$ and $Yb_2O_3$ (25 mol %), $Zr_3Yb_4O_{12}$ (from JCPDS), and a mixture of $ZrO_2$ alone and $Yb_2O_3$ alone (25 mol %).
Figure 4:
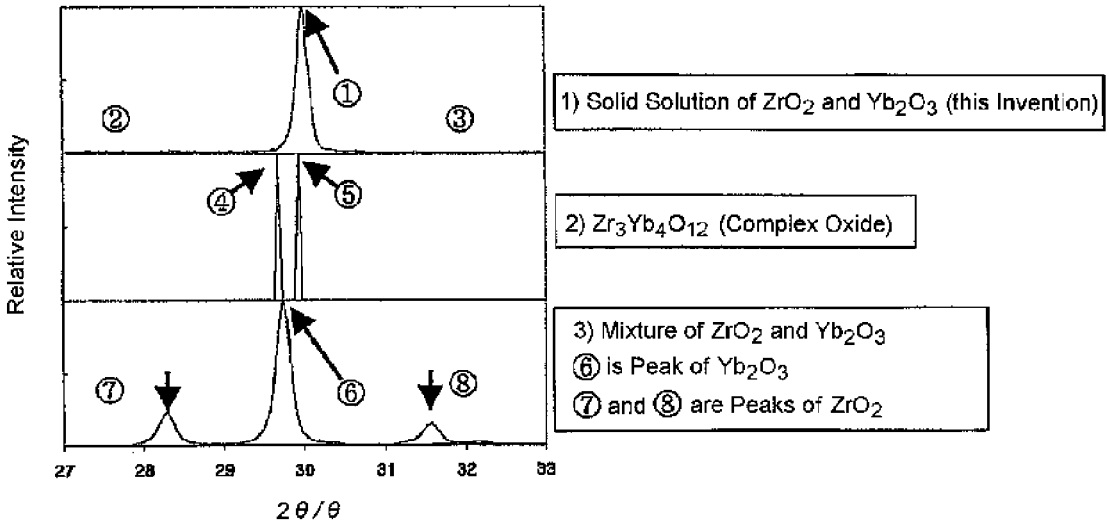
FIG. 4 shows (a) an enlarged view of FIG. 3 and (b) a diagram showing $2\theta/\theta$ and the relative intensity of each of the peaks in (a).

As specific examples, the peaks of a solid solution of $ZrO_2$ and $Yb_2O_3$ (25 mol %) obtained by X-ray diffraction, the peaks of $Zr_3Yb_4O_{12}$ shown in the JCPDS, and the peaks of a mixture of $ZrO_2$ alone and $Yb_2O_3$ alone (25 mol %) obtained by X-ray diffraction are collectively shown in FIGS. 3 and 4.

In FIG. 3, the peaks of $Zr_3Yb_4O_{12}$ and the peaks of the solid solution of $ZrO_2$ and $Yb_2O_3$ (25 mol %) seem to coincide with each other. However, as seen from an enlarged view of FIG. 3 shown in FIG. 4(*a*), the peak of $Zr_3Yb_4O_{12}$ near 28=30° is separated into two peaks of circled numbers 4 and 5, while, the peak of the solid solution of $ZrO_2$ and $Yb_2O_3$ (25 mol %) is only a single peak of circled number 1 at different 28. Therefore, it can be interpreted that both show different existing states.

In the mixture of $ZrO_2$ alone and $Yb_2O_3$ alone, the peak of $Yb_2O_3$ at 2θ=29.6° (peak of (222) plane with a spacing of 3.01 Å ($3.01\times10^{-1}$° m), denoted by circled number 6 in FIG. 4(*a*)) is the highest, while, the peaks of $ZrO_2$ have a relative intensity of 22% at 2θ=28.2° (circled number 7 in FIG. 4(*a*)) and a relative intensity of 14% at 2θ=31.5° (circled number 8 in FIG. 4(*a*)).

In the solid solution of $ZrO_2$ and $Yb_2O_3$, the peak at 2θ=30.0° (circled number 1 in FIG. 4(*a*)) (peak of (111) plane with a spacing d=2.98 Å ($2.98\times10^{-10}$ m)) is the highest and this is the highest intensity line, while, the relative intensity of $ZrO_2$ alone, which is not solid-dissolved, is only less than 1% at 2θ=28.2° (circled number 2 in FIG. 4(*a*)) and is also only less than 1% at 2θ=31.5° (circled number 3 in FIG. 4(*a*)). That is, the peaks unique to $ZrO_2$ alone at 2θ=28.2° and 31.5° disappeared. If the peak intensities of $ZrO_2$ alone at 2θ=28.2° and 31.5° are each less than 10% of the highest intensity line, the solid solution exhibits the properties equivalent to those of an oxide solid solution of this invention.

According to the results of an additional test conducted by the present inventors, it has been found that the oxide before being mixed with the tungsten powder, which is shown in Patent Document 1, i.e. $La_2Zr_2O_7$ or the like, is in a state where the constituent elements are chemically bonded at a predetermined molar ratio.

Therefore, the oxide obtained by the method of Patent Document 1 belongs to (2) of later-described classification.

Since the existing state of the oxide is not defined in Patent Document 4, the present inventors have conducted an additional test with the following contents according to an Example thereof in order to obtain the oxide powder in which the La-metal oxide and the Zr-metal oxide are coexistent.

The mixture ratio of the above-mentioned metal oxides was set to $La_2O_3$:$ZrO_2$=1:2 in molar ratio. This satisfies claim 4 of Patent Document 4 reading "a molar ratio of an oxide AxOy of at least one kind of metal selected from lanthanum, cerium, yttrium, scandium, and gadolinium to an oxide BzOt of at least one kind of metal selected from titanium, zirconium, hafnium, niobium, and tantalum is such that A/B 1.0", and corresponds to A/B=0.5 in this claim.

First, a commercial La-metal oxide ($La_2O_3$, manufactured by Wako Pure Chemical, purity 99 mass %) and a commercial Zr-metal oxide ($ZrO_2$, manufactured by Wako Pure Chemical, purity 99 mass %) were mixed at the above-mentioned molar ratio and pulverized in a ball mill for 5 minutes.

Then, the pulverized powder was pressed at a pressure of 98 MPa to produce a compact.

Then, the obtained compact was sintered in the atmosphere at 1400° C. and then again pulverized to obtain a metal oxide. After natural cooling, the metal oxide was analyzed by X-ray diffraction. As a result, $La_2O_3$ and $ZrO_2$ were mainly observed while $La_2Zr_2O_7$ in which the oxides were stoichiometrically combined at the predetermined molar ratio formed only a very small part. That is, it has been found that the mixture in which the La-metal oxide and the Zr-metal oxide were individually present was predominant even after the heating.

Therefore, it has been found that the oxide obtained by the method of Patent Document 4 (referred to as a "coexisting substance" in Patent Document 4) belongs to (2) and (3) of the later-described classification while Patent Documents 2 and 3 belong to (3) of the later-described classification like Patent Document 4, that is, any of them is not an oxide solid solution.

As described above, according to the X-ray diffraction, it has been found that only the oxide solid solution of this invention belongs to (1) of the classification given below while any of Patent Documents 1 to 4 does not belong thereto.

In other words, it has been found that, only by heating the mixture of the tungsten powder and the oxide shown in each of Patent Documents 1 to 4, it is difficult to obtain a mixture containing an oxide solid solution in the tungsten powder.

Based on the results of the X-ray diffraction, the forms of the oxide solid solution powder of this invention before being mixed with the tungsten powder and the oxide powder before being mixed with the tungsten powder shown in each of Patent Documents 1 to 4 are summarized. These forms can be classified into (1) an oxide solid solution in which an oxide of Zr or Hf and an oxide of Sc, Y, or a lanthanoid are solid-dissolved (oxide solid solution of this invention), (2) a complex oxide of Zr or Hf and Sc, Y, or a lanthanoid in which these elements are chemically bonded at a predetermined molar ratio (the oxide in which the elements are chemically bonded at the predetermined molar ratio represents an oxide comprising two or more kinds of metal elements and oxygen in which the elements are chemically bonded at a molar ratio of a chemical formula, like a chemical formula of $La_2Zr_2O_7$, which will hereinafter be referred to as a complex oxide), and (3) a mixture of an oxide of Zr or Hf and an oxide of Sc, Y, or a lanthanoid (hereinafter referred to as a mixture).

Therefore, even in the case of the same constituent elements and the same composition ratio, the peaks unique to the oxide solid solution of the oxide of Zr or Hf and the oxide of Sc, Y, or the lanthanoid appear in (1) given above, the peaks unique to the complex oxide (oxide shown in Patent Document 1) appear in (2) given above, and the peaks of the oxide of Zr or Hf and the peaks of the oxide of Sc, Y, or the lanthanoid appear in a superimposed manner in the mixture (oxide shown in Patent Document 2, 3, or 4) of (3) given above, which thus can be identified, respectively.

In this way, the oxide solid solution, the complex oxide, and the mixture exhibit the different existing states even if the constituent elements and the composition ratio thereof are the same.

The above-mentioned X-ray diffraction was measured under a condition of 40 kV and 30 mA with a Cu tube, using RAD-2× manufactured by Rigaku K.K.

As described above, based on the above-mentioned additional tests and X-ray diffraction, it has been confirmed that this invention and the prior arts are fundamentally different from each other in the form of the oxide powder before being mixed with the tungsten powder.

An electrode produced using the oxide shown in each of Patent Documents 1 to 4 has a cross-sectional structure as shown at B in FIG. 2. That is, it is the technique of using a powder in which an oxide solid solution is not formed and, therefore, when a mixture of oxides is used, there is obtained an electrode material in which two or more kinds of oxides of Zr or Hf and Sc, Y, or a lanthanoid are individually dispersed, while, when a complex oxide/oxides is/are used, there is obtained an electrode material in which one or more kinds of complex oxides of Zr or Hf and Sc, Y, or a lanthanoid are dispersed. The same figure shows the case of a mixture of two kinds of oxides or the case of two kinds of complex oxides.

<Existing State of Oxide Solid Solutions in Electrode Material of this Invention and Confirmation Method>

Using X-ray diffraction, it is also possible to perform state confirmation as to whether or not the oxides form a solid solution in the electrode material of this invention.

As another method, it is possible to chemically dissolve only tungsten to separate and recover the oxides, and then to perform state confirmation as to whether or not the oxides exhibit a solid-dissolved state by X-ray diffraction.

Other than this, it is possible to directly confirm a solid-dissolved state or not by observing atoms of the oxides and atomic arrangement thereof using a transmission electron microscope (TEM). It is also possible to confirm a state where the oxides are solid-dissolved, using a later-described energy dispersive X-ray analyzer (EDX) or electron probe microanalyzer (EPMA).

The results of the X-ray diffraction, the EDX measurement, and the EPMA measurement of the existing state of the oxide solid solutions will be described in Examples and Comparative Examples which will be described later.

<Tungsten Electrode Material Manufacturing Methods>

Next, tungsten electrode material manufacturing methods of this invention will be described.

Figure 5:
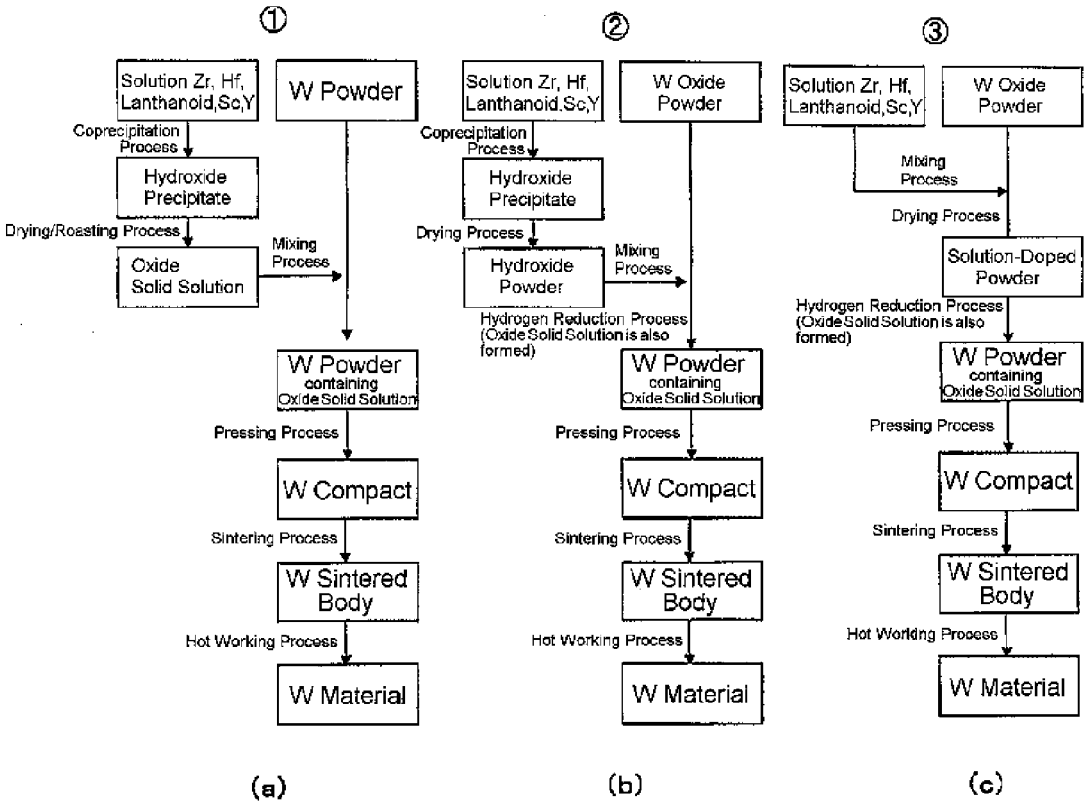
FIG. 5 shows flow diagrams of this invention.

As shown at (a), (b), and (c) in FIG. 5, there are three methods for manufacturing an electrode in which oxide solid solutions of this invention are dispersed.

The manufacturing method of (a) in FIG. 5 uses a tungsten powder while the manufacturing methods of (b) and (c) in FIG. 5 use a tungsten oxide powder. The manufacturing method to be used can be selected depending on whether the starting material is the tungsten powder or the tungsten oxide powder.

Further, the manufacturing method of (a) in FIG. 5 is a method of producing an oxide solid solution in advance and then mixing it, while, each of the manufacturing methods of (b) and (c) in FIG. 5 is a method of mixing a mixture as a precursor of an oxide solid solution with tungsten oxide and then changing the precursor into the oxide solid solution in a later process.

Hereinbelow, a production method will be described for each of the manufacturing methods shown at (a), (b), and (c) in FIG. 5.

<Production Method according to Manufacturing Method of (a) in FIG. 5>

[Process of producing Hydroxide Precipitate]

In the manufacturing method of (a) in FIG. 5, a hydroxide precipitate of Zr hydroxide and Er hydroxide is first produced using a coprecipitation method.

First, Zr chloride (purity 99.9 mass %) and Er chloride (purity 99.9 mass %) are dissolved in water so that the composition contains 80 mol % $ZrO_2$ and 20 mol % $Er_2O_3$ (this is given as a solution A).

The mass ratio of the respective chlorides $ZrCl_4$ and $ErCl_3$ to be dissolved in the water is determined such that since 1 mole of $Er_2O_3$ contains 2 moles of Er, the ratio of moles of Er to the sum of moles of Zr and Er becomes 20%×2=40%, i.e. 0.4.

The chlorides corresponding to the composition of a desired oxide solid solution are dissolved so that the concentration of the solution is adjusted to 0.5 mol/L in the total moles of Zr and Er.

Then, the solution A is stirred. The solution A shows acidity. Sodium hydroxide (purity 99 mass %) is dissolved in water and the concentration is adjusted to 0.5 mol/L (this is given as a solution B). The solution B shows alkalinity. Upon dropping the aqueous solution B into the stirring solution A, neutralization reactions occur so that Zr ions and Er ions both become hydroxides so as to be precipitated.

The solution B continues to be dropped and, when the pH of the solution A exceeds pH7, the neutralization reactions are completed. Alternatively, the concentrations and amounts (volumes) of the solutions A and B may be determined so that metal ions in the solution A and $OH^-$ ions in the solution B are all reacted.

The precipitate of the hydroxides can be separated using precipitation, filtration, or a centrifugal separator. By appropriately repeating washing and separation to remove excessive $OH^-$ ions and other ions contained in the precipitate of the hydroxides, there is obtained a precipitate of the hydroxides (hereinafter referred to as a "hydroxide precipitate").

The production conditions are not limited to the above-mentioned method. For example, in the case of a coprecipitation method, an oxide solid solution powder production method can be rationalized such that (1) nitrate, sulfate, or the like is used instead of chloride, (2) a basic solution such as aqueous ammonia is used instead of a sodium hydroxide solution, (3) adjustment is carried out to increase the concentration of a solution, or the like, (4) adjustment is carried out to raise the temperature of a solution in the formation of a precipitate, or the like, or (5) the concentrations and amounts (volumes) of solutions A and B are determined so as to increase the pH at the completion of mixing of the solutions.

The combination and compositions of components of a solution are required to be the combination and compositions of components of a solid solution according to a phase diagram of an oxide of Zr or Hf and an oxide of Sc, Y, or a lanthanoid, or the like and the preparation thereof can be appropriately changed depending on required thermionic emission properties, economical efficiency, and so on.

[Process of Producing Hydroxide Powder]

Then, the hydroxide precipitate is heated to thereby produce a powder in a dried state. For drying the hydroxide precipitate, use can be made of a method of heating up to about 100° C. to 250° C. using an evaporating dish, a spray dryer, a vacuum dryer, or the like. This powder is a powder of Zr and Er hydroxides with moisture slightly remaining.

This moisture is preferably completely removed, but is also removed in the next drying/roasting process (heat treatment).

[Process of producing Oxide Solid Solution Powder]

Then, the hydroxide powder is heat-treated, thereby producing an oxide solid solution powder in which $ZrO_2$ and $Er_2O_3$ are solid-dissolved.

An atmosphere of the heat treatment is not limited to the atmosphere. It may be an atmosphere of nitrogen, argon, vacuum, or the like as long as the hydroxides can be dehydrated.

The lower limit of the temperature of the heat treatment is 500° C. This is because if it is below 500° C., the hydroxides remain as they are so that a desired oxide solid solution powder cannot be obtained. The upper limit of the temperature is less than the melting point of the oxide solid solution. Further taking into account the aggregation and seizure of the oxide solid solution powder, the adjustment of the particle size of the powder, and the capability and productivity of a furnace, the temperature is preferably 500 to 1500° C.

The obtained oxide solid solution powder has a purity of 99 mass % or more and a particle size of about 1 to 10 μm. The particle size of the oxide solid solution powder is a value measured by a laser diffraction method (the same in other Examples).

[Process of Producing Mixture Powder of Oxide Solid Solution Powder and Tungsten Powder]

The mixture powder can be produced by a method which is popular as a tungsten manufacturing method, such as mixing using a mixer or a mortar.

In this Example, a general tungsten powder having a purity of 99.9 mass % (3N) is used. However, using a high-purity tungsten powder with less metal impurities, it is possible to prevent the melting point depression of the tungsten base alloy and thus to reduce the wear of an electrode.

[Process of Producing Compact]

Then, the mixture powder is press-formed into a compact (also referred to as a "pressed body") by a method which is popular as a tungsten manufacturing method, such as metal mold pressing or cold isostatic pressing (CIP).

Taking into account the shape retainability of the compact and the sintered body density, the pressing pressure is preferably 98 MPa to 588 MPa which is generally used. According to need such as obtaining a strength necessary for handling the pressed body, presintering may be suitably carried out.

[Process of producing Sintered Body]

Then, the compact is sintered in a non-oxidizing atmosphere to produce a sintered body.

The compact is sintered at 1750° C. or more, thereby obtaining the sintered body having a relative density of 95% or more. The sintering temperature is preferably set to 1800° C. in consideration of the sintered body productivity and to 2000° C. or more in consideration of improving the sintered body density.

The upper limit of the sintering temperature is set to less than the melting point of tungsten in consideration of maintaining the shape of the compact.

The sintering method can be sintering by indirect heating or sintering by direct electric heating. Generally, the sintering temperature is 2400° C. or less in the former due to restriction of an apparatus, while, is 3000° C. or less in the latter.

An atmosphere of the sintering can be suitably selected from a general hydrogen gas reducing atmosphere, inert argon atmosphere, and vacuum. The sintering temperature and time are not limited to the conditions given in the later-described Examples of this invention, but can be properly set in consideration of a required sintered body density, the processability in the next plastic working, and so on.

[Process of Producing Tungsten Rod Material (Also Called Rod-Shaped Material or Columnar Material)]

Then, plastic working is applied to the sintered body so as to generally provide a relative density of 98% or more, thereby producing a tungsten rod material. This is because the mechanical properties or the like are required for an electrode.

As the plastic working, use can be made of a method which is popular as a tungsten material manufacturing method, such as hot swaging, drawing, or rolling.

<Production Method according to Manufacturing Method of (b) in FIG. 5>

This method is a production method which uses a tungsten oxide powder instead of the tungsten powder used at (a) in FIG. 5. A particular difference from the production method of (a) in FIG. 5 resides in [Process of producing Oxide Solid Solution Powder].

Hereinbelow, this method will be described.

[Process of producing Hydroxide Precipitate]

First, a hydroxide precipitate of Zr hydroxide and Er hydroxide is produced using the coprecipitation method described in the production method of (a) in FIG. 5.

[Process of Producing Hydroxide Powder]

Then, a powder in a dried state is produced using the production method described in the production method of (a) in FIG. 5.

[Process of producing Mixture]

Then, the hydroxide powder obtained above and the tungsten oxide powder are mixed together to produce a mixture. The purity of the tungsten oxide is such that the purity of tungsten excluding oxygen is 99.9 mass % or more. The particle size is preferably 1 to 10 μm (measured by the Fsss (Fischer) method).

The mixture can be produced by mixing using a method which is popular as a tungsten manufacturing method, such as a mixer.

[Process of Producing Oxide Solid Solution Powder]

Then, by reducing the mixture in a hydrogen atmosphere, the tungsten oxide powder becomes a tungsten powder and, simultaneously, the powder of Zr and Er hydroxides as a precursor of an oxide solid solution becomes an oxide solid solution powder. In this manner, a mixture powder of the tungsten powder and the oxide solid solution powder is produced.

The lower limit of the reduction temperature is 500° C. This is because if it is below 500° C., the hydroxides of the hydroxide powder remain as they are so that a desired oxide solid solution powder cannot be obtained, and further, the tungsten oxide is not reduced so that subsequent sintering cannot be carried out. The upper limit of the temperature is less than the melting point of the oxide solid solution. Further taking into account the aggregation of the oxide solid solution powder, the adjustment of the particle size of the powder, the seizure of the powder, the reduction of the tungsten oxide, and the capability and productivity of a furnace, the temperature is preferably 800 to 1000° C.

The reduction of the tungsten powder for a tungsten electrode is generally carried out at 800 to 1000° C. so that the precursor produced in this production method of (b) in FIG. 5 or a precursor produced in a later-described process of (c) in FIG. 5 can be completely solid-dissolved in the reduction process.

As the tungsten oxide, use can be made of tungsten trioxide ($WO_3$), blue oxide (typical composition formula $W_4O_{11}$), tungsten dioxide ($WO_2$), or the like.

Hereinbelow, [Process of producing Compact], [Process of producing Sintered Body], and [Process of producing Tungsten Rod Material] are the same as those described at (a) in FIG. 5.

<Production Method according to Manufacturing Method of (c) in FIG. 5>

This method is, like (b) in FIG. 5 described above, a production method which uses a tungsten oxide powder instead of the tungsten powder of (a) in FIG. 5.

Hereinbelow, this method will be described.

[Process of Doping (Mixing) Solid Solution Precursor into Tungsten Oxide Powder]

First, a solution in which Zr chloride and Er chloride are dissolved in water at a predetermined ratio is produced as a precursor of an oxide solid solution and then is mixed with a tungsten oxide powder.

This mixture may be produced by using nitrate, sulfate, or the like instead of chloride, increasing the concentration of the solution, diluting the aqueous solution with ethyl alcohol, or the like.

The above-mentioned mixing is carried out by a general method using a mixer or the like for use in the manufacture of tungsten.

Then, the mixture is heated at about 100° C. to 250° C., thereby producing a mixed/dried tungsten oxide powder.

For the drying, use is made of the same method as [Process of producing Hydroxide Powder] of (a) in FIG. 5.

Moisture is preferably completely removed, but is also removed in the next hydrogen reduction process.

[Process of producing Oxide Solid Solution Powder]

Then, by reducing the mixture in a hydrogen atmosphere as in the production method of (b) in FIG. 5, the tungsten oxide powder becomes a tungsten powder and, simultaneously, a powder of an oxide solid solution of $ZrO_2$ and $Er_2O_3$ is formed. In this manner, a mixture powder of the tungsten powder and the oxide solid solution powder is produced. The lower limit and the upper limit of the reduction temperature and the tungsten oxide used are the same as those in the production method of (b) in FIG. 5. However, although tungsten is obtained by the reduction in the hydrogen atmosphere, Zr or Er metal alone is not obtained while $ZrO_2$ and $Er_2O_3$ are produced.

This is evident from the known thermodynamic data.

That is, as a value $\Delta G°$ of the standard free energy of formation of oxidation (per mole of oxygen) decreases, the reaction proceeds in a direction that produces an oxide. For example, $\Delta G°$ of the following chemical reaction formulas at 1027° C. are as follows, respectively.

$$2H_2+O_2=2H_2O\ \Delta G°_{H2O}=-352\ \text{kJ/mol} \quad (1)$$

$$2/3W+O_2=2/3WO_3\ \Delta G°_{WO3}=-342\ \text{kJ/mol} \quad (2)$$

$$Zr+O_2=ZrO_2\ \Delta G°_{ZrO2}=-853\ \text{kJ/mol} \quad (3)$$

$$4/3Er+O_2=2/3Er_2O_3\ \Delta G°_{Er2O3}=-1016\ \text{kJ/mol} \quad (4)$$

From (1) and (2), it is seen that hydrogen is more easily oxidized than tungsten. That is, this shows that a tungsten oxide can be reduced with hydrogen at this temperature. On the other hand, in a comparison between (1), (3), and (4), it is seen that Zr and Er are more easily oxidized than hydrogen. That is, this shows that Zr or Er metal alone is not obtained while their oxides are formed in a hydrogen atmosphere. In the case of not only Zr and Er, but also Hf, Sc, Y, and the lanthanoids, $\Delta G°$ are smaller than (1) and thus their oxides are formed.

Hereinbelow, [Process of producing Compact], [Process of producing Sintered Body], and [Process of producing Tungsten Rod Material] are the same as those described at (a) in FIG. 5.

Taking into account the required thermionic emission properties and processability, the mixture ratio of the oxide solid solution powder to the tungsten powder can be arbitrarily changed in the electrode material of this invention. In other words, the oxide solid solution content of the electrode material as a final product can be properly designed. The content ranges will be shown in the later-described Comparative Examples.

Using a method, other than the above-mentioned production methods of (a), (b), and (c), such as mixing with a tungsten powder a solution, in which Zr chloride and Er chloride are dissolved at a predetermined ratio, as a precursor of an oxide solid solution, or mixing with a tungsten oxide powder an oxide solid solution powder prepared in advance, it is possible to produce a tungsten electrode material in which oxide solid solution particles are finally dispersed in a tungsten material.

EXAMPLES

Hereinbelow, the tungsten electrode material of this invention will be described in further detail with reference to specific Examples.

First, tungsten electrode materials as evaluation samples, shown in the following Examples 1 to 13, were produced by the method of (a) in FIG. 5.

Example 1

The mass ratio of Zr chloride and La chloride (manufactured by Aldrich, purity 99.9 mass %) was determined so as to provide 95 mol % $ZrO_2$ and 5 mol % $La_2O_3$. The Zr chloride and the La chloride were dissolved in water and the concentration was adjusted to 0.2 mol/L. While stirring an obtained aqueous solution, 2 mol/L aqueous ammonia was dropped into the aqueous solution. The aqueous ammonia was dropped until the aqueous solution reached pH8, thereby obtaining a hydroxide precipitate of Zr and La.

Then, the hydroxide precipitate was dried at 200° C. and then the dried hydroxide precipitate was roasted in the atmosphere at 1000° C., thereby obtaining an oxide solid solution powder. This powder was confirmed to be a solid solution powder of $ZrO_2$ and $La_2O_3$ by X-ray diffraction. The particle size of the obtained oxide solid solution was about 1 to 10 μm.

Then, the above-mentioned $ZrO_2$—$La_2O_3$ oxide (95 mol % $ZrO_2$ and 5 mol % $La_2O_3$ were solid-dissolved) powder was mixed with a general tungsten powder having a purity of 99.9 mass % or more and an average particle size of about 4 μm (measured by the Fsss (Fischer) method). Then, the obtained tungsten powder was mold-pressed at 196 MPa, thereby obtaining a cylindrical compact with a diameter of 30 mm and a height of 20 mm. The mixing amount of the $ZrO_2$—$La_2O_3$ oxide was adjusted so that it would be finally contained at 1.0 mass % in a tungsten electrode material.

Then, sintering was carried out in a hydrogen atmosphere at 1800° C. for 10 hours, thereby producing a tungsten electrode material of this invention. The relative density of the obtained cylindrical tungsten electrode material was about 95%.

Example 2

A tungsten electrode material was produced in the production sequence of Example 1 except that a $ZrO_2$-20 mol % $Sm_2O_3$ oxide solid solution was used.

Example 3

An oxide in which $ZrO_2$ and $Er_2O_3$ were solid-dissolved was produced in the production sequence of Example 1. Specifically, a $ZrO_2$—$Er_2O_3$ oxide solid solution (78 mol % $ZrO_2$ and 22 mol % $Er_2O_3$ were solid-dissolved) powder was mixed with a general tungsten powder having a purity of 99.9 mass % or more and an average particle size of about 4 μm (measured by the Fsss (Fischer) method).

Then, the tungsten powder was press-formed, then heated in a hydrogen atmosphere at 1200° C. for 1 hour, and then subjected to electric current sintering in a hydrogen atmosphere at 2500° C. to 3000° C., thereby producing a rod-shaped tungsten electrode material with a cross-section of 25 mm×25 mm.

Example 4

[Process of producing Tungsten Rod Material] described above was applied to the sintered body of Example 3, thereby producing a rod-shaped tungsten electrode material.

Example 5

A tungsten electrode material was produced in the production sequence of Example 1 except that a $ZrO_2$-22 mol % $Er_2O_3$ oxide solid solution powder was used.

Example 6

A tungsten electrode material was produced in the production sequence of Example 1 except that a $ZrO_2$-25 mol % $Yb_2O_3$ oxide solid solution powder was used.

Example 7

A tungsten electrode material was produced in the production sequence of Example 1 except that a $ZrO_2$-23 mol % $Y_2O_3$ oxide solid solution powder was used.

Example 8

A tungsten electrode material was produced in the production sequence of Example 1 except that a $ZrO_2$, $HfO_2$—$Er_2O_3$ (22 mol % $Er_2O_3$, 39 mol % $ZrO_2$, 39 mol % $HfO_2$) oxide solid solution powder was used.

Example 9

A tungsten electrode material was produced in the production sequence of Example 1 except that a $HfO_2$-22 mol % $Er_2O_3$ oxide solid solution powder was used.

Example 10

A tungsten electrode material was produced in the production sequence of Example 4 except that the content (mass %) of the $ZrO_2$—$Er_2O_3$ oxide solid solution powder of Example 3 was set to 0.5%.

Example 11

A tungsten electrode material was produced in the production sequence of Example 4 except that the content (mass %) of the $ZrO_2$—$Er_2O_3$ oxide solid solution powder of Example 3 was set to 5%.

Example 12

A tungsten electrode material was produced in the production sequence of Example 1 except that the rare earth oxide composition of the $ZrO_2$—$Er_2O_3$ oxide solid solution of Example 3 was changed to $ZrO_2$-10 mol % $Er_2O_3$.

Example 13

A tungsten electrode material was produced in the production sequence of Example 1 except that the rare earth oxide composition of the $ZrO_2$—$Er_2O_3$ oxide solid solution of Example 3 was changed to $ZrO_2$-40 mol % $Er_2O_3$.

The relative densities of the electrode materials obtained in Examples 2, 3, 5 to 9, 12, and 13 were the same as that in Example 1. The relative densities of the electrode materials obtained in Examples 4, 10, and 11 were about 98%.

Then, tungsten electrode materials as evaluation samples, shown in the following Reference Examples 1 to 3 (Comparative Examples 1 to 3), were produced as reference examples and, further, tungsten electrode materials as evaluation samples, shown in the following Comparative Examples 4 to 16, were produced as comparative examples.

Reference Example 1

Comparative Example 1

A tungsten electrode material was produced in the production sequence of Example 4 except that the content of the $ZrO_2$—$Er_2O_3$ oxide solid solution of Example 3 was set to 0.1 mass %.

It was possible to apply plastic working in Reference Example 1 Comparative Example 1).

Reference Example 2

Comparative Example 2

A tungsten electrode material was produced in the production sequence of Example 4 except that the content of the $ZrO_2$—$Er_2O_3$ oxide solid solution of Example 3 was set to 6 mass %.

As a result, it was not possible to apply plastic working in Reference Example 2 (Comparative Example 2).

Reference Example 3

Comparative Example 3

A tungsten electrode material was produced in the production sequence of Example 4 except that the content of the $ZrO_2$—$Er_2O_3$ oxide solid solution of Example 3 was set to 10 mass %.

It was not possible to carry out sintering in Reference Example 3 (Comparative Example 3).

Then, in Comparative Examples 4 to 8, oxides were arbitrarily selected from complex oxides shown in Patent Document 1, then, using the production sequence of Example 1, a mixture powder of a powder of each of the selected oxides and a tungsten powder was mold-pressed into a cylindrical compact at 196 MPa. Then, since the sintering temperature was not shown in the specification of Patent Document 1, sintering was carried out in a hydrogen gas atmosphere for 10 hours at 1800° C. where sintering of tungsten was enabled, thereby producing tungsten electrode materials.

Specifically, the following oxides were used.

Comparative Example 4

$CaZrO_3$ (manufactured by Kojundo Chemical, purity 99 mass %) was used as an oxide.

Hereinbelow, in Comparative Examples 5 to 8, the tungsten electrode materials were produced using the complex oxides shown in Patent Document 1 like in Comparative Example 4.

Comparative Example 5

$SrZrO_3$ (manufactured by AlfaAeser, purity 99 mass %) was used as an oxide.

Comparative Example 6

$BaZrO_3$ (manufactured by AlfaAeser, purity 99 mass %) was used as an oxide.

Comparative Example 7

$SrHfO_3$ (manufactured by Kojundo Chemical, purity 99 mass %) was used as an oxide.

Comparative Example 8

$BaHfO_3$ (manufactured by Kojundo Chemical, purity 99 mass %) was used as an oxide.

Then, in Comparative Examples 9 to 13, oxides were arbitrarily selected from oxides shown in Patent Documents 2 and 3 and mixtures each of an oxide of Zr or Hf and an oxide of Sc, Y, or a lanthanoid and the oxides alone were selected, thereby producing tungsten electrode materials in the production sequence of Example 1.

Specifically, the following oxides were used.

Comparative Example 9

A mixture of $ZrO_2$ alone and $Y_2O_3$ alone (manufactured by Kojundo Chemical, purity 99 mass %, 77 mol % $ZrO_2$ and 23 mol % $Y_2O_3$) was used as an oxide.

Comparative Example 10

A mixture of $HfO_2$ alone and $Er_2O_3$ alone (manufactured by Wako Pure Chemical, purity 99 mass %, 78 mol % $HfO_2$ and 22 mol % $Er_2O_3$) was used as an oxide.

Comparative Example 11

$ZrO_2$ (manufactured by Kojundo Chemical, purity 99 mass %) was used as an oxide.

Comparative Example 12

$La_2O_3$ (manufactured by Wako Pure Chemical, purity 99 mass %) was used as an oxide.

Comparative Example 13

$Y_2O_3$ (manufactured by Kojundo Chemical, purity 99 mass %) was used as an oxide.

Then, Comparative Examples 14 to 16 were produced in the following sequences.

Comparative Example 14

A tungsten electrode material was obtained in the same production sequence as in Example 3 except that a Zr oxide alone and an Er oxide alone were used as oxides. More specifically, using commercial products as oxides, a powder of the respective commercial $ZrO_2$ and $Er_2O_3$ oxides (manufactured by Wako Pure Chemical, 78 mol % $ZrO_2$ and 22 mol % $Er_2O_3$) each having a purity of 99 mass % was mixed with a general tungsten powder having a purity of 99.9 mass % or more.

Comparative Example 15

A tungsten electrode material containing a coexisting substance of a La-metal oxide and a Zr-metal oxide was produced according to Example 1 of Patent Document 4.

Specifically, through a process of producing an oxide coexisting substance using commercial $La_2O_3$ and $ZrO_2$ oxides alone each having a purity of 99 mass % (manufactured by Wako Pure Chemical, $La_2O_3$:$ZrO_2$=1:2 in molar ratio), an attempt was made to obtain a tungsten electrode material in the same production sequence as in Example 3 by mixing with a tungsten powder the coexisting substance mainly composed of substantially a mixture of the oxides. However, when a compact obtained by pressing was heated in a hydrogen atmosphere at 1200° C., a presintered body was deformed and thus was unable to be supplied to the next electric current sintering process.

Comparative Example 16

A commercial tungsten electrode material containing $ThO_2$-2.0 mass % thorium oxide was prepared.

Except Reference Examples 2, 3 and Comparative Example 15, where the sintering or plastic working were unable to be carried out, the relative densities of the electrode materials obtained in Comparative Examples 4 to 14 were the same as that in Example 1. The relative density of the electrode material obtained in Reference Example 1 was about 98%.

<Oxide State Confirmation Results by X-Ray Diffraction>

Then, the tungsten electrode materials of Examples 1 to 13, Reference Example 1, and Comparative Examples 4 to 14 were subjected to X-ray diffraction, thereby confirming the state of the oxides.

<X-ray Diffraction Results of Examples 1 to 13>

Figure 7:
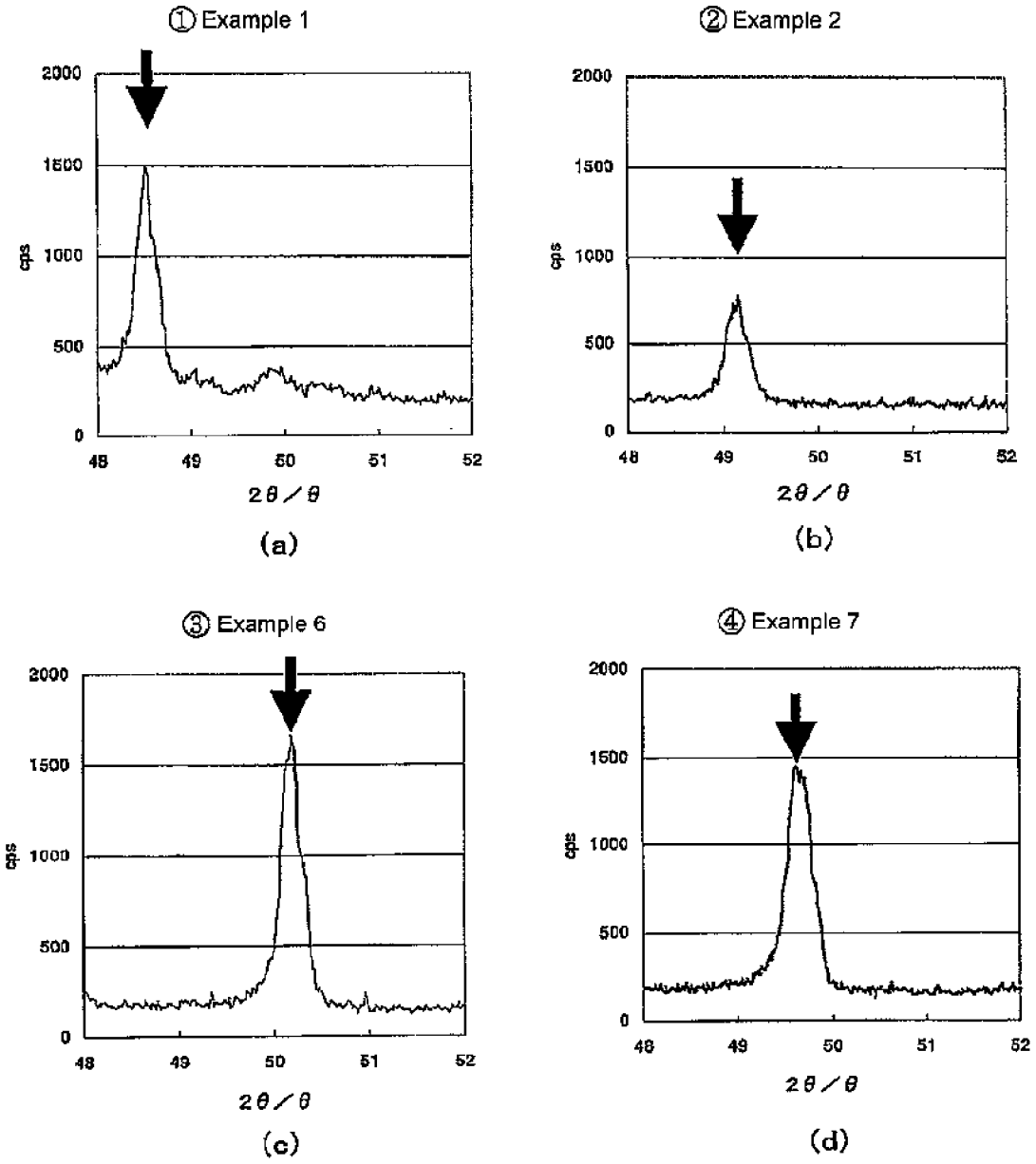
FIG. 7 shows the results of X-ray diffraction of tungsten electrode materials of Examples 1, 2, 6, and 7.

As a result of X-ray diffraction of the tungsten electrode materials of Examples 1, 2, 6, and 7, as shown in FIG. 7, the peaks of tungsten and the peaks of the respective oxide solid solutions (peaks indicated by arrows of circled numbers 1 to 4 in FIG. 7, in this case, peaks of (220) planes) were measured. That is, the oxide solid solution maintained its solid-dissolved state in the tungsten material without being lost even after the sintering.

The reason that the values of $2\theta/\theta$ are different from each other for the peaks of the same crystal planes is because the values of $2\theta/\theta$ that show the peaks differ depending on the solid-dissolved elements and the composition ratios thereof.

In the oxide solid solution confirmation method described before, attention was paid to the highest intensity line among the peaks obtained by the X-ray diffraction. However, in the case of the X-ray diffraction of the tungsten electrode material containing the oxide solid solution, there is a case where the highest intensity line of the oxide solid solution is close to the peak of tungsten and thus is difficult to detect, and therefore, the oxide state confirmation was performed paying attention to the peaks different from the highest intensity line.

Figure 10:
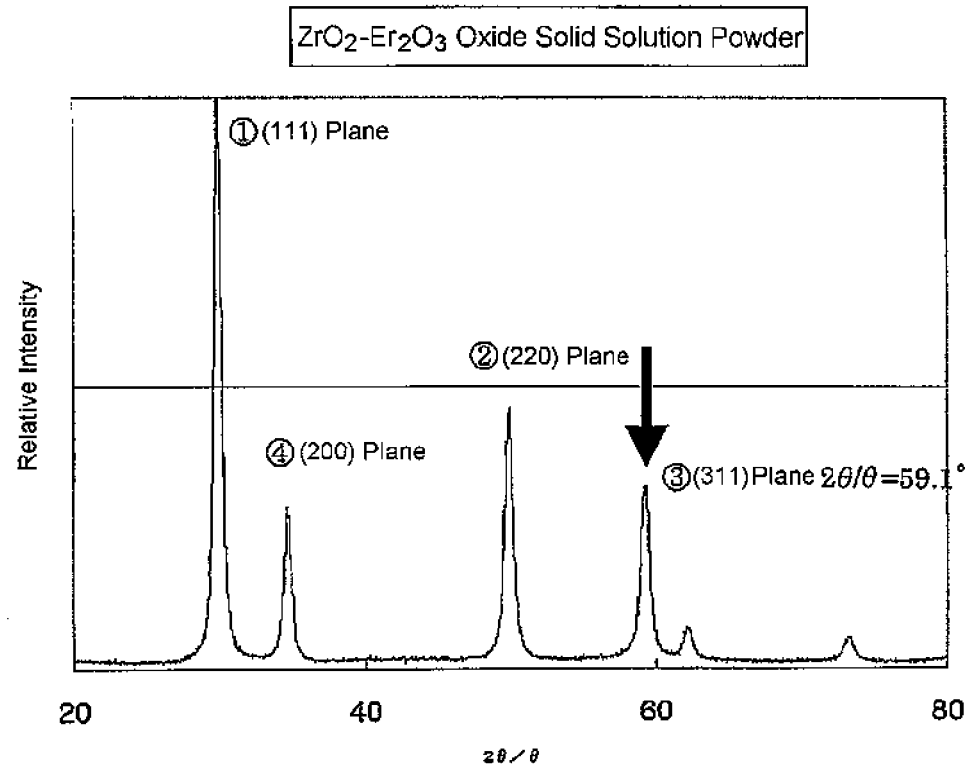
FIG. 10 shows (a) a diagram showing the results of X-ray diffraction of a $ZrO_2$—$Er_2O_3$ oxide solid solution powder, (b) a diagram showing the results of X-ray diffraction of Example 3, and (c) a diagram showing the results of X-ray diffraction of Comparative Example 14.
Figure 10:
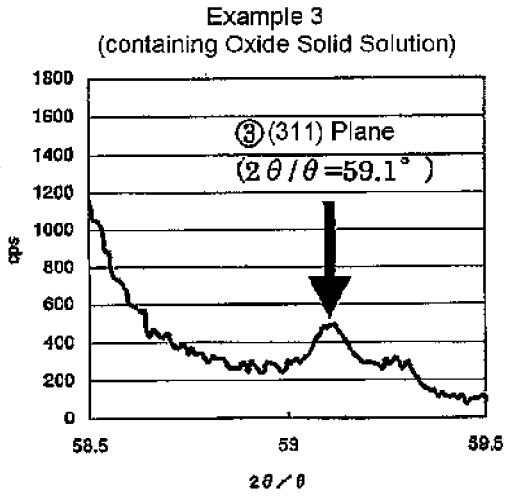
Figure 10:
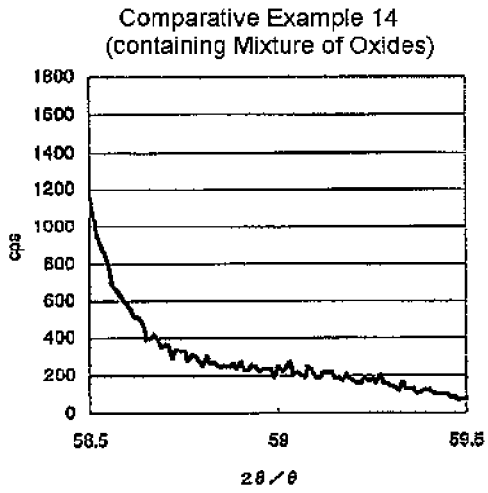

The results of X-ray diffraction of Example 3 are shown in FIG. 10(*b*). As shown by an arrow in the same figure, in the sample of Example 3, the peak of the $ZrO_2$—$Er_2O_3$ oxide solid solution was measured at 2θ/θ equal to that of the peak (peak of the oxide solid solution powder) indicated by an arrow of circled number 3 in FIG. 10(*a*). That is, it was confirmed that the $ZrO_2$—$Er_2O_3$ oxide solid solution contained in the sample of Example 3 maintained its solid-dissolved state in the tungsten electrode material without being lost even after the sintering.

Although not illustrated, the same X-ray diffraction results as in Example 3 were obtained in Example 4. Further, it was confirmed that the $ZrO_2$—$Er_2O_3$ oxide solid solution maintained its solid-dissolved state in the tungsten electrode material without being lost even after the swaging.

Figure 6:
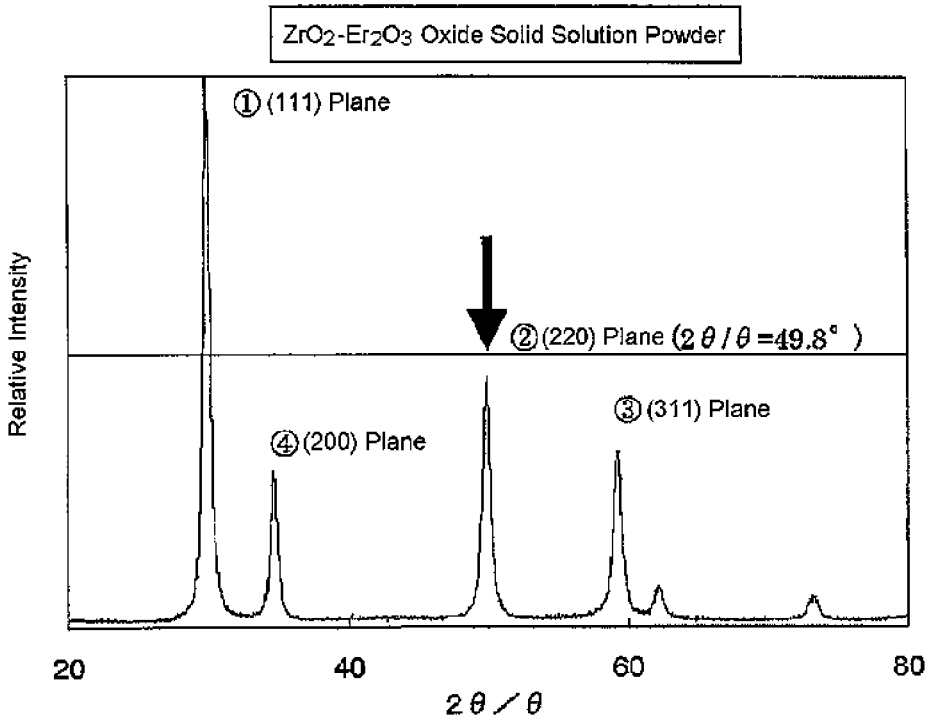
FIG. 6 shows (a) a diagram showing the results of X-ray diffraction of a $ZrO_2$—$Er_2O_3$ oxide solid solution powder and (b) a diagram showing the results of X-ray diffraction of a tungsten electrode material of Example 5.
Figure 6:
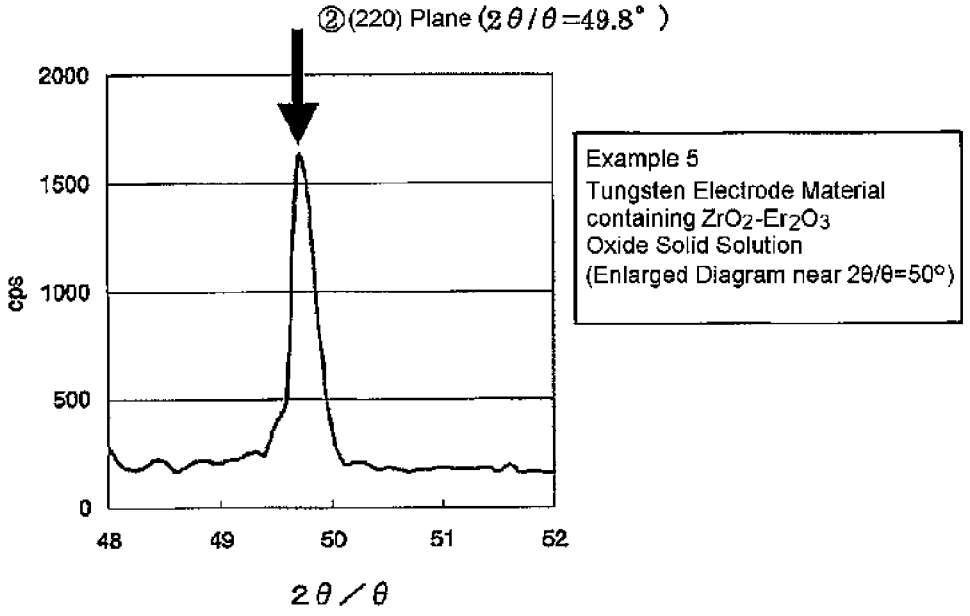

As a result of X-ray diffraction of the tungsten electrode material of Example 5, there were measured the peaks of tungsten and, as indicated by an arrow in FIG. 6(*b*), the same peak as the peak of the $ZrO_2$—$Er_2O_3$ oxide solid solution (powder) of circled number 2 in FIG. 6(*a*). (in this case, the peak of circled number 2 is the peak of (220) plane) That is, the $ZrO_2$—$Er_2O_3$ oxide solid solution maintained its solid-dissolved state in the tungsten electrode material without being lost even after the sintering.

As a result of X-ray diffraction of the tungsten electrode materials of Examples 8 to 13, the peaks of tungsten and the peaks of the respective oxide solid solutions were measured as in Examples 1 to 7. That is, the oxide solid solution maintained its solid-dissolved state in the tungsten electrode material without being lost even after the sintering.

The particle size of the oxide solid solutions contained in the tungsten electrode materials of Examples 1 to 13 was about 1 to 10 μm and thus was substantially the same as the particle size before the sintering.

The particle size of the oxide solid solution was measured using a SEM (scanning electron microscope) photograph of the powder and a microscopic photograph of a polished surface of the sintered body.

<X-Ray Diffraction Results of Reference Example 1 and Comparative Examples 4 to 14

As a result of X-ray diffraction of Reference Example 1, the peaks of tungsten and the peaks of the oxide solid solution were measured as in Examples 1 to 13. That is, the oxide solid solution maintained its solid-dissolved state in the tungsten electrode material without being lost even after the sintering.

Figure 8:
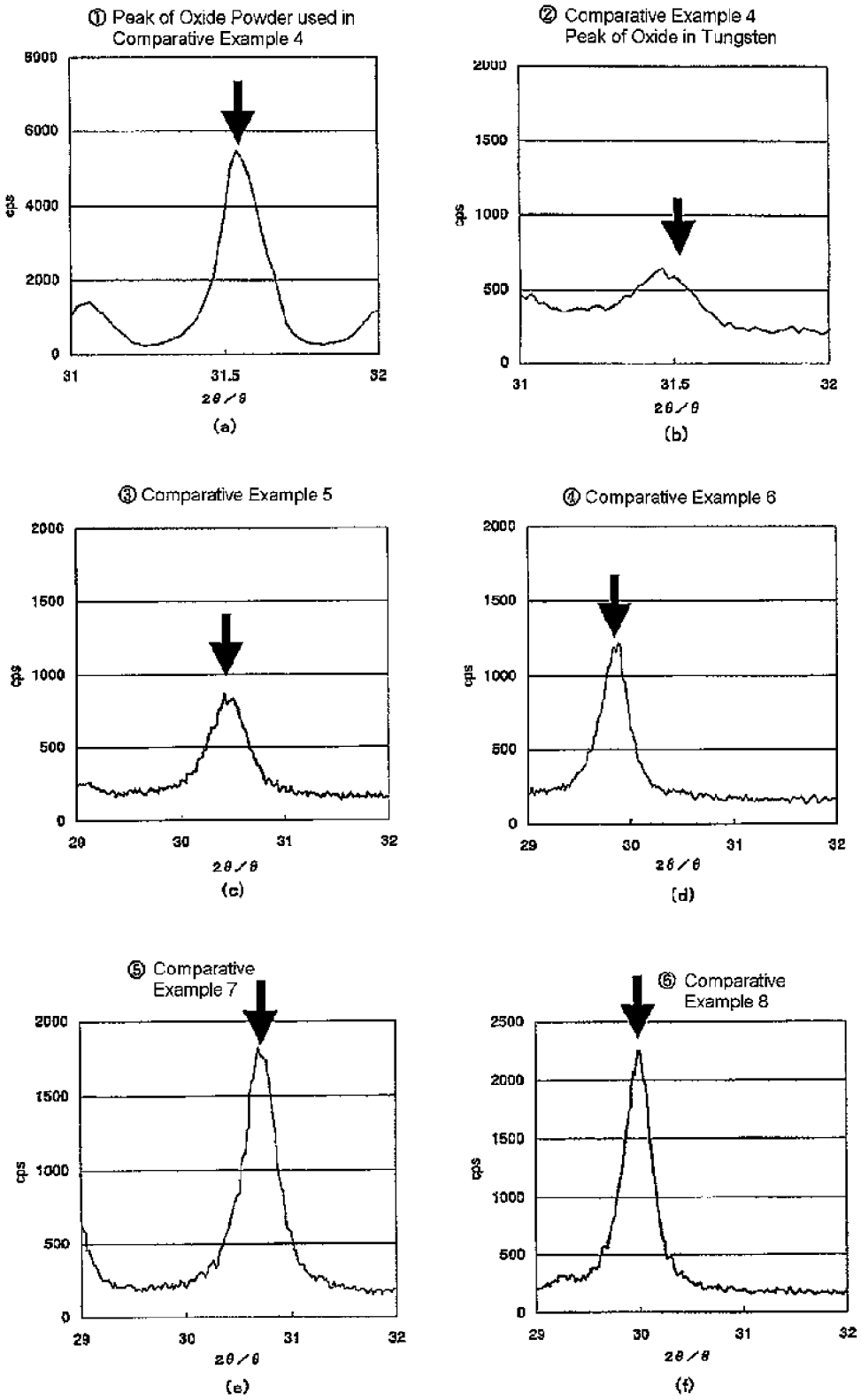
FIG. 8 shows the results of X-ray diffraction of Comparative Examples 4 to 8.

As a result of X-ray diffraction of Comparative Examples 4 to 8, the peaks of tungsten and the peaks of the respective complex oxides were measured as shown in FIG. 8. That is, it was confirmed that the complex oxide was in an existing state different from that of the oxide solid solution referred to in this invention even after the sintering.

The sample containing $CaZrO_3$ (1.4 wt %) of Comparative Example 4, the sample containing $SrZrO_3$ (1.7 wt %) of Comparative Example 5, and the sample containing $BaZrO_3$ (2.1 wt %) of Comparative Example 6 were subjected to later-described thermionic emission measurement and then the oxides on thermionic emission surfaces were subjected to a qualitative analysis by EDX. As a result, it was found that only Zr and O remained.

Further, the sample containing $SrHfO_3$ (2.4 wt %) of Comparative Example 7 and the sample containing $BaHfO_3$ (2.7 wt %) of Comparative Example 8 were subjected to the later-described thermionic emission measurement and then the oxides on thermionic emission surfaces were subjected to a qualitative analysis by EDX in the same manner. As a result, it was found that only Hf and O remained. That is, in the case of the complex oxides or the mixtures contained in the samples of Comparative Examples 4 to 8, the elements other than Zr or Hf were decomposed and evaporated during heating so that only the Zr oxide or the Hf oxide remained.

Therefore, it was seen that the complex oxides of Comparative Examples 4 to 8, i.e. the complex oxides given in Patent Document 1, were not necessarily stable at a high temperature and thus were unable to maintain the thermionic emission properties for a long time. It is considered that, with respect also to electron emission materials described in U.S. Pat. No. 6,051,165 Specification relating to Patent Document 1, production means are the same and thus the thermionic emission properties cannot be maintained long just like the above.

Next, the results of X-ray diffraction of Comparative Examples 9 to 14 will be described.

Figure 9:
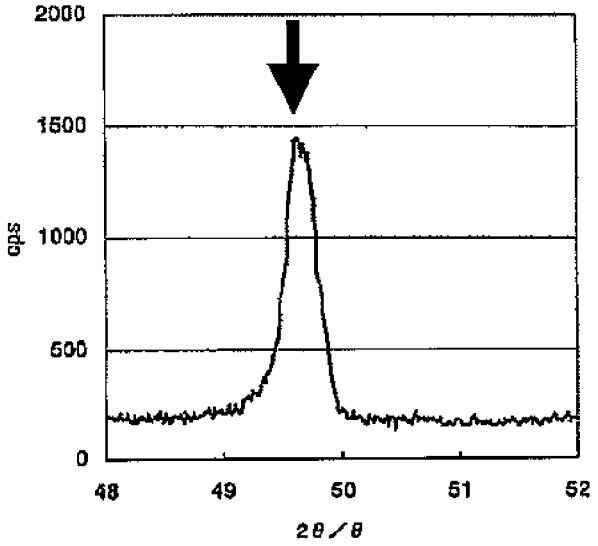
FIG. 9 shows (a) a diagram showing the results of X-ray diffraction of a $ZrO_2$—$Y_2O_3$ oxide solid solution and (b) a diagram showing the results of X-ray diffraction of Comparative Example 9.
Figure 9:
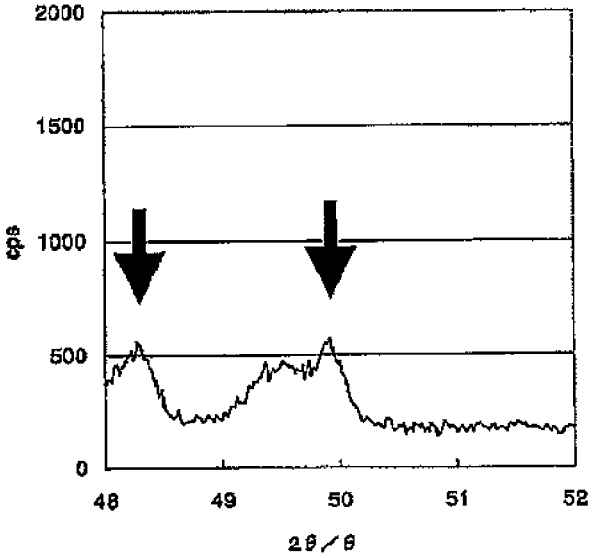

First, the X-ray diffraction results of Comparative Example 9 are shown in FIG. 9(*b*). The constituent elements (Zr, Y, and O) of the oxide of Comparative Example 9 were the same as those of Example 7. However, the peak (arrow of circled number 1 in FIG. 9(*a*)) of the $ZrO_2$—$Y_2O_3$ oxide solid solution was not observed while the peaks (arrows of circled number 2 in FIG. 9(*b*)) of $ZrO_2$ and $Y_2O_3$ were respectively observed. That is, it was confirmed that the oxide mixture of $ZrO_2$ and $Y_2O_3$ did not form a solid solution even if sintered and it was seen that the mixed state was maintained in the tungsten electrode material.

Likewise, in Comparative Example 10, the peak of the $HfO_2$—$Er_2O_3$ oxide solid solution was not observed while the peaks of $HfO_2$ and $Er_2O_3$ were respectively observed. It was confirmed that when $HfO_2$ and $Er_2O_3$ were added in the form of the individual oxides, the oxides did not form a solid solution and it was found that even if the oxide mixture was added, the oxide mixture maintained its state in the tungsten electrode material, i.e. maintained the mixed state.

In each of Comparative Examples 11 to 13, the oxide alone was mixed with tungsten and sintered and the original oxide was maintained even after the sintering.

The X-ray diffraction results of Comparative Example 14 are shown in FIG. 10(*c*). As seen from the same figure, the peak of the $ZrO_2$—$Er_2O_3$ oxide solid solution was not measured in the sample of Comparative Example 14. That is, it was confirmed that even if $ZrO_2$ and $Er_2O_3$ were mixed with tungsten and sintered, the oxides did not form an oxide solid solution.

This supports that, as described before, the different oxides are in the state of being individually dispersed in the tungsten compact of the prior arts and, therefore, even if, for example, the electric current sintering is carried out, it is difficult for all the oxide particles to cause mass transport so as to take the form of a solid solution.

<Evaluation of Thermionic Emission Properties>

In order to evaluate the thermionic emission properties corresponding to the properties of an electrode material for use in a discharge lamp or the like, cylindrical evaluation samples each having a diameter of 8 mm and a height of 10 mm were produced by applying cutting, polishing, and degreasing to the respective tungsten electrode materials of Examples 1 to 13, Reference Example 1, Comparative Examples 4 to 14, and Comparative Example 16 (commercial product) which were obtained by the above-mentioned methods, and then the thermionic emission was measured using a thermionic emission current measuring device 100 which was created by the present inventors for evaluating a tungsten electrode material of this invention.

First, the structure of the thermionic emission current measuring device 100 and its measuring method will be described.

First, referring to FIG. 21, the outline of the structure of the thermionic emission current measuring device 100 according to this embodiment will be described.

Figure 21:
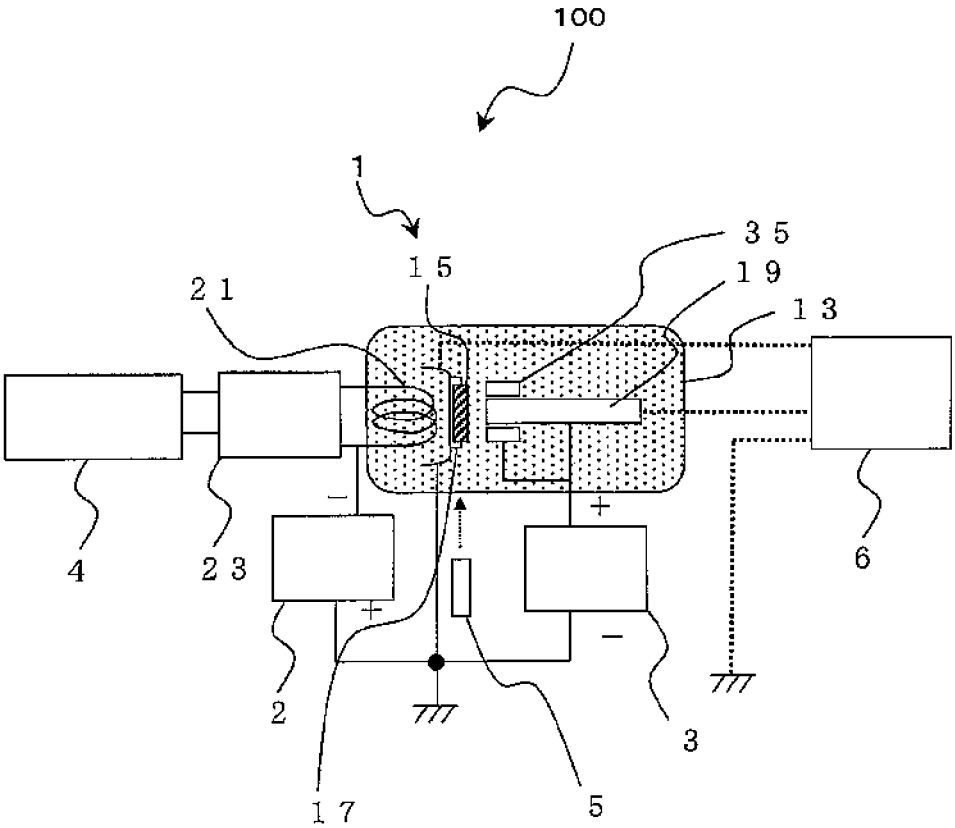
FIG. 21 is a diagram showing a schematic structure of a thermionic emission current measuring device 100 of this invention.

As shown in FIG. 21, the thermionic emission current measuring device 100 comprises a measuring device body 1 forming an electron bombardment heating means, a DC power supply 2, a pulsed power supply 3, and a current-voltage measuring device 6 (oscilloscope) forming a thermionic emission current measuring means.

The DC power supply 2 and the pulsed power supply 3 form a power supply device.

The thermionic emission current measuring device 100 further comprises a temperature measuring portion 5 as a heating temperature measuring means.

Next, the measuring device body 1 will be described in more detail with reference to FIG. 21.

As shown in FIG. 21, the measuring device body 1 comprises a vacuum chamber 13, a sample stage 17 provided in the vacuum chamber 13 for placing thereon a cathode 15 as a measurement sample, an anode 19 provided in the vacuum chamber 13, and a filament 21 provided in the vacuum chamber 13.

The filament 21 is connected to a filament power supply 4 having an isolation transformer 23.

The isolation transformer 23 is for heating the filament 21 and provides isolation between the DC power supply 2 for electron bombardment heating and the filament power supply 4 to prevent direct electrical connection therebetween.

Next, the outline of a thermionic emission current measuring method using the thermionic emission current measuring device 100 will be briefly described with reference to FIGS. 21 and 22.

First, using the filament power supply 4, a current is supplied to the filament 21 so that the filament 21 is heated to emit thermal electrons. A voltage is applied to the filament 21 using the DC power supply 2 to accelerate the thermal electrons, thereby applying electron bombardment to the sample serving as the cathode 15 to heat it.

Then, a pulse voltage is applied to the anode 19 and, using the current-voltage measuring device 6 (oscilloscope), the voltage between ground and the anode 19 and the voltage between ground and the cathode 15 are measured. Simultaneously with this, the amount of thermal electrons reaching the anode 19 from the heated cathode 15, i.e. the current, is also measured using the current-voltage measuring device 6 (oscilloscope).

Figure 22:
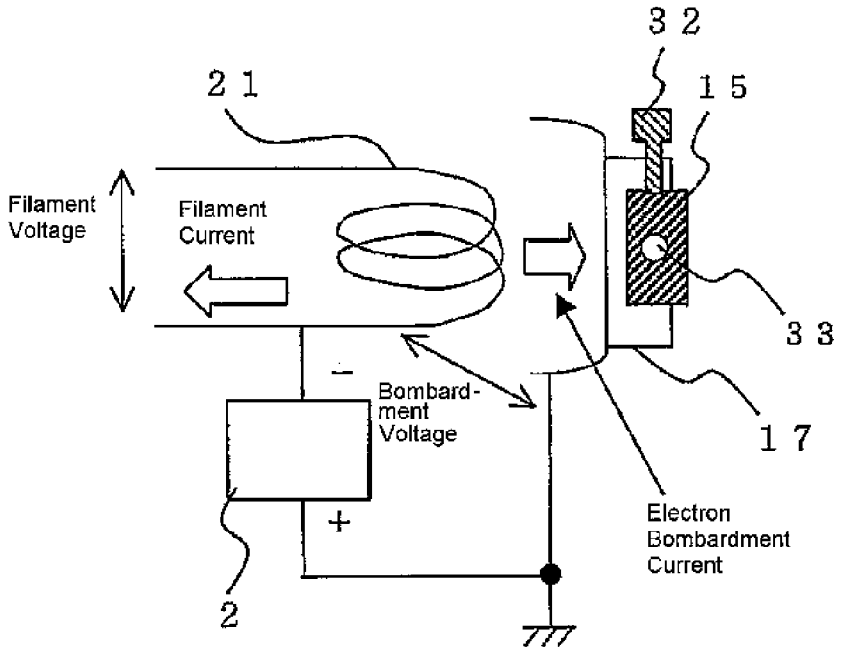
FIG. 22 shows enlarged diagrams of an electron bombardment heating portion in FIG. 21.
Figure 22:
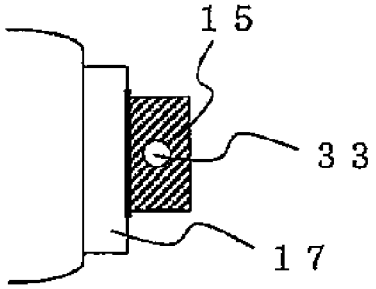
Figure 22:
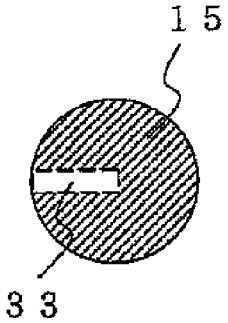

Herein, as shown in an enlarged diagram of an electron bombardment heating portion, i.e. FIG. 22(*a*), the filament 21, which is supplied with AC power from the isolation transformer 23 to be heated, is set to a negative potential with respect to ground using the DC power supply 2 for electron bombardment heating. Since the cathode 15 is at the same potential as ground, thermal electrons emitted from the filament 21 proceed to the cathode 15 to effect electron bombardment heating of the cathode 15. As a consequence, the cathode 15 with a defined area can be heated to a predetermined temperature.

Next, the structure of the measuring device body 1, the thermionic emission current measuring method, and a work function calculation method will be described in more detail with reference to FIGS. 21 to 24.

<Measuring Device Body 1>

As described above, the measuring device body 1 comprises the vacuum chamber 13, the sample stage 17 for placing the cathode 15 thereon, the anode 19, and the filament 21.

(Vacuum Chamber 13)

Taking into account that it is possible to avoid oxidative degradation of the sample serving as the cathode 15 and to carry out electron bombardment heating without any problem, it is preferable that the vacuum chamber 13 can achieve high vacuum. However, the purpose can be accomplished with a general vacuum device. For example, a stable vacuum atmosphere required for this invention can be obtained by properly remodeling the inside of a chamber of MUE-ECO manufactured by ULVAC, Inc. The pressure inside of the vacuum chamber 13 is required to be $10^{-4}$ Pa or less even during heating for the purpose of electron bombardment heating. This, however, can be realized by combining known baking equipment, a turbomolecular pump or a cryopump, and a rotary pump.

(Sample Stage 17)

It is necessary that the sample stage 17 be configured to apply electron bombardment heating to the back side of the cathode 15, thereby making it possible to accurately heat a large-area surface of the cathode 15 to a temperature high enough for thermionic emission which is difficult to obtain by electric heating.

Therefore, it is sufficient for the sample stage 17 to have a structure that can fix the cathode 15 for electrode material evaluation aimed at by this invention.

Specifically, the sample stage 17 is preferably formed of, for example, a molybdenum material having heat resistance.

The structure thereof may be such that, as illustrated in FIG. 22(*a*), a circular flat surface portion adapted to receive electron bombardment is formed into an annular shape with a recess and the cathode 15 can be inserted into this recess and fixed by a screw 32 or the like.

As illustrated in FIG. 22(*b*), a fixing method may be brazing or use can be made of an arbitrary technique such as electron beam welding.

(Cathode 15)

The cathode 15 is preferably made of a material composed mainly of a high melting point metal.

As shown in FIG. 22(*c*), the cathode 15 has a disk shape and has a certain or greater size so that it is possible to reduce its deformation in high-temperature heating and further to measure the thermionic emission current more accurately.

Further, as shown in later-described Examples, the outer diameter of the cathode 15 is preferably set to, for example, about ϕ8 mm. This is because it is possible to obtain a measurement-limit current density and necessary pulse voltage and current.

In order to accurately measure the temperature of the cathode 15, a temperature measuring hole 33 is provided from a side wall of the cathode 15 toward its center as shown in FIG. 22(*c*). This is because, by providing the temperature measuring hole 33 having a depth of 4 or more with respect to an inlet diameter of 1, the emissivity corresponding to blackbody radiation becomes 1 so that the emission temperature measurement can be carried out with high accuracy.

Conductivity is required for electron bombardment heating. Therefore, it is difficult to heat a material composed mainly of a non-conductive ceramic or resin. However, the cathode 15 is not limited to a high melting point pure metal. It may be a metal containing an oxide, a carbide, or the like or an alloy containing a plurality of components. Specifically, it may be a material in which the electrical conduction can be confirmed, for example, the resistivity is about $1\times10^{-6}$ Ωm or less at room temperature.

(Anode 19)

Figure 23:
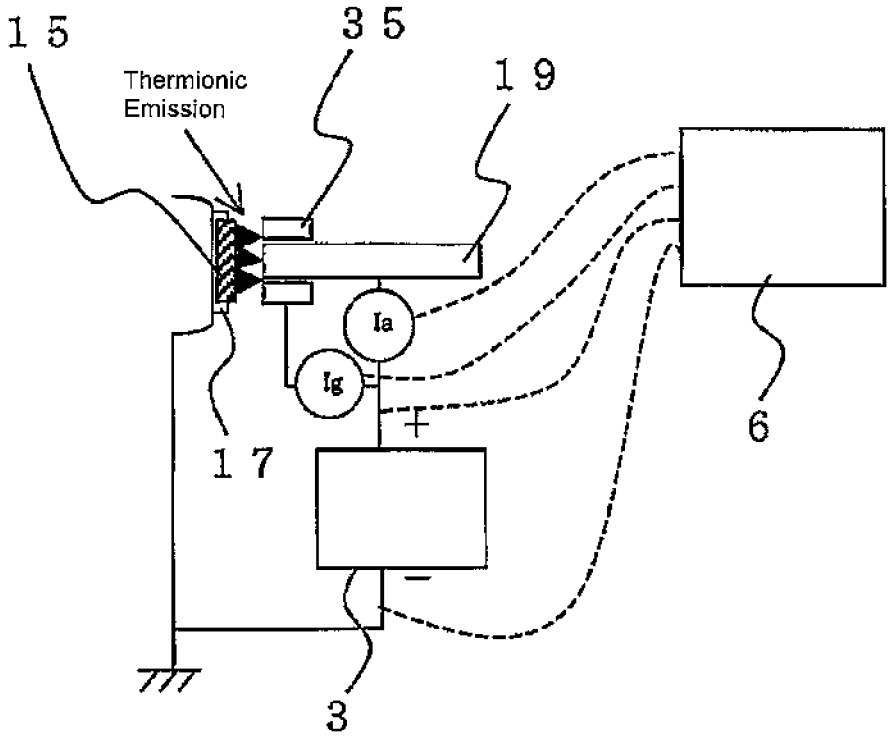
FIG. 23 shows diagrams respectively showing the measurement system of a cathode 15 and an anode 19 and the layout of the anode 19 and a guard ring 35.
Figure 23:
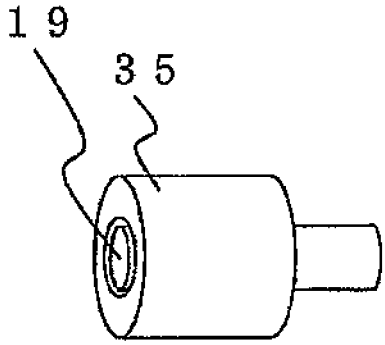

As shown in FIG. 23(*a*), the anode 19 is configured to be disposed coaxially with the sample stage 17 for placing the cathode 15 thereon.

As shown in FIG. 23(*b*), in this embodiment, the anode 19 is in the form of a circular solid molybdenum round bar and has a cylindrical guard ring 35, also made of molybdenum, on the circumference of a front end portion of the anode, thereby forming a guard ring added anode.

It is necessary that a front end face of the anode 19 and an end face of the guard ring 35 be flush with each other in order to prevent the occurrence of unevenness in electric field distribution and to remove the edge effect as intended. The material of the anode and the guard ring 35 is not necessarily limited to molybdenum as long as it is a high melting point metal that does not degrade in a test.

The anode 19 is disposed in a state of being insulated from the vacuum chamber 13.

Since the anode 19 is configured to use the guard ring 35, the accuracy of the diameter allows a plus tolerance, and if the offset of the center axis is within a range where the guard ring 35 is provided (position where the circumference of the guard ring 35 is located in a direction perpendicular to an end portion of the cathode 15), it is possible to carry out a measurement in which the area of the anode 19 is defined, without any problem.

With the configuration described above, it is possible to measure the accurate thermionic emission current density by capturing thermal electrons emitted from the cathode 15 by the anode 19 having the guard ring 35.

Figure 24:
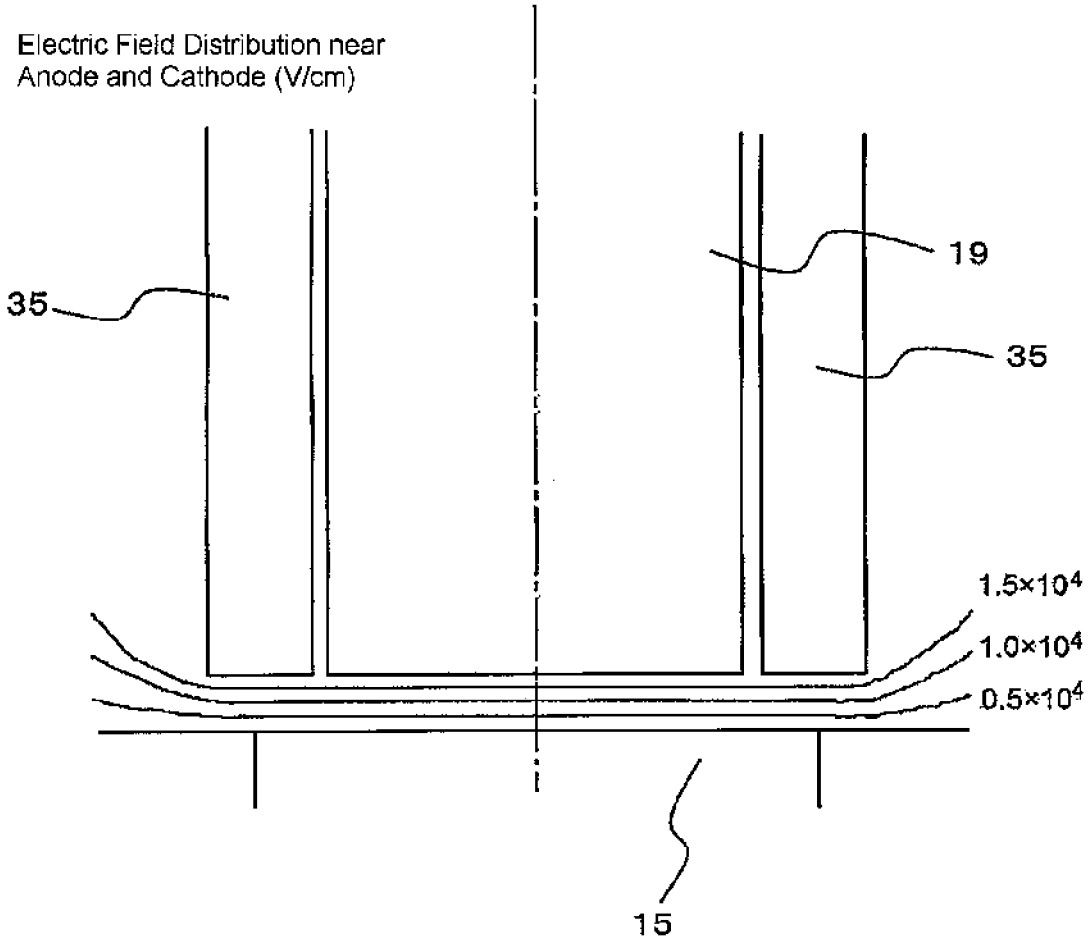
FIG. 24 is a diagram showing the calculation results of electric field distribution at the anode 19 and the guard ring 35.

As seen from FIG. 24, if the anode 19 facing the cathode 15 is provided alone, the electric field between the anode and cathode caused by an applied pulse voltage becomes uneven at a center portion and an end portion of the anode 19 (edge effect appears), and therefore, the guard ring 35 is provided on the circumference of the facing anode 19.

That is, by providing the guard ring 35, the anode 19 is free of the influence of the edge effect so that uniform electric field distribution is provided, and therefore, it is possible to measure uniform current density.

In this embodiment, the facing anode 19 and the guard ring 35 are held parallel to the cathode 15 with a distance of 0.5 mm therebetween. The cross-sectional area of the guard ring 35 is set to be equal to or greater than that of the anode 19. The facing anode 19 and the guard ring 35 are disposed coaxially with the cathode 15.

(Relationship in Size Between Cathode 15 and Anode 19)

In this embodiment, a thermionic emission surface of the cathode 15 has a diameter of ϕ8 mm and an electrode cross-section of the anode 19 has a diameter of ϕ6.2 mm. A current due to thermal electrons reaching the electrode cross-section of the anode 19, i.e. the cross-section with the diameter of ϕ6.2 mm, from the cathode 15 is a thermionic emission current. Herein, in this embodiment, the guard ring 35 is configured to have an outer diameter of ϕ9.2 mm and an inner diameter of ϕ6.6 mm with a clearance of 0.2 mm from the anode 19 so as not to affect the measurement current.

Herein, preferable shapes, structures, and layouts of the cathode 15, the anode 19, and the guard ring 35 will be described in detail.

As shown in FIGS. 21 to 24, each of their cross-sections is preferably circular. This is because, in a shape other than a circle, such as, for example, a square, the edge effect appears more significantly at corners.

The diameter of the cathode 15 is preferably ϕ1 mm or more for preventing the edge effect like the anode 19 and is more preferably ϕ3 mm to ϕ20 mm in terms of the measurement lower limit of current and the restriction of the heating power supply which will be described later.

In the measurement of this invention using the known measuring device, the measurement lower limit of current is about 1 mA. When pure tungsten is used as the cathode 15 and heated to 2200K to obtain a work function of 4.5 eV, the thermionic emission current density from the cathode 15 is about 0.029 A/cm$^2$ from the Richardson-Dushman equation. Therefore, given that the cathode area necessary for emitting a current of 1 mA is $1\times10^{-3}/0.029=0.034$ cm$^2$, the lower limit of the diameter of the cathode 15 is 2.1 mm.

The upper limit of the diameter of the cathode 15 is restricted by the upper limit of the output of the DC power supply 2 for electron bombardment heating. As the diameter increases, the sample weight increases so that the output required for heating increases. In this invention using the known device, the diameter of 20 mm is the upper limit.

The diameter of the anode 19 preferably satisfies "cathode diameter anode diameter+1 mm" in the range of 3 to 19 mm. However, the upper limit 19 mm of the diameter of the anode 19 may possibly be less than 19 mm depending on the thermionic emission current density of the cathode 15 and the measurement upper limit of the measuring device.

If the diameter of the anode 19 is less than 3 mm, the current becomes below the measurement lower limit of current and thus is difficult to measure. If it exceeds 19 mm, the influence of the edge effect cannot be ignored when the cathode diameter is the maximum of 20 mm. In the case of a sample whose thermionic emission current is relatively large, when the diameter of the anode 19 is large, there is a possibility that the current exceeds the measurement upper limit of current to damage the measuring device.

The inner diameter of the guard ring 35 preferably satisfies "anode diameter+1 mm≥guard ring inner diameter > anode diameter". This is because the inner diameter of the guard ring 35 is preferably as close to the diameter of the anode 19 as possible in order to remove the edge effect of the anode 19, while, if it exceeds the anode diameter+1 mm, the effect of removing the edge effect is reduced.

The outer diameter of the guard ring 35 preferably satisfies "guard ring outer diameter cathode diameter+1 mm" and "guard ring cross-sectional area/anode cross-sectional area ≥1". This is because unless these are satisfied, the effect of removing the edge effect is reduced. However, it is necessary that the upper limit of the outer diameter of the guard ring 35 be reconsidered to be smaller depending on the thermionic emission current density of the cathode 15 and the measurement upper limit of the measuring device.

The distance between the cathode 15 and the anode 19 is preferably in the range of 0.1 mm to 1 mm. This is because if the distance is large, the electric field strength decreases even at the same pulse voltage so that the actual measurement current decreases to approach the measurement region lower limit.

On the other hand, if the distance between the cathode 15 and the anode 19 becomes less than 0.1 mm, the possibility increases that the cathode 15 and the anode 19 are brought into contact with each other due to thermal expansion of the constituent components and so on. If it exceeds 1 mm, there is a possibility that the current becomes below the measurement lower limit of emission current and thus is unable to be measured.

Unless the difference in height between the anode 19 and the guard ring 35 is set to 0.1 mm or less, the electric field distribution becomes uneven so that accurate current measurement cannot be carried out.

(Filament 21)

In this embodiment, the filament 21 serving as an electron source for electron bombardment heating is in the form of a coil of a tungsten line having a diameter of ϕ1 mm and is disposed on the back side of the sample stage 17.

<DC Power Supply 2>

As the DC power supply 2 for electron bombardment to the cathode 15, use can be made of, for example, a DC high-voltage stabilized power supply RR5-120 manufactured by GAMMA.

<Pulsed Power Supply 3>

An emission current can be accurately read by applying a pulse voltage.

In order to measure the thermionic emission current, it is necessary to apply a pulse voltage, i.e. an electric field, for collecting thermal electrons to the anode 19.

The pulsed power supply 3 can be a very popular high-pressure pulsed power supply and it is possible to use, for example, YHPG-40K-20ATR of YAMABISHI Corporation, or the like.

<Isolation Transformer 23 and Filament Power Supply 4>

The filament power supply 4 for heating the filament 21 is used by adjusting a supply voltage of 100V to an adequate voltage using Slidac. As the isolation transformer 23, use can be made of, for example, MNR-GT manufactured by UNION Electronics, Co., Ltd.

The isolation transformer 23 is for heating the filament 21 and provides isolation between the DC power supply 2 for electron bombardment heating and the filament power supply 4 to prevent direct electrical connection therebetween.

<Temperature Measuring Portion 5>

The temperature measuring portion 5 is used for measuring the temperature of the cathode 15 and a radiation thermometer is suitable for this. A monochromatic radiation thermometer with a short measurement wavelength is highly reliable in temperature measurement. For example, using TR-630 and a close-up lens No. 110 manufactured by Minolta Co., Ltd., it is possible to measure the temperature of a region with a diameter of ϕ0.4 mm.

In this embodiment, a measurement region at a temperature due to emission or less, for example, a region at 1000° C. or less, is measured by disposing a tungsten-rhenium thermocouple on the opposite side of the sample. By providing the temperature measuring hole 33 having a ratio L/D=5 between a hole depth L=5 mm and a diameter D=1 mm so that the emissivity of the sample is given by 1, the temperature of the sample is calculated using an effective emissivity of 0.92 obtained by multiplying together the emissivity of 1 and an absorptance of 0.92 on an optical path from the sample to the radiation thermometer. If a dichroic radiation thermometer is used, since it is not affected by the absorptance on the optical path, it is not necessary to accurately determine the absorptance on the optical path or the emissivity of the sample.

<Current-Voltage Measuring Device 6>

In order to read a current upon application of a pulse voltage, an oscilloscope is used as the current-voltage measuring device 6 in this embodiment. For example, DL9710L manufactured by Yokogawa Electric Corporation can be used.

<Measurement of Thermionic Emission Current>

The measurement system of the cathode 15 and the anode 19 is shown in FIG. 23(*a*). With an electrical circuit shown in the same figure, it is possible to read a thermionic emission current received by the anode 19, potential differences between the guard ring 35 and an anode and cathode of the pulsed power supply 3, and potential differences between the anode 19 and the anode and cathode of the pulsed power supply 3, using the current-voltage measuring device 6 (oscilloscope).

As the measurement sequence and the measurement conditions, the following can be given as an example.

1. A surface of the cathode 15 that emits thermal electrons and a surface of the electrode that faces the cathode 15 to receive the thermal electrons are polished and finished to a surface roughness of preferably Ra 1.6 μm or less. If the surface roughness is within Ra 5 μm, the measurement can be stably carried out. If the surface roughness exceeds Ra 10 μm, abnormal discharge possibly occurs at a projecting portion.

2. The temperature rising rate of the cathode 15 during heating is set to, for example, 1 to 20K/min.

3. The filament voltage and the filament current during heating and during maintaining the temperature are set to, for example, 4 to 5V and 24 to 26 A.

4. By setting the acceleration voltage for electron bombardment heating to, for example, 3 to 4 kV and the electron bombardment current to 30 to 240 mA, it is possible to heat the cathode 15 to a target high temperature.

5. The measurement of a thermionic emission current is started after the cathode 15 is maintained at a predetermined temperature.

In order to measure the thermionic emission current for deriving the work function, it is preferable to carry out the measurement after the cathode temperature becomes stable so that the emission current becomes stable. Therefore, it is preferable to carry out the measurement after 5 minutes from the start of maintaining the temperature. The reason is that if less than 5 minutes from the start of maintaining the temperature, the temperatures of the cathode 15 and peripheral components of the cathode 15 are not stabilized and thus the thermionic emission is also not stabilized, and therefore, the reproducibility of derivation of the work function cannot be obtained.

6. The thermionic emission current is measured by applying a pulse voltage of, for example, 200 to 1000V to the anode 19 facing the cathode 15.

7. The pulse duty is set to 1:1000.

Since the cathode 15 is cooled due to the thermionic emission from the cathode 15 during the application of the pulses, this is necessary for minimizing that temperature change and for measuring the current density while avoiding saturation of space charge.

For the removal of the edge effect and the uniform electric field distribution, which is the purpose of providing the guard ring 35, the same pulse voltage as that for the anode 19 is applied to the guard ring 35.

8. The current upon the application of the pulse voltage is read using the current-voltage measuring device 6 (oscilloscope).

Then, from the obtained current, the thermionic emission current density of the cathode 15 is derived by dividing the current value flowing to the anode 19 (excluding the guard ring 35) by the electrode cross-sectional area of the anode 19.

FIG. 24 is a diagram showing the calculation results of the electric field distribution at the anode 19 and the guard ring 35 according to this invention.

In the embodiment of this invention, in order to accurately capture the thermionic emission current from the cathode 15 by the anode 19, it is preferable that the electric field distribution near the anode 19 be uniform, i.e. there be no edge effect.

Therefore, the guard ring 35 is provided on the circumference of the anode 19. In order to clarify the effect thereof, electric field distribution was calculated in radial directions from the center axes of the cathode and the anode under the conditions of an applied voltage of 1000V and a cathode/anode distance of 0.5 mm.

From the same figure, it is seen that the electric field near the anode 19 and the cathode 15 is uniformly distributed and that the electric field is non-uniformly distributed only outside of the circumference of the guard ring 35 (edge effect appears only outside of the measurement range).

Figure 25:
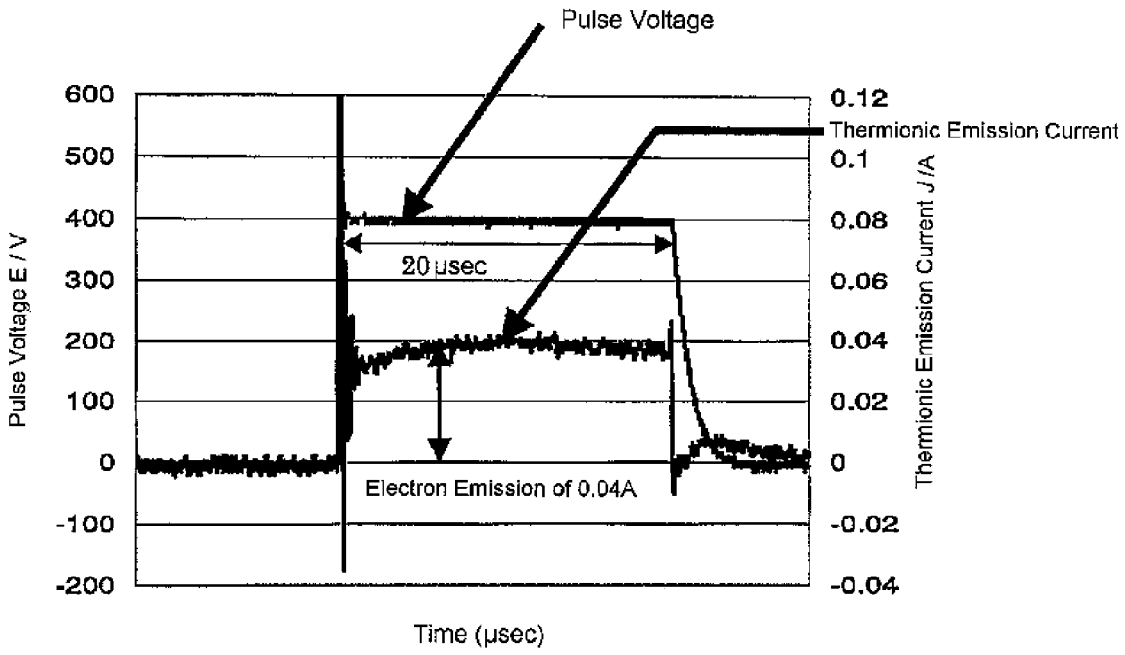
FIG. 25 is a diagram showing the electron emission current upon application of a pulse voltage.

FIG. 25 is a diagram showing the electron emission current upon application of a pulse voltage according to this invention.

When the pulse voltage is applied, the current due to thermionic emission gradually increases to reach a constant value. Immediately after the application of the pulse voltage, the current changes transiently. The measured value of the thermionic emission current referred to in this invention is a value when the current reached the constant value.

Since the electron emission properties change transiently due to evaporation of a metal contained as a base of a sample and evaporation of an oxide and so on contained in the sample, the change is significant particularly after exceeding 2300K and therefore, for deriving the work function, the measurement is preferably finished after 5 minutes but before 30 minutes from the start of maintaining the temperature, as a criterion.

That is, as shown in the Richardson-Dushman equation, the temperature is included in the exponential term and thus the error in temperature measurement largely affects the thermionic emission current, and therefore, it is important to accurately measure the temperature of the cathode 15 as the heated sample.

Hereinbelow, the thermionic emission current measuring method will be described in further detail.

The cathode 15 is placed in the vacuum chamber 13. The inside of the vacuum chamber 13 is maintained in a vacuum atmosphere ($10^{-4}$ Pa or less). The cathode 15 is heated by electron bombardment and is maintained at, for example, 1500 to 2473K. The pressure in the vacuum chamber 13 may become $1\times10^{-3}$ Pa or more during the heating, but is required to be $1\times10^{-4}$ Pa or less at time of measurement in order to measure electron emission in a vacuum. If the vacuum system is divided into two separate vacuum systems for use as a space for electron bombardment heating and a space for measuring the electron emission properties, it is possible to measure the electron emission properties without any influence of the pressure increase caused by electron bombardment heating during the heating.

<Work Function Calculation Method>

In order to calculate the work function, first, two or more maintaining temperatures are determined and the thermionic emission current density is measured at each temperature. More preferably, the number of maintaining temperatures is four or more. The difference between the highest maintaining temperature and the lowest maintaining temperature is preferably 40K or more.

Next, a method of deriving the work function from the thermionic emission current obtained in the above-mentioned measurement will be described hereinbelow.

First, there is obtained a current density in which the influence of the electric field is removed from the measured thermionic emission current density.

This is because the work function is primarily an ideal value with no influence of the electric field and, in this embodiment, since the pulse voltage is applied in the measurement of the thermionic emission current, it is necessary to subtract the influence of the electric field.

Specifically, the above-mentioned current density at each temperature is obtained in the following manner.

First, an electric field is derived from the pulse voltage and the distance between the cathode and the anode and measurement points are plotted with respect to the abscissa axis representing the square root of the electric field and the ordinate axis representing the logarithm of the current density. By obtaining a regression straight line for the plotted measurement points aligned linearly, it is possible to perform correction to subtract the influence of the electric field and the intercept of the straight line corresponds to a current density in which the influence of the electric field at that temperature is removed (FIG. 26).

Figure 26:
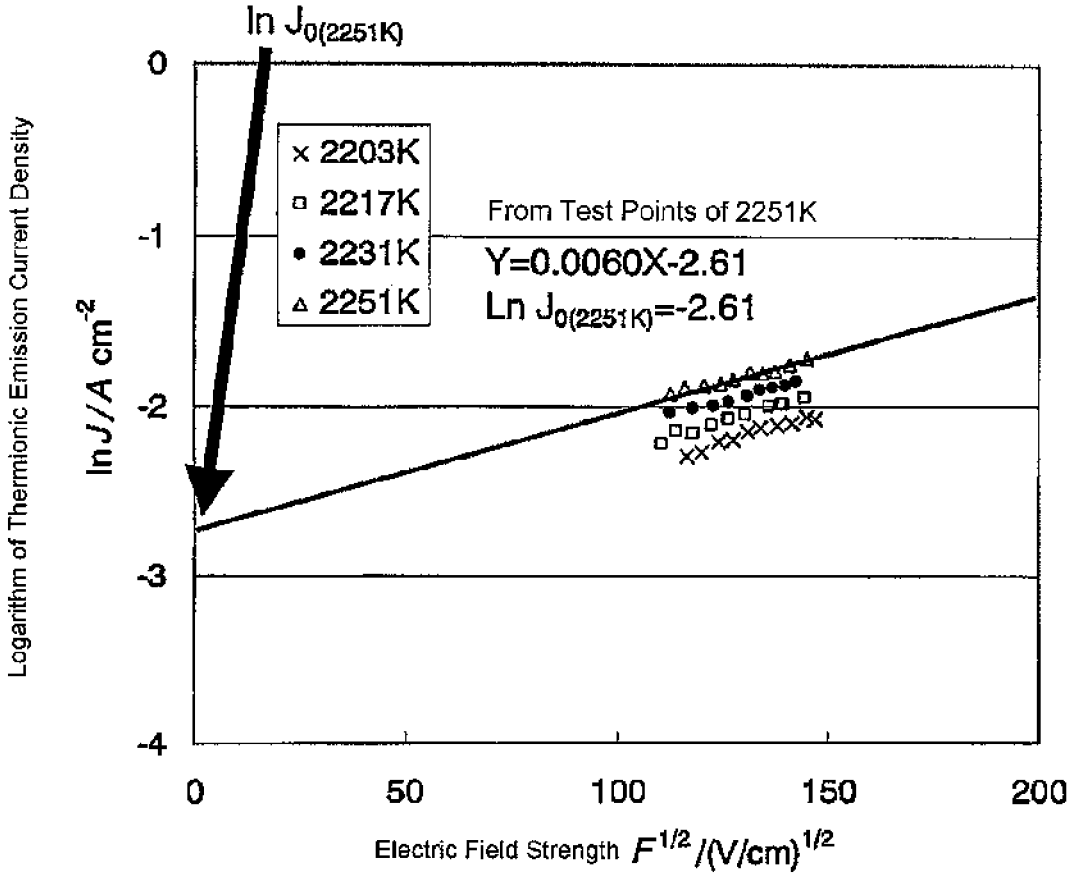
FIG. 26 is a diagram showing extrapolated values of the measured voltage and the thermionic emission current.

FIG. 26 shows extrapolated values of the measured voltage and the thermionic emission current.

In order to measure the thermionic emission current, it is necessary to apply a pulse voltage, i.e. an electric field, for collecting thermal electrons to the anode 19. In order to obtain a thermionic emission current excluding the influence of that electric field, measurement points aligned linearly are linearly approximated and the thermionic emission current is calculated from the intercept of this straight line.

The logarithm InJ of the thermionic emission current density is given as the ordinate axis Y of a graph while the square root $F^{1/2}$ of the applied electric field is given as the abscissa axis X of the graph. When, for example, measurement points of 2251K are linearly approximated, $Y=0.0060X-2.61$ so that a value: $-2.61$ of the intercept of this equation is the logarithm of a thermionic emission current density $J_{0(2251K)}$ excluding the influence of the electric field at 2251K. That is, $\ln J_{0(2251K)}=-2.61$.

Then, the work function is derived from the thermionic emission current densities excluding the influence of the electric field.

Figure 27:
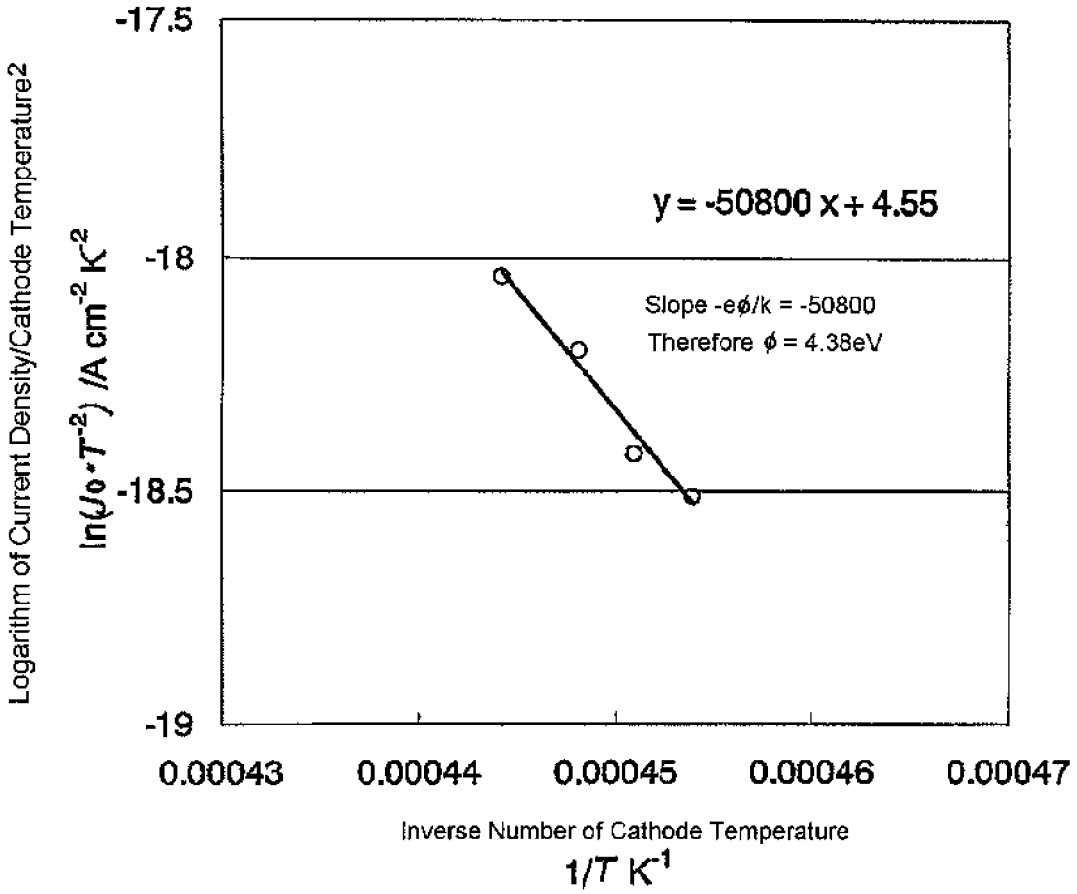
FIG. 27 is an example showing the derivation of the work function.

A specific sequence will be shown with reference to FIG. 27.

First, measurement points are plotted with respect to the abscissa axis representing the inverse number of the maintaining temperature (absolute temperature) and the ordinate axis representing the logarithm of a value obtained by dividing a current density by the square of a cathode temperature and a regression straight line is obtained from those points. Then, the slope and intercept of this straight line are calculated by the method of least squares or the like. Further, by modifying the Richardson-Dushman equation, it is possible to calculate a work function from the slope and a Richardson constant from the intercept.

Then, plotting is performed per cathode maintaining temperature with respect to the abscissa axis representing the inverse number of the cathode temperature (absolute temperature) and the ordinate axis representing the logarithm of a value obtained by dividing a thermionic emission current by the square of a cathode temperature. Finally, from the slope of a regression straight line of these points, it is possible to derive a work function.

For example, in the case where the test-point maintaining temperature is set to 2251K, first, the logarithm of the thermionic emission current density, specifically, the logarithm $\ln(J_0/T^2)$ of a value obtained by dividing a thermionic emission current density excluding the influence of the electric field by the square of a cathode temperature, is given as the ordinate axis Y of a graph.

Then, the inverse number 1/T of the cathode temperature is given as the abscissa axis X of the graph and the following values are plotted.

$$Y=\ln(J_{0/(2251K)}/2251^2)=-18.0$$

$$X=1/2251=0.000444$$

Then, test points of respective maintaining temperatures are linearly approximated and the slope and intercept are calculated by the method of least squares.

In a later-described Example, the slope is −50800 and the intercept is 4.55.

On the other hand, by modifying the Richardson-Dushman equation, the following equation is obtained.

$$\ln(J/T^2)=-e\phi/k\times(1/T)+\ln A \quad \text{(Equation 1)}$$

That is, the slope $-e\phi/k=-50800$ and, since e and k are constants, the work function $\phi$ can be obtained. In this case, $\phi=4.38$ eV.

Figure 28:
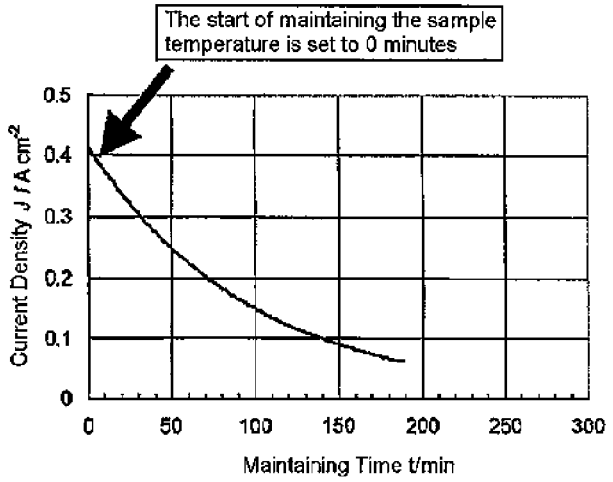
FIG. 28 shows examples of temporal change measurement.
Figure 28:
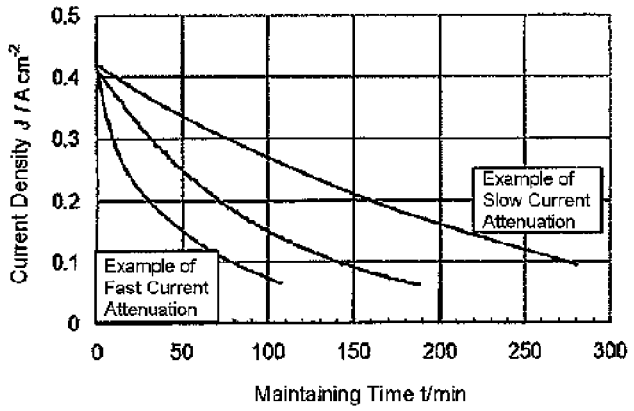
Figure 28:
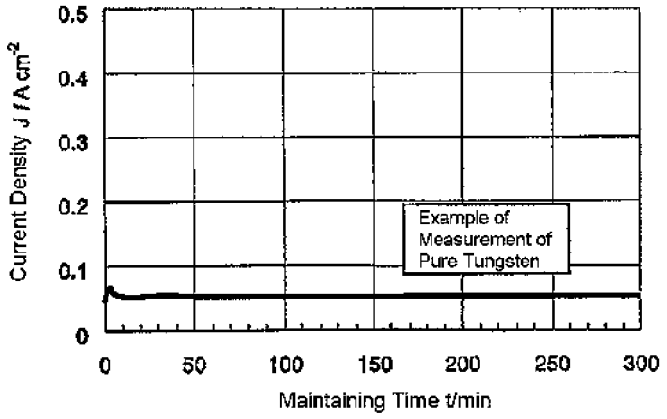

For the thermionic emission material, it is also important to measure the temporal change of the thermionic emission current. Also for this, the measurement can be carried out with time using the thermionic emission current measuring device 100 according to this embodiment. FIG. 28 shows examples of the temporal change measurement.

The foregoing are the structure of the thermionic emission current measuring device 100 and its measuring method.

Next, a specific sequence of evaluation of the thermionic emission properties of Examples 1 to 13, Reference Example 1, Comparative Examples 4 to 14, and Comparative Example 16 using the thermionic emission current measuring device 100 and the evaluation results will be described.

First, each evaluation sample (cathode 15) was placed in the vacuum chamber 13 and the inside of the vacuum chamber 13 was maintained in a vacuum atmosphere ($10^{-4}$ Pa or less). The evaluation sample was heated by electron bombardment and was maintained at 1877° C. The temperature rising rate during the heating was set to 15K/min and, during maintaining the temperature, the filament 21 as an electron source was heated at 5V and 24 A. The acceleration voltage for electron bombardment was applied at 3.2 kV to supply a current of 110 mA. For measuring the temperature of the evaluation sample, a radiation thermometer TR-630A manufactured by Minolta Co., Ltd. was used as the temperature measuring portion 5. The sample temperature was calculated using the effective emissivity 0.92 obtained by multiplying together the emissivity 1 of the evaluation sample and the absorptance 0.92 on the optical path. In general, when a deep hole is provided on an object to be measured, the emissivity of the bottom of the hole can be regarded as 1. Therefore, in the evaluation of this invention, by providing the temperature measuring hole 33 having a ratio L/r=10 between a hole depth L=10 and a radius r=1, the emissivity of the evaluation sample was regarded as 1. The absorptance of a window of the vacuum chamber 13 was measured as the absorptance on the optical path and it was 0.92.

The thermionic emission was measured by applying a pulse voltage of 400V to the electrode facing the evaluation sample. A surface of the sample adapted to emit thermal electrons and a surface of the electrode facing the sample to receive the thermal electrons, i.e. the anode 19, were polished to a surface roughness of Ra 1.6 μm or less. The pulse duty, i.e. the ratio between the time in which the pulse voltage is applied and the time in which the pulse voltage is not applied, was set to 1:1000.

As described before, if the anode 19 is provided alone, the electric field strength between the anode and cathode caused by the applied pulse voltage becomes uneven at the electrode center portion and the electrode end portion and, therefore, the guard ring 35 was provided on the circumference of the anode 19. The guard ring 35 had an outer diameter of 11 mm and an inner diameter of 6.6 mm. The pulse voltage synchronous with that for the electrode was applied to the guard ring 35. The anode 19 and the guard ring 35 were held parallel to the evaluation sample with a distance of 0.5 mm therebetween. The anode 19 was disposed coaxially with the evaluation sample.

The thermionic emission surface of the evaluation sample as the cathode 15 had a diameter D8.0 mm while the anode cross-section had D6.2 mm. Thermal electrons reaching the anode cross-section, i.e. the cross-section of D6.2 mm, from the cathode evaluation sample were received and a current value thereof was measured. In the measurement, the oscilloscope was used as the current-voltage measuring device 6 to read the current upon application of the pulse voltage. Then, the current value was divided by the cross-sectional area of the anode 19 to derive a current density.

In this manner, while maintaining the evaluation sample of the tungsten electrode material of this invention at 1877° C., temporal changes in current density due to the thermionic emission were recorded.

First, when the evaluation sample was maintained at 1877° C., the initial current density of the evaluation sample showed a maximum of about 0.6 A/cm$^2$ due to the electron emission. With the lapse of the maintaining time, evaporation of the oxides proceeded and thus the electron emission decreased so that the current density converged to about 0.02 A/cm$^2$. Each evaluation sample was taken out when the current density reached about 0.02 A/cm$^2$, and then was observed by SEM and subjected to a qualitative analysis by EDX. As a result, it was seen that the oxides on the thermionic emission surface were lost with only tungsten remaining.

This value is close to a theoretical value of thermionic emission of pure tungsten. A current density J (A/cm$^2$) due to thermionic emission of a pure metal can be derived from the above-mentioned Richardson-Dushman equation.

$$J=120T^2\exp(-e\phi/kT)$$

where $e=1.60\times10^{-19}$ (J), $k=1.38\times10^{-23}$ (J/K): Boltzmann constant, $\phi$(eV): work function, and T (K): absolute temperature.

Given that T=2150K (1877° C.) and that $\phi$ of pure tungsten is set to a generally known value of 4.5 eV, a theoretical current density value is derived to be about 0.016 A/cm$^2$ from this equation. This value is close to the measured value 0.02 A/cm$^2$ to which the current density decreased and converged with the lapse of the time, and thus matches with the measurement results that the oxides were lost from the thermionic emission surface with only tungsten remaining as a result of the observation by SEM and the qualitative analysis by EDX. Accordingly, it has been found that this measuring method is adequate as a method of evaluating the thermionic emission properties.

However, there is a problem in judging the thermionic emission properties based on the time in which the thermionic emission current decreases to this value. This is because this value of 0.02 A/cm$^2$ is close to the measurement lower limit of the instrument and further it is necessary to maintain the temperature for a long time until the thermionic emission current decreases to this value.

Figure 13:
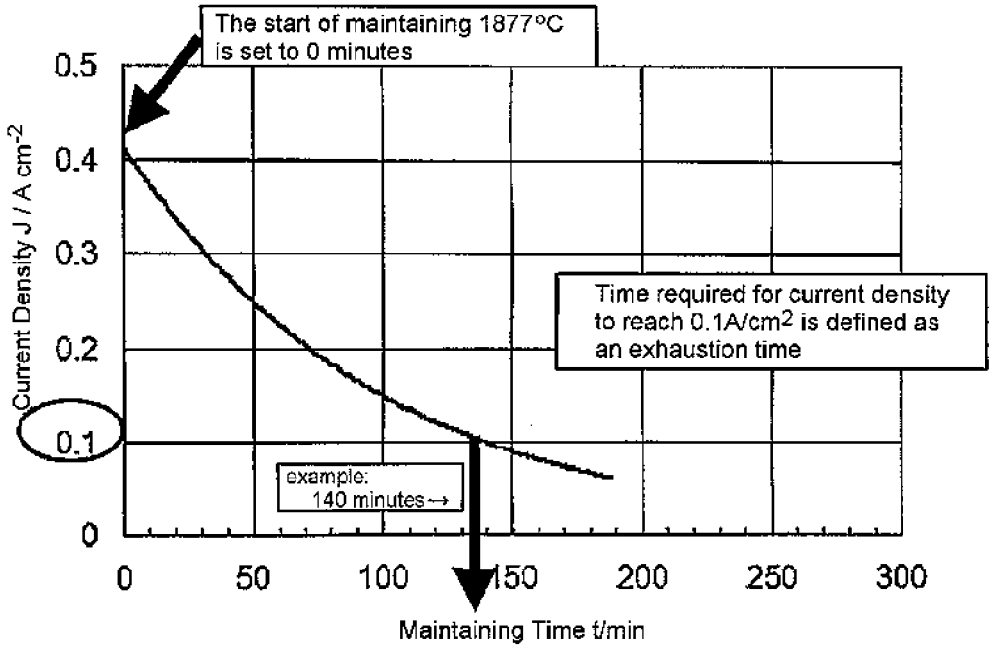
FIG. 13 shows current density measuring examples and a definition of an exhaustion time.
Figure 13:
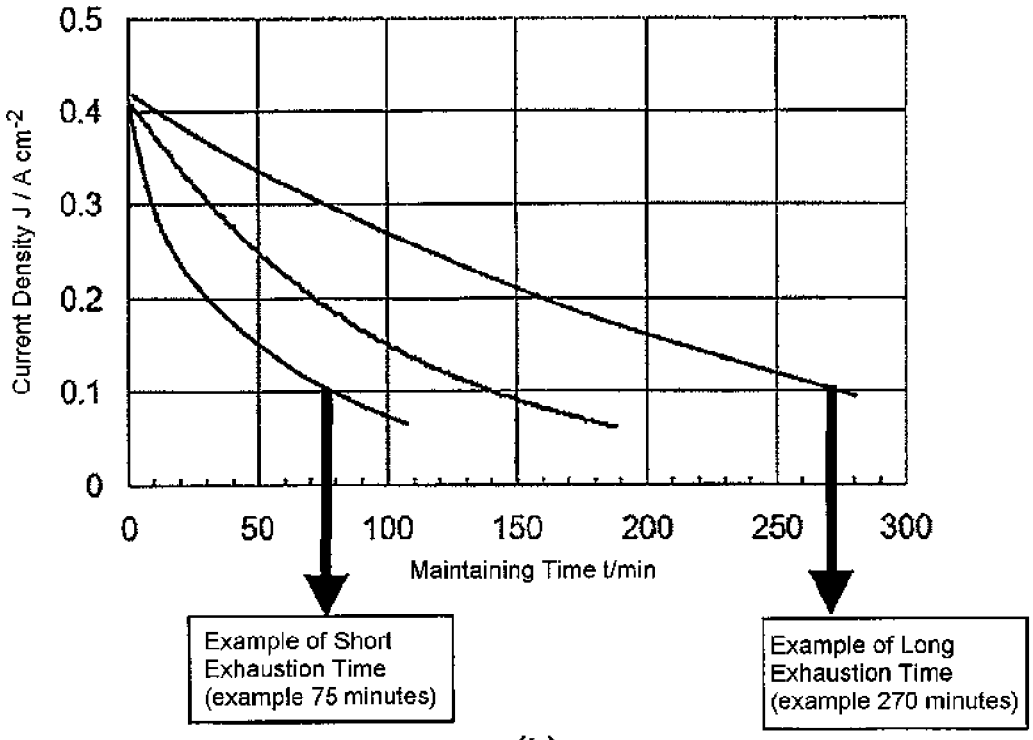

In view of this, in this invention, a reduction of current density to 0.1 A/cm$^2$ after an evaluation sample is maintained at 1877° C. is defined as exhaustion of thermionic emission and the thermionic emission properties are evaluated based on the time required for the exhaustion (hereinafter referred to as an exhaustion time). FIG. 13 shows current density measuring examples and a definition of this exhaustion time. Based on this definition, the time is 140 minutes in the example of FIG. 13(*a*). As shown in FIG. 13(*b*), as the exhaustion time becomes longer, it shows that a sample can maintain the thermionic emission properties long and thus is excellent in performance as an electrode material and, conversely, as the exhaustion time becomes shorter, it shows that a sample cannot maintain the thermionic emission properties and thus is inferior in performance as an electrode material.

Based on the above-mentioned definition, the exhaustion time of Examples 1 to 13, Reference Example 1, and Comparative Examples 4 to 14 and 16 was measured. The obtained results are shown in Table 2.

TABLE 2

| Evaluation Sample | Oxide (rare earth oxide composition (mol%) in parentheses) | Oxide Content in Tungsten Material mol % | mass % | Exhaustion Time | Classification, Others |
|---|---|---|---|---|---|
| Example 1 | $ZrO_2$—$La_2O_3$ (5 mol %) solid solution | 1.4 | 1.0 | 140 minutes | this invention |
| Example 2 | $ZrO_2$—$Sm_2O_3$ (20 mol %) solid solution | 1.4 | 1.3 | 190 minutes | this invention |
| Example 3 | $ZrO_2$—$Er_2O_3$ (22 mol %) solid solution | 1.4 | 1.4 | 140 minutes | this invention (electric current sintering) |
| Example 4 | $ZrO_2$—$Er_2O_3$ (22 mol %) solid solution | 1.4 | 1.4 | 180 minutes | this invention (electric current sintering, plastic working) |
| Example 5 | $ZrO_2$—$Er_2O_3$ (22 mol %) solid solution | 1.4 | 1.4 | 200 minutes | this invention |
| Example 6 | $ZrO_2$—$Yb_2O_3$ (25 mol %) solid solution | 1.4 | 1.2 | 180 minutes | this invention |
| Example 7 | $ZrO_2$—$Y_2O_3$ (23 mol %) solid solution | 1.4 | 1.1 | 180 minutes | this invention |
| Example 8 | $ZrO_2$, $HfO_2$—$Er_2O_3$ (22 mol %) solid solution | 1.4 | 1.5 | 170 minutes | this invention |
| Example 9 | $HfO_2$—$Er_2O_3$ (22 mol %) solid solution | 1.4 | 1.9 | 140 minutes | this invention |
| Example 10 | $ZrO_2$—$Er_2O_3$ (22 mol %) solid solution | 0.5 | 0.5 | 135 minutes | this invention |
| Example 11 | $ZrO_2$—$Er_2O_3$ (22 mol %) solid solution | 5.1 | 5.0 | 300 minutes | this invention |
| Example 12 | $ZrO_2$—$Er_2O_3$ (10 mol %) solid solution | 1.4 | 1.1 | 160 minutes | this invention |
| Example 13 | $ZrO_2$—$Er_2O_3$ (40 mol %) solid solution | 1.4 | 1.7 | 140 minutes | this invention |
| Reference Example 1 (Comparative Example 1) | $ZrO_2$—$Er_2O_3$ (22 mol %) solid solution | 0.1 | 0.1 | 20 minutes | (electric current sintering, plastic working) |
| Reference Example 2 (Comparative Example 2) | $ZrO_2$—$Er_2O_3$ (22 mol %) solid solution | 6.1 | 6.0 | working disabled | (electric current sintering, plastic working) |
| Reference Example 3 (Comparative Example 3) | $ZrO_2$—$Er_2O_3$ (22 mol %) solid solution | 10.2 | 10 | sintering disabled | (electric current sintering, plastic working) |
| Comparative Example 4 | $CaZrO_3$ | 1.4 | 1.4 | 40 minutes | prior art (patent document 1) |
| Comparative Example 5 | $SrZrO_3$ | 1.4 | 1.7 | x | prior art (patent document 1) |
| Comparative Example 6 | $BaZrO_3$ | 1.4 | 2.1 | x | prior art (patent document 1) |
| Comparative Example 7 | $SrHfO_3$ | 1.4 | 2.4 | 10 minutes | prior art (patent document 1) |
| Comparative Example 8 | $BaHfO_3$ | 1.4 | 2.7 | x | prior art (patent document 1) |
| Comparative Example 9 | $ZrO_2$, $Y_2O_3$ (23 mol %) mixture | 1.4 | 1.1 | 120 minutes | prior art (patent document 2 to 4) |
| Comparative Example 10 | $HfO_2$, $Er_2O_3$ (22 mol %) mixture | 1.4 | 1.9 | 50 minutes | prior art (patent document 2 to 4) |
| Comparative Example 11 | $ZrO_2$ | 1.4 | 0.9 | 105 minutes | prior art (patent document 2 to 4) |
| Comparative Example 12 | $La_2O_3$ | 1.4 | 2.5 | 10 minutes | prior art (patent document 2 to 4) |
| Comparative Example 13 | $Y_2O_3$ | 1.4 | 1.7 | 40 minutes | prior art (patent document 2 to 4) |

TABLE 2-continued

| Evaluation Sample | Oxide (rare earth oxide composition (mol%) in parentheses) | Oxide Content in Tungsten Material mol % | mass % | Exhaustion Time | Classification, Others |
|---|---|---|---|---|---|
| Comparative Example 14 | $ZrO_2$, $Er_2O_3$ (22 mol %) mixture | 1.4 | 1.4 | 10 minutes | prior art (patent document 2 to 4, electric current sintering)) |
| Comparative Example 15 | $ZrO_2$, $La_2O_3$ (33.3 mol %) coexistence (mixture) | 1.4 | 1.5 | sintering disabled | prior art (patent document 4, electric current sintering)) |
| Comparative Example 16 | $ThO_2$ | 1.4 | 2.0 | 130 minutes | prior art (commercial product) |

Note 1:
In Examples 1 to 9, 12, and 13 and Comparative Examples 4 to 15, moles of the oxide was set to a fixed amount of 1.4 mol % with respect to tungsten by adjusting mass % of the oxide. 1.4 mol % $ThO_2$ corresponds to 2.0 mass % $ThO_2$ with respect to tungsten (Comparative Example 16).
Note 2:
"x" shows that the thermionic emission current was reduced to exhaustion while raising the temperature.
"Working disabled" shows that sintering was enabled, but plastic working was disabled.
"Sintering disabled" shows that sintering was disabled so that a tungsten electrode material was not obtained.

As shown in Table 2, it is seen that each of the electrode materials using the oxide solid solutions of Examples 1 to 13 of this invention has a longer exhaustion time as compared with the prior art electrode materials of Comparative Examples 4 to 14 and the commercial tungsten electrode material containing thorium oxide of Comparative Example 16 and thus can maintain the thermionic emission properties for a long time.

It is seen that the tungsten electrode material using the oxide solid solution of $ZrO_2$ and $Y_2O_3$ of Example 7 of this invention has a longer exhaustion time as compared with the tungsten electrode material using the mixture of $ZrO_2$ and $Y_2O_3$, which is one example of the oxides cited in Patent Documents 2 to 4, of Comparative Example 9 and thus can also maintain the thermionic emission properties for a long time.

Also in the case of $HfO_2$, it is seen that Example 9 of this invention has a longer exhaustion time as compared with Comparative Example 10 and thus can also maintain the thermionic emission properties for a long time.

Also in the case of producing the square rod-shaped sintered body by the electric current sintering, it is seen that the tungsten electrode material using the oxide solid solution of $ZrO_2$ and $Er_2O_3$ of Example 3 of this invention has a longer exhaustion time as compared with the tungsten electrode material using the mixture of $ZrO_2$ and $Er_2O_3$ of Comparative Example 14 and thus can also maintain the thermionic emission properties for a long time.

It is seen that the rod-shaped tungsten electrode material using the oxide solid solution of $ZrO_2$ and $Er_2O_3$ of Example 4 of this invention can also maintain the thermionic emission properties for a long time.

The oxides contained in the tungsten materials of Examples 3, 4, and 5 are all in the same solid solution state with the same amounts, but the results are that the exhaustion times are different from each other. This is considered to be because since the states of tungsten crystal particles and oxide solid solution dispersion, and so on differ from each other due to the sintering methods and the plastic working, there appears the difference in exhaustion time. However, it is seen that all of them can maintain the thermionic emission properties for a longer time than the prior art electrode materials.

In each of Examples 1 to 13, the exhaustion time was longer than that of thorium oxide of Comparative Example 16. According to this, it is seen from Example 10 that the lower limit of the solid solution content is preferably 0.5 mass % and it is seen from Reference Example 2 and Example 11 that the upper limit thereof is preferably 5 mass % that still enables the plastic working.

However, when importance is attached to the productivity, i.e. the processability, the upper limit is preferably set to 3 mass % or less.

<Evaluation of this Invention by Manufacturing Method of FIG. 5(*b*)>

Example 14

In Example 14, a tungsten electrode material containing a $ZrO_2$—$Er_2O_3$ (22 mol %) oxide solid solution at 1.4 mass % was produced by the manufacturing method of FIG. 5(*b*).

First, a hydroxide precipitate of Zr and Er produced in Example 1 was dried at 200° C. and mixed with a tungsten blue oxide powder (purity of tungsten excluding oxygen is 99.9 mass % or more) being a general tungsten oxide. Herein, mass % of the hydroxide precipitate was adjusted so that moles of the oxide would be fixed 1.4 mol % with respect to tungsten after later-described sintering.

Then, the tungsten oxide powder was heated in a hydrogen atmosphere at 950° C., thereby obtaining a tungsten powder containing an oxide solid solution powder. The oxide in this powder was confirmed to be a solid solution of $ZrO_2$ and $Er_2O_3$ by X-ray diffraction.

The obtained tungsten powder was mold-pressed at 196 MPa, thereby obtaining a cylindrical compact with a diameter of 30 mm and a height of 20 mm.

Then, sintering was carried out in a hydrogen gas atmosphere at 1800° C. for 10 hours, thereby producing a tungsten electrode material of this invention. The relative density of the obtained tungsten electrode material was about 95%.

It was confirmed by X-ray diffraction that a $ZrO_2$—$Er_2O_3$ oxide solid solution was contained in the sintered tungsten material.

<Evaluation of this Invention by Manufacturing Method of FIG. 5(*c*)>

Example 15

In Example 15, a tungsten electrode material containing a $ZrO_2$—$Er_2O_3$ (22 mol %) oxide solid solution at 1.4 mass % was produced by the manufacturing method of FIG. 5(*c*).

First, the mass ratio of Zr nitrate and Er nitrate (manufactured by Kojundo Chemical, purity 99 mass %) was determined so as to provide 78 mol % $ZrO_2$ and 22 mol % $Er_2O_3$ and these were dissolved in water.

Then, a mixture of tungsten blue oxide was produced according to a doping method described in paragraph [0031] of JP-A-H11-152534 of the present applicant and then this mixture was dried.

The concentrations and mixing amounts of the tungsten oxide and the aqueous solution were adjusted so that moles of the oxide would be fixed 1.4 mol % with respect to tungsten after later-described sintering.

Then, the dried tungsten oxide powder was reduced in a hydrogen atmosphere at 950° C. according to reducing conditions described in paragraph [0033] of JP-A-H11-152534, thereby obtaining a tungsten powder containing an oxide solid solution. The oxide in this powder was confirmed to be a solid solution of $ZrO_2$ and $Er_2O_3$ by X-ray diffraction.

Subsequently, a tungsten electrode material will be produced in the same processes as in Example 14. The relative density of the obtained tungsten electrode material was about 95%.

It was confirmed by X-ray diffraction that a $ZrO_2$—$Er_2O_3$ oxide solid solution was contained in the tungsten electrode material.

The exhaustion time of the tungsten electrode materials of Examples 14 and 15 obtained by the above-mentioned methods was measured like Example 1.

The obtained results are shown in Table 3.

TABLE 3

| Evaluation Sample | Manufacturing Method | Exhaustion Time | Classification |
|---|---|---|---|
| Example 14 | FIG. 5(b) | 190 minutes | this invention |
| Example 15 | FIG. 5(c) | 180 minutes | this invention |

As shown in Table 3, the results are that the exhaustion time of each of Examples 14 and 15 is slightly inferior as compared with Example 5 (oxide solid solution of the same composition) produced by the manufacturing method of FIG. 5(*a*). This is considered to be because the dispersion states of the oxide solid solutions finally dispersed in the tungsten electrode materials, and so on differ from each other due to the difference between the manufacturing methods and this affected the exhaustion time. However, it is seen that each of them has a longer exhaustion time as compared with Comparative Examples 4 to 16 being the prior arts and thus can maintain the thermionic emission properties for a long time.

As described above about Examples 1 to 15 shown in Tables 2 and 3, it is clear that, according to the tungsten electrode material of this invention in which the oxide as a thermionic emission source is present in the form of the solid solution, the time to exhaustion of thermionic emission is longer as compared with the electrode materials of the prior arts and thus can maintain the thermionic emission properties for a long time.

That is, this is considered to be because, taking the form of the oxide solid solution in which the Zr oxide and/or the Hf oxide and the oxide of at least one or more kinds of rare earth elements selected from Sc, Y, and the lanthanoids were solid-dissolved, the bonding force between the oxides increased and, as a result, the vapor pressure became lower so that evaporation of the oxides was reduced, i.e. the melting point of the oxides was increased.

<Oxide Solid Solution Confirmation Method other than X-ray Diffraction>

In order to confirm whether an oxide in a tungsten electrode material is an oxide solid solution of this invention or a mixture of oxides of the prior art, use can be made of not only the above-mentioned X-ray diffraction, but also EDX or EPMA.

Hereinbelow, oxide solid solution confirmation methods using EDX and EPMA, respectively, will be described with reference to the Examples.

<Measurement by Energy Dispersive X-Ray Analyzer (EDX)>

In EDX, the composition ratio of elements forming each oxide is measured and, if the standard deviation showing variation in composition ratio is a predetermined value or less, the oxide can be judged as a solid solution.

Hereinbelow, a specific measuring method will be described with reference to Example 3 and Comparative Example 14.

First, the oxides in the tungsten materials of Example 3 and Comparative Example 14 were subjected to a quantitative analysis by EDX.

Figure 11:
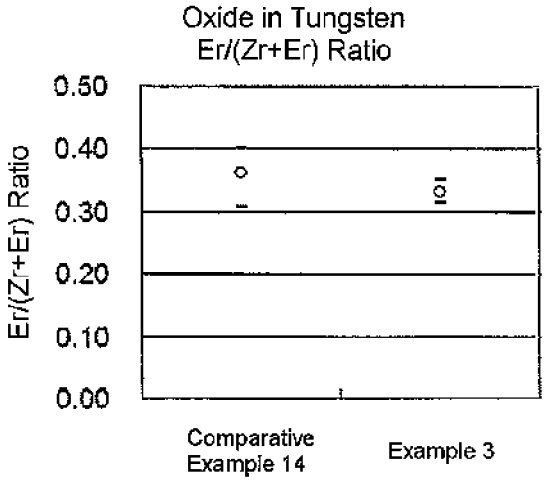
FIG. 11 shows the results of a quantitative analysis by EDX of oxides in tungsten materials of Example 3 and Comparative Example 14, wherein (a) shows the standard deviation of values of the molar ratios converted from the mass ratios of Zr and Er in the oxides, (b) is a diagram showing values of the molar ratios converted from the ratios of mass of Er to the count numbers of Zr and Er in the oxides, (c) is a diagram imitating an electron microscope photograph of Example 3, and (d) is a diagram imitating an electron microscope photograph of Comparative Example 14.
Figure 11:
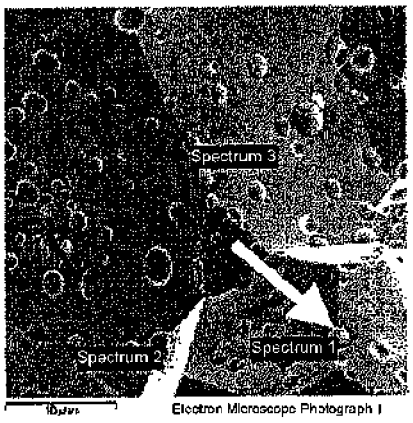
Figure 11:
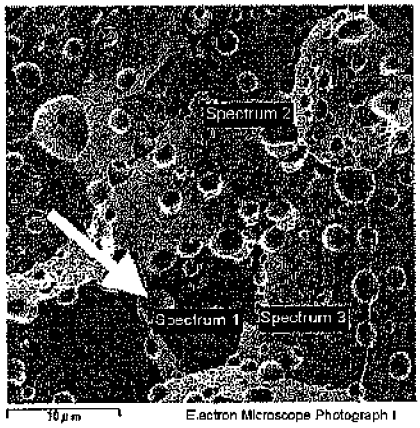

FIG. 11(*c*) and FIG. 11(*d*) are diagrams imitating electron microscope photographs of the tungsten materials of Example 3 and Comparative Example 14, respectively. The oxides in the respective materials are indicated by arrows.

These oxides are each in the combination of an oxide containing Zr oxide and an oxide containing lanthanoid Er oxide. The ratios of mass of Er to mass of Zr and Er in the oxides (see FIG. 11(*b*)) were obtained and then the standard deviation of the molar ratios, converted from the mass ratios, was obtained with n=5 (FIG. 11(*a*)).

EMAX-400 manufactured by HORIBA, Ltd. was used as EDX. The acceleration voltage of an electron beam was set to 15 kV and the beam diameter to 2 nm. The tungsten electrode material as a sample was cut along the crystal grain boundaries and oxide particles dispersed on the interface were analyzed.

With respect to the oxides of Zr and Er cited in Example 3 and Comparative Example 14, the standard deviation of the molar ratios in $ZrO_2$-22 mol % $Er_2O_3$ oxide solid solutions and the standard deviation of the molar ratios in $ZrO_2$-22 mol % $Er_2O_3$ oxide mixtures were measured. As a result, the solid solution exhibited a standard deviation of 0.025 or less while the mixture exceeded 0.025.

Specifically, in the tungsten electrode material of Example 3, the standard deviation of the molar ratios was 0.012 and thus it was found to be an oxide solid solution. On the other hand, in the tungsten electrode material of Comparative Example 14, the standard deviation of the molar ratios was 0.028 exceeding 0.025. Therefore, the presence of oxide mixtures is considered and thus it can be judged to be a mixture. These results well agree with the results of judgment by X-ray diffraction.

This shows that since the composition of the components forming the oxide solid solutions is uniform, the above-mentioned standard deviation becomes small, while, the composition of the components forming the oxide mixtures is nonuniform, the standard deviation becomes large.

Likewise, the ratios of mass of Sc, Y, and the lanthanoids to mass of Zr, Hf, Sc, Y, and the lanthanoids in oxides were obtained with n=5 and then the standard deviation of the molar ratios, converted from the mass ratios, was obtained with n=5. As a result, a solid solution exhibited 0.025 or less while a mixture exceeded 0.025.

<Measurement by Electron Probe Microanalyzer (EPMA)>

In EPMA, characteristic X-ray intensities relating to a chemical bonding state of an element forming an oxide are measured and, if the intensity ratio thereof is a predetermined value or less, the oxide can be judged as a solid solution.

Figure 12:
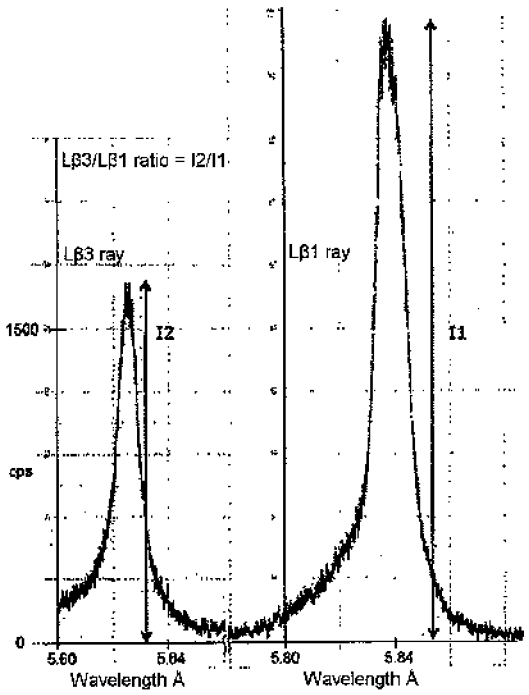
FIG. 12 shows characteristic X-ray intensity data obtained by analyzing a chemical bonding state of an element forming an oxide in each of tungsten electrode materials of Example 3 and Comparative Example 14, wherein (a) is a diagram showing the intensities of characteristic X-rays $L\beta_1$ and $L\beta_3$ of Zr, (b) is a diagram showing the intensity ratios $L\beta_3/L\beta_1$ of X-ray $L\beta_3$ to X-ray $L\beta_1$ of Zr, (c) is a diagram imitating an electron microscope photograph of Example 3, and (d) is a diagram imitating an electron microscope photograph of Comparative Example 14.
Figure 12:
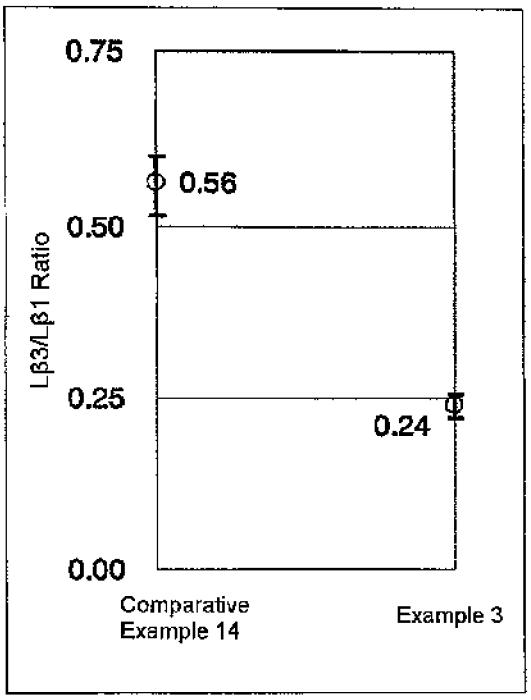
Figure 12:
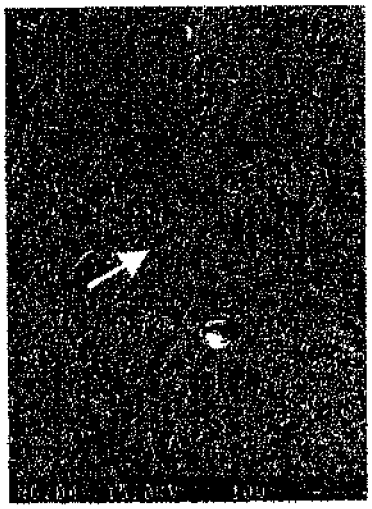
Figure 12:
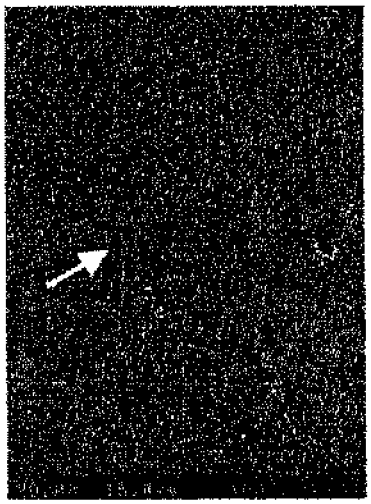

FIG. 12 is characteristic X-ray intensity data obtained by analyzing a chemical bonding state of the element forming the oxide in each of the tungsten electrode materials of Example 3 and Comparative Example 14.

FIG. 12(*c*) and FIG. 12(*d*) are diagrams imitating electron microscope photographs of the tungsten materials of Example 3 and Comparative Example 14, respectively. The oxides in the respective materials are indicated by arrows.

The analysis was carried out using EPMA (EPMA8705 manufactured by Shimadzu Corporation).

Specifically, analysis samples were produced by polishing the above-mentioned tungsten electrode materials. Then, an electron beam was incident on an oxide on a polished surface of each sample to thereby measure a characteristic X-ray. The measurement conditions were such that the acceleration voltage was set to 15 kV, the sample current to 20 nA, and the beam size to 5 μm in diameter and that pentaerythritol (PET) was used as an analyzing crystal.

Then, Zr was selected from the elements forming the oxide in each tungsten electrode material and the intensities of characteristic X-rays $L\beta_1$ and $L\beta_3$ of Zr were measured with n=3 (see FIG. 12(*a*)). The theoretical wavelength of $L\beta_1$ is 5.836 Å($5.836\times10^{-10}$ m) and that of $L\beta_3$ is 5.632 Å ($5.632\times10^{-10}$ m). From measured values thereof, the intensity ratio $L\beta_3/L\beta_1$ of X-ray $L\beta_3$ to X-ray $L\beta_1$ of Zr was obtained (see FIG. 12(*b*)).

Further, the intensity ratios $L\beta_3/L\beta_1$ of a $ZrO_2$-22 mol % $Er_2O_3$ oxide solid solution and a $ZrO_2$-22 mol % $Er_2O_3$ oxide mixture, free of tungsten, which were prepared separately, were measured. As a result, the solid solution exhibited 0.5 or less while the mixture exceeded 0.5.

As a consequence, the oxide of Example 3 was found to be an oxide solid solution with $L\beta_3/L\beta_1$=0.24. On the other hand, the oxide of Comparative Example 14 was found to be an oxide mixture with $L\beta_3/L\beta_1$=0.56.

This shows that the chemical bonding states of Zr differ from each other in the solid solution of $ZrO_2$ and $Er_2O_3$ and in the mixture of $ZrO_2$ and $Er_2O_3$.

Further, the characteristic X-ray intensity ratios of Zr in oxides were obtained with n=3. As a result, a solid solution exhibited 0.49 or less while a mixture exceeded 0.49.

<Evaluation of Anisotropy of Oxide Solid Solutions in Electrode Material>

The relationship between the anisotropy of oxide solid solutions in an electrode material and the exhaustion time was evaluated in the following sequence.

First, samples were produced in the following sequence.

Example 16

A columnar tungsten electrode material was produced under the production conditions of Example 6 except that the average particle size of oxide solid solutions was set to 10 μm and that the processing ratio was set to 30%. A processing direction was set to be a center axis direction of the columnar body.

Example 17

A columnar tungsten electrode material was produced under the production conditions of Example 6 except that the average particle size of oxide solid solutions was set to 10 μm and that the processing ratio was set to 50%. A processing direction was set to be a center axis direction of the columnar body.

Figure 14:
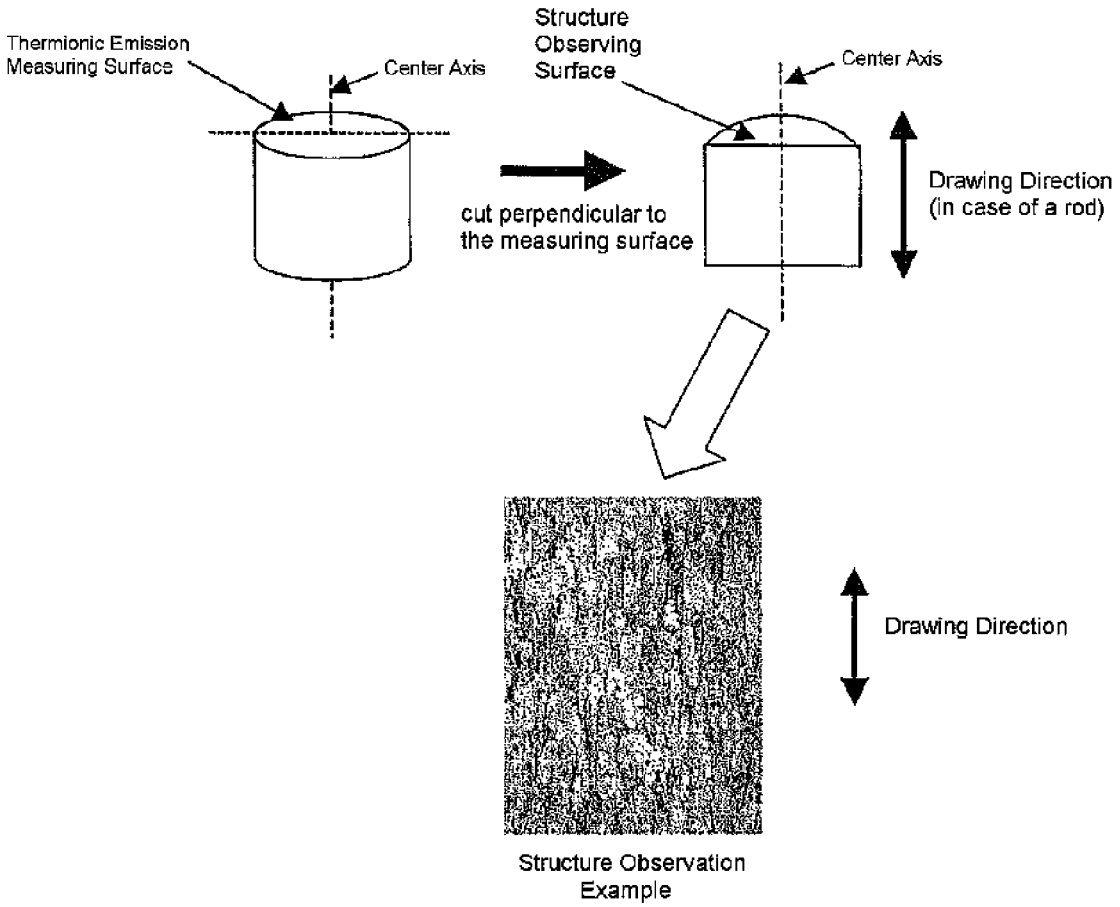
FIG. 14 is a diagram showing the sequence of observation of the cross-sectional shape of a tungsten electrode material and an observation example thereof.

Then, as shown in FIG. 14, the samples of Example 6, Example 16, and Example 17 were each cut in a plane including the center axis and being parallel to the center axis and the cross-sectional shape was photographed by EPMA. The photographing range was set to 1700 μm×1280 μm.

Then, the photographed cross-sectional shape was binarized using Image Pro Plus manufactured by Media Cybernetics, Inc.

Then, based on the binarized image data, the area of the oxide solid solution particle was standardized as a tungsten area ratio along with the results of quantitative analysis by ICP emission spectral analysis according to JIS H 1403, thereby obtaining a long axis of an equivalent ellipse of the oxide solid solution and measuring an angle between the center axis and the long axis. All the oxide solid solution particles present in an observation area of 1700 μm×1280 μm (field number is 3) were measured and the measured number of the particles was 100 to 4000, which, however, differed depending on the sample.

Then, with respect to the samples of Example 6, Example 16, and Example 17, the exhaustion time was measured by the same device and method as those described in <Evaluation of Thermionic Emission Properties>.

Figure 15:
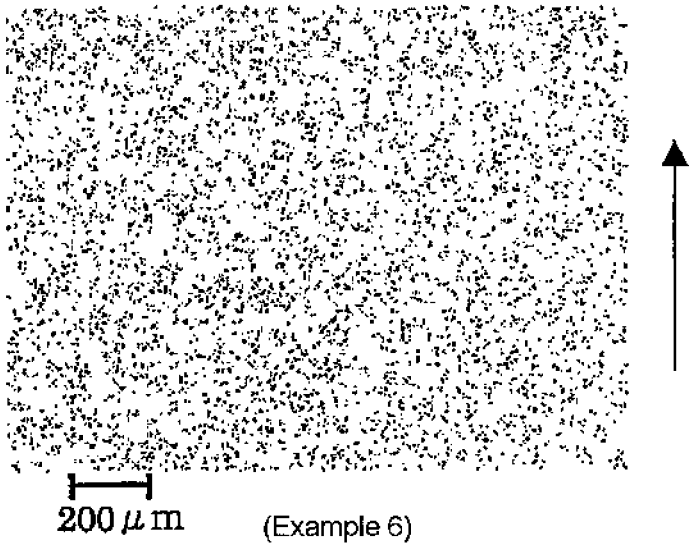
FIG. 15 shows binarized image data of the cross-sectional shape of a tungsten electrode material according to Example 6.
Figure 16:
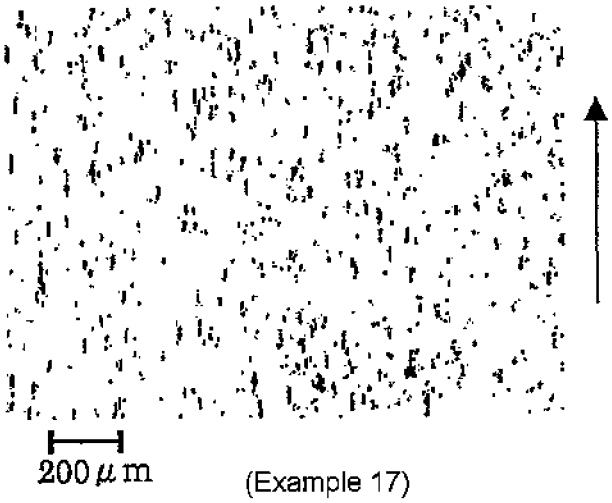
FIG. 16 shows binarized image data of the cross-sectional shape of a tungsten electrode material according to Example 17.
Figure 17:
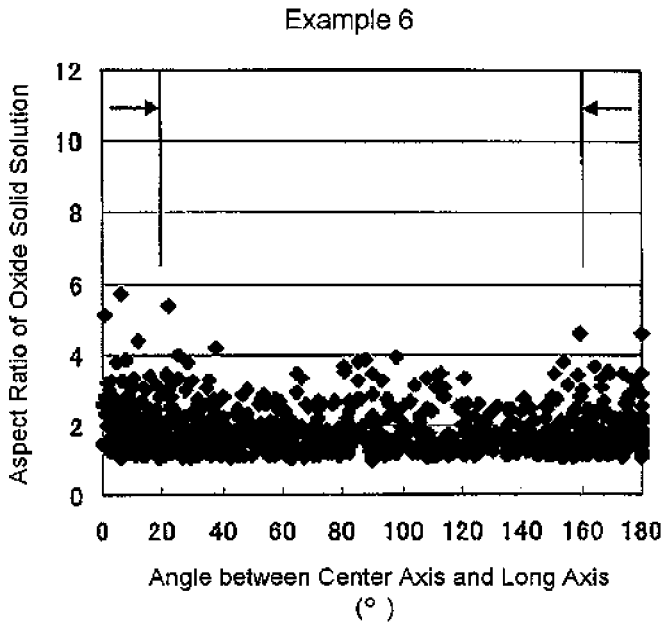
FIG. 17 shows graphs each showing a distribution of angles each between a center axis and a long axis of an oxide solid solution in a cross-section of a tungsten electrode material according to each of Example 6 and Example 17.
Figure 17:
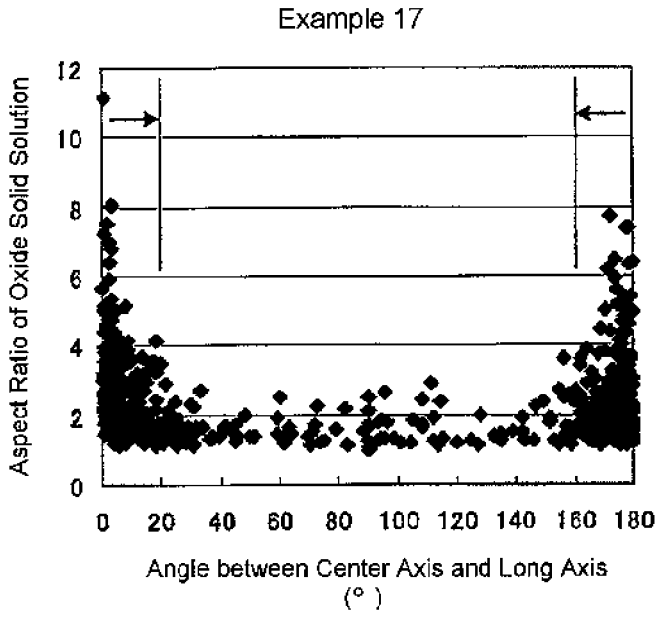

FIGS. 15 and 16 show the binarized image data of Examples 6 and 17, respectively, and FIG. 17 shows, among distributions of the angles each between the center axis and the long axis, the distributions of Example 6 and Example 17. In FIGS. 15 and 16, an arrow shows the center axis direction. In FIG. 17, the ordinate axis represents the aspect ratio of an equivalent ellipse, i.e. the (major axis/minor axis) ratio of an equivalent ellipse.

Further, the measured exhaustion time is shown in Table 4. Table 4 also shows the area ratio of the oxide solid solutions each having a long axis forming an angle of 20° or less with the center axis. In FIG. 17, regions indicated by arrows, respectively, are regions where the angle between the center axis and the long axis is 20° or less.

TABLE 4

| Evaluation Sample | Area Ratio of Oxide Solid Solutions with Long Axis forming Angle of 20° or less with electrode center axis | Exhaustion Time |
|---|---|---|
| Example 6 | 35% | 180 minutes |
| Example 16 | 52% | 240 minutes |
| Example 17 | 88% | 270 minutes |

As is clear from FIGS. 15 to 17, it is seen that as the processing ratio increases, the number of the oxide solid solutions whose long axis forms a small angle with the center axis increases and thus the long axis directions are more aligned with the center axis direction.

As is clear from Table 4, it is seen that the evaluation sample in which the long axis directions are more aligned with the center axis direction has a longer exhaustion time and that particularly when the area ratio of the oxide solid solutions whose long axis forms an angle of 20° or less with the center axis becomes 50% or more, the exhaustion time largely increases.

<Evaluation of Aspect Ratio of Oxide Solid Solutions>

The relationship between the aspect ratio of oxide solid solutions and the exhaustion time was evaluated in the following sequence.

First, a sample was produced in the following sequence.

Example 18

A columnar tungsten electrode material was produced under the production conditions of Example 6 except that oxide solid solution particles of 5 μm or less were removed by screening from oxide solid solutions having an average particle size of 7 μm and that the processing ratio was set to 30%. A processing direction was set to be a center axis direction of the columnar body.

Then, the samples of Example 6, Example 17, and Example 18 were each cut in a plane including the center axis and being parallel to the center axis and the cross-sectional shape was photographed by EPMA. The photographing range was set to 1700 μm×1280 μm.

Then, the photographed cross-sectional shape was binarized using Image Pro Plus manufactured by Media Cybernetics, Inc.

Then, based on the binarized image data, the area of the oxide solid solution particle was standardized as a tungsten area ratio along with the results of quantitative analysis by ICP emission spectral analysis according to JIS H 1403, thereby obtaining an aspect ratio of an equivalent ellipse of the oxide solid solution. All the oxide solid solution particles present in an observation area of 1700 μm×1280 μm (field number is 3) were measured and the measured number of the particles was 100 to 4000 per field, which, however, differed depending on the sample.

Then, with respect to the samples of Example 6, Example 17, and Example 18, the exhaustion time was measured by the same device and method as those described in <Evaluation of Thermionic Emission Properties>.

Figure 18:
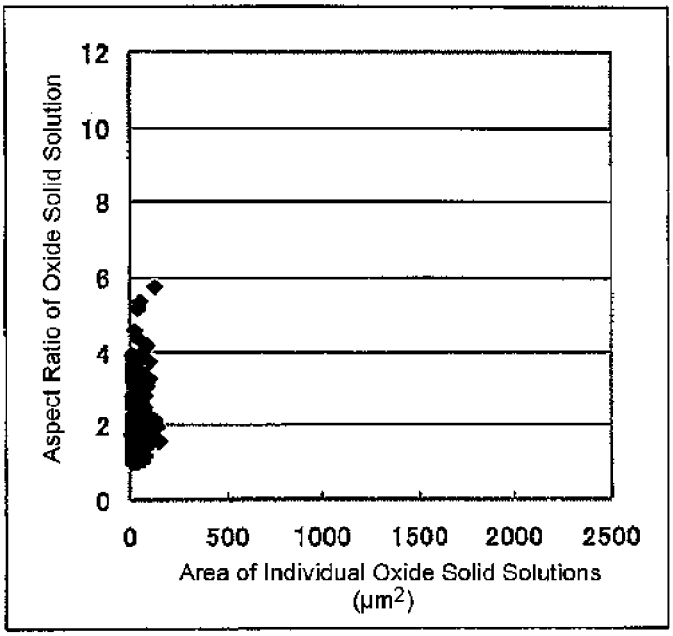
FIG. 18 shows distribution diagrams each showing the relationship between the aspect ratio and the area of oxide solid solutions in a cross-section of a tungsten electrode material according to each of Example 6 and Example 17.
Figure 18:
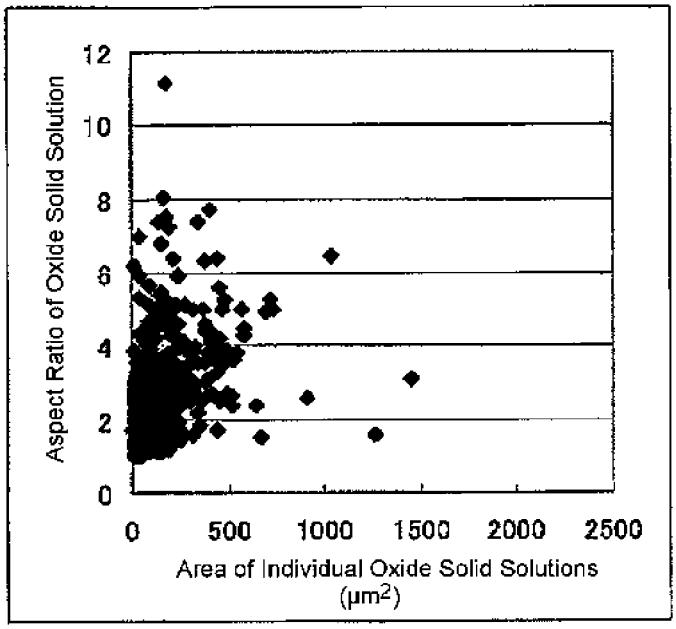

FIG. 18 illustrates distribution diagrams showing the relationship between the aspect ratio and the area in Example 6 and Example 17. Table 5 shows the exhaustion time measured using the samples of Example 6, Example 17, and Example 18. Table 5 also shows the number, number ratio, and area ratio of the oxide solid solutions each with an aspect ratio of 6 or more in the photographing range.

TABLE 5

| Evaluation Sample | Number of Oxide Solid Solutions with Aspect Ratio of 6 or more | Number Ratio of the Number given left to the Whole | Area Ratio of the Number given left to the Whole | Exhaustion Time |
|---|---|---|---|---|
| Example 6 | 0 | 0.00% | 0.00% | 180 minutes |
| Example 17 | 14 | 2.10% | 5.00% | 270 minutes |
| Example 18 | 6 | 1.10% | 4.10% | 250 minutes |

As is clear from FIG. 18 and Table 5, it is seen that as the oxide solid solutions with the aspect ratio of 6 or more increase, the exhaustion time is prolonged and that particularly when the area ratio of the oxide solid solutions with the aspect ratio of 6 or more becomes 4% or more, the exhaustion time largely increases.

Further, it is seen that the processing ratio and the particle size are complementary to each other such that if the particle size is large, the particles with the aspect ratio of 6 or more tend to be formed even if the processing ratio is low, while, if the processing ratio is high, the particles with the aspect ratio of 6 or more tend to be formed even if the particle size is small.

Even by changing only the size of the oxide solid solution particles, the particles with the aspect ratio of 6 or more were not obtained and were not formed even accidentally.

<Evaluation of Particle Size of Oxide Solid Solutions>

The relationship between the particle size of oxide solid solutions and the exhaustion time was evaluated in the following sequence.

First, samples were produced in the following sequence.

Example 19

A columnar tungsten electrode material was produced under the production conditions of Example 6 except that oxide solid solutions were pulverized in a ball mill to obtain primary particles of 0.8 μm in a particle size distribution. A processing direction was set to be a center axis direction of the columnar body.

Example 20

A columnar tungsten electrode material was produced under the production conditions of Example 6 except that oxide solid solutions were screened to remove particles of 5 μm or less so as to obtain an average particle size of 8 μm. A processing direction was set to be a center axis direction of the columnar body.

Then, the samples of Example 6, Example 19, and Example 20 were each cut in a plane including the center axis and being parallel to the center axis and the cross-sectional shape was photographed by EPMA. The photographing range was set to 1700 μm×1280 μm.

Then, the photographed cross-sectional shape was binarized using Image Pro Plus manufactured by Media Cybernetics, Inc.

Then, based on the binarized image data, the area of the oxide solid solution particle was standardized as a tungsten area ratio along with the results of quantitative analysis by ICP emission spectral analysis according to JIS H 1403, thereby obtaining a circle-converted particle size of the oxide solid solution. All the oxide solid solution particles present in an observation area of 1700 μm×1280 μm (field number is 3) were measured and the measured number of the particles was 100 to 4000, which, however, differed depending on the sample.

Then, with respect to the samples of Example 6, Example 19, and Example 20, the exhaustion time was measured by the same device and method as those described in <Evaluation of Thermionic Emission Properties>.

Figure 19:
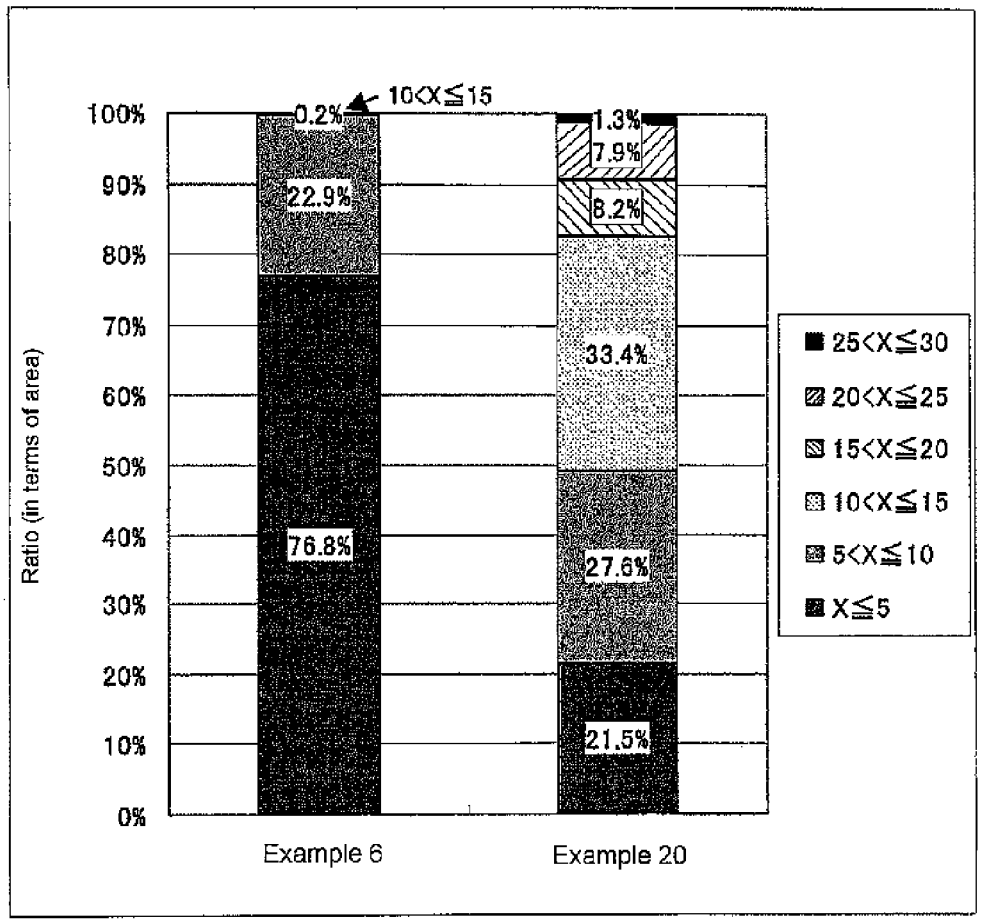
FIG. 19 is a band graph showing the ratio (in terms of area) of the circle-converted particle sizes of oxide solid solutions in a cross-section of a tungsten electrode material according to each of Example 6 and Example 20.
Figure 20:
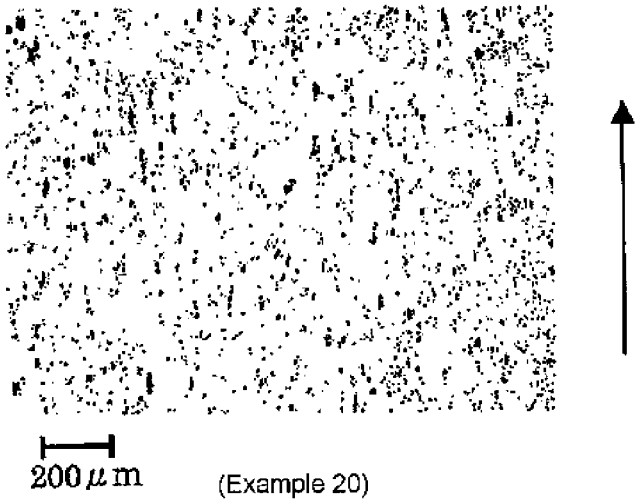
FIG. 20 shows binarized image data of the cross-sectional shape of a tungsten electrode material according to Example 20.

FIG. 19 shows, in the form of a band graph, the ratio (in terms of area) of the circle-converted particle sizes of each of Example 6 and Example 20. FIG. 20 shows binarized image data of Example 20. Table 6 shows the test results of the exhaustion time of Example 6, Example 19, and Example 20. Table 6 also shows the area ratio of the oxide solid solutions having the diameter of 5 μm or less in each Example.

TABLE 6

| Evaluation Sample | Area Ratio of Oxide Solid Solutions with Diameter of 5 μm or less | Exhaustion Time |
|---|---|---|
| Example 6 | 77% | 180 minutes |
| Example 19 | 45% | 230 minutes |
| Example 20 | 22% | 240 minutes |

As is clear from FIG. 19 and Table 6, the area ratio of the oxide solid solutions having the diameter of 5 μm or less is reduced in Example 20 than in Example 6. This is also clear from FIGS. 15 and 20. Further, it is seen that as the area ratio of the oxide solid solutions having the diameter of 5 μm or less decreases, the exhaustion time is prolonged and that when the area ratio becomes 50% or less, the exhaustion time largely increases.

That is, it is seen that the oxide solid solutions having the diameter of 5 μm or less do not contribute to thermionic emission and thus the particle size of the oxide solid solutions when the tungsten electrode material is produced is important.

<Deviation of Element Ratios in Oxide Solid Solutions>

The relationship between the deviation of element ratios in oxide solid solutions and the exhaustion time was evaluated in the following sequence.

First, a sample was produced in the following sequence.

Example 21

A columnar tungsten electrode material was produced under the production conditions of Example 3 except that the mixing amount of the oxide solid solution in Example 3 was set to 70 mass % as compared with Example 3 and the mixture oxides in Comparative Example 14 were mixed at 30 mass % with the oxide solid solution, thereby obtaining an oxide with insufficient solid dissolution (i.e. the oxide solid solution and the mixture oxides were mixed at a mass ratio of 7:3) on a test basis.

Then, the ratios of mass of Er to mass of Zr and Er in the oxides of each of Example 3, Example 21, and Comparative Example 14 (see FIG. 11(*b*)) were obtained and then the standard deviation of the molar ratios, converted from the mass ratios, was obtained with n=5.

Table 7 shows the test results of the exhaustion time of Example 3, Example 21, and Comparative Example 14. Table 7 also shows the standard deviation of the oxide composition ratios in each Example.

TABLE 7

| Evaluation Sample | Standard Deviation of Oxide Composition Ratio | Exhaustion Time |
|---|---|---|
| Example 3 | 0.012 | 140 minutes |
| Example 21 | 0.024 | 135 minutes |
| Comparative Example 14 | 0.028 | 10 minutes |

As is clear from Table 7, the large difference appears between each Example and the Comparative Example.

From these results, it is seen that as the standard deviation of the oxide composition ratios decreases, the exhaustion time is prolonged and that the properties of the oxide solid solution are not lost even by mixing the mixture oxides up to 30 mass %.

The foregoing is the description about the method of producing the oxide solid solution powder, the production method of enabling the presence of the oxide solid solution in the tungsten material, and the method of analyzing the oxide solid solution in the electrode material according to this invention.

Taking into account the required thermionic emission properties and processability, the mixture ratio of the oxide solid solution powder to the tungsten powder can be arbitrarily changed in the electrode material of this invention. In other words, the mass ratio of the oxide solid solution in the tungsten material as a final product can be properly designed.

Therefore, although all the optimum range of the mass ratios between tungsten and the oxide solid solution is not described, the mass ratio is arbitrarily adjusted in consideration of the thermionic emission properties required per use of the electrode and thus it is adequate to arbitrarily define the mass ratios of the oxide solid solution in this invention.

This invention is the technique that can improve the temporal change in thermionic emission and the thermionic emission properties by the new means of forming the oxide solid solution in the tungsten material. It is naturally possible to produce an electrode satisfying the required properties by changing the oxide or increasing the number of oxides to be used, such as selecting an oxide not described in this specification, for example, barium oxide for use in a discharge lamp in which the heat load of an electrode is small, and forming a solid solution of the selected oxide and the Zr oxide and/or the Hf oxide shown in this invention as an oxide that can achieve the increase in the melting point, or forming a solid solution of the Zr oxide and/or the Hf oxide, the barium oxide, and the scandium oxide and/or the yttrium oxide, or the like.

As described before, the idea of this invention is to obtain the oxide solid solution with the increased melting point by combining the oxide having the high melting point alone, such as the Zr oxide and/or the Hf oxide, and the oxide capable of thermionic emission. In the combinations of the Zr oxide and/or the Hf oxide and the oxides described in this specification, it is possible to form an oxide solid solution using the combination other than those shown as the examples or changing the number of the combining oxides.

The tungsten material of this invention can be used as an electrode in the form of the sintered body as it is.

The tungsten electrode material containing the oxide solid solution of this invention is not limited to a cylindrical or rod-shaped electrode. Depending on the use, for example, it is possible to sinter a compact formed into a square plate shape and to use this sintered body as an electrode.

There is no particular limitation to the particle size and purity of the tungsten oxide or tungsten to be mixed. Use may be made of a powder of a tungsten alloy such as a tungsten-rhenium alloy excellent in high-temperature strength or a powder in which a tungsten powder is doped with a certain amount of aluminum, potassium, or silicon. The reason for using the doped powder is that the doping contributes to an increase in aspect ratio of tungsten crystal particles and the stability of the tungsten crystal grain boundaries.

<Evaluation of Thermionic Emission Current Measuring Device>

Next, the following test was conducted for confirming the measurement accuracy of the thermionic emission current measuring device 100 itself of this invention.

<Derivation of Work Function of Pure Tungsten>

First, a description will be given of an example in which the work function of pure tungsten was derived using the thermionic emission current measuring device 100 of this invention.

First, a cathode 15 as a sample was produced using a rod-shaped tungsten material with a purity of 99.99 mass %. The cathode 15 had a diameter of 8 mm and a thickness of 10 mm.

A measurement surface of the sample was polished and, after degreasing, the sample was fixed in the vacuum chamber 13 and the inside of the vacuum chamber 13 was maintained in a vacuum atmosphere ($10^{-5}$ Pa or less). The cathode 15 was heated by electron bombardment heating using the method described in the embodiment. The temperature rising rate during the heating was set to 15K/min and the maintaining temperatures (test points) were set to 4 points of 2203K, 2217K, 2231K, and 2251K. The pressure in the vacuum chamber 13 during maintaining the temperature was $1\times10^{-4}$ Pa or less.

The measurement conditions in this event were such that the filament voltage was set to 4V and the filament current was set to 24 to 26 A. The conditions for electron bombardment heating were set to 3.2 kV and 105 to 125 mA. The pulse voltage for measurement was set to 200 to 1200V and the duty was set to 1:1000. The distance between the cathode and the anode was set to 0.5 mm, the diameter of the cathode 15 was set to 8.0 mm, the diameter of the anode 19 was set to 6.2 mm, and the outer diameter and the inner diameter of the guard ring 35 were set to 11 mm and 6.6 mm, respectively.

Determining the maintaining temperatures (test points) to be the 4 points of 2203K, 2217K, 2231K, and 2251K, a thermionic emission current received by the anode 19, potential differences between the guard ring 35 and the anode and cathode of the pulsed power supply 3, and potential differences between the anode 19 and the anode and cathode of the pulsed power supply 3 were read at each of the maintaining temperatures (test points) using the current-voltage measuring device 6 (oscilloscope).

Square roots of electric field strengths and logarithms of thermionic emission current densities were obtained from those values and plotted and then the plotted points aligned linearly were linearly approximated. Those plotted points are shown in Table 8 below.

TABLE 8

| 2203K | | 2217K | | 2231K | | 2251K | |
|---|---|---|---|---|---|---|---|
| Square Root of Electric Field Strength | Natural Logarithm of Current Density | Square Root of Electric Field Strength | Natural Logarithm of Current Density | Square Root of Electric Field Strength | Natural Logarithm of Current Density | Square Root of Electric Field Strength | Natural Logarithm of Current Density |
| 117 | −2.29 | 111 | −2.22 | 113 | −2.04 | 113 | −1.93 |
| 120 | −2.26 | 114 | −2.14 | 118 | −2.01 | 116 | −1.89 |
| 124 | −2.21 | 118 | −2.15 | 123 | −2.01 | 121 | −1.88 |
| 128 | −2.20 | 123 | −2.10 | 127 | −1.98 | 124 | −1.86 |
| 131 | −2.15 | 127 | −2.07 | 131 | −1.94 | 128 | −1.84 |
| 134 | −2.12 | 131 | −2.05 | 134 | −1.90 | 132 | −1.80 |
| 138 | −2.11 | 136 | −2.00 | 137 | −1.89 | 135 | −1.80 |
| 142 | −2.10 | 139 | −1.99 | 140 | −1.88 | 138 | −1.79 |
| 145 | −2.07 | 140 | −1.98 | 143 | −1.85 | 141 | −1.76 |
| 147 | −2.08 | 145 | −1.95 | 147 | −1.83 | 145 | −1.72 |

Then, as shown in FIG. 26, the intercept of each line was obtained as an extrapolated value of the thermionic emission current density.

From the graph, when the measurement points at 2203K, 2217K, 2231K, and 2251K are linearly approximated, $$Y=0.0072X-3.12,$$

$$Y=0.0074X-3.01,$$

$$Y=0.0065X-2.78, \text{ and}$$

$$Y=0.0060X-2.61, \text{ respectively.}$$

Therefore, the logarithms of thermionic emission current densities excluding the influence of the electric field at the respective temperatures are −3.12, −3.01, −2.78, and −2.61, respectively.

(Derivation of Work Function)

Then, as shown in the graph of FIG. 27, measurement points were plotted with respect to the abscissa axis representing the inverse number of the maintaining temperature (absolute temperature) and the ordinate axis representing the logarithm of a value obtained by dividing a current density by the square of a cathode temperature and a regression straight line was obtained from those points.

In this Example, the slope and intercept of this straight line were calculated by the method of least squares. The obtained straight line was Y=−50800X+4.55. The work function was calculated from this slope.

The slope is given by $-e\phi/k=-50800$ and, since e and k are constants, the work function is $\phi=4.38$.

As described above, the work function of tungsten measured at 2203K to 2251K was 4.38 eV. This value is close to a theoretical value 4.55 eV of Non-Patent Document 1.

<Derivation of Work Function of Pure Tantalum>

A description will be given of an example in which the work function of pure tantalum was derived.

A sample was produced as a cathode 15 using a rod-shaped tantalum material with a purity of 99.9 mass %. As a result of measuring the electron emission properties of tantalum in the same manner as in the above-mentioned measurement, the work function was found to be 4.18 eV. This value is close to a theoretical value 4.25 eV of Non-Patent Document 1.

<Measurement of Temporal Change in Thermionic Emission Current>

The temporal change in thermionic emission current was measured while maintaining the temperature of a sample at an arbitrary temperature.

FIGS. 28(*a*) and (*b*) show the results of measuring rod-shaped samples in each of which an oxide was added to pure tungsten with a purity of 99.99 mass %, while, FIG. 28(*c*) shows the results of measuring a rod-shaped sample of pure tungsten with a purity of 99.99 mass %. All the samples were measured while being maintained at 2150K. In the measurement of FIGS. 28(*a*) and (*b*), the current was gradually attenuated to converge to about 0.05 A/cm$^2$, corresponding to a current of the pure tungsten sample of FIG. 28(*c*), in all the samples. For example, in an example of fast current attenuation in FIG. 28(*b*), the current density was 0.142 $A/cm^2$ at 50 minutes and 0.080 $A/cm^2$ at 100 minutes, while, in an example of slow current attenuation, the current density was 0.336 $A/cm^2$ at 50 minutes and 0.125 $A/cm^2$ at 250 minutes.

In the pure tungsten measurement of FIG. 28(*c*), a constant current value of about 0.05 $A/cm^2$ was exhibited. For example, the value was 0.049 $A/cm^2$ at 50 minutes, 0.051 $A/cm^2$ at 150 minutes, and 0.050 $A/cm^2$ at 300 minutes. The tendency of the life characteristics in a discharge lamp agreed with the measurement results shown in FIG. 28(*b*). That is, the tendency was that the sample with slower current attenuation had a longer life in the discharge lamp.

Therefore, it is seen that it is possible to evaluate the lamp life by measuring the temporal change.

As described above, the thermionic emission current measuring device 100 according to this embodiment comprises the measuring device body 1 forming the electron bombardment heating means, the DC power supply 2, the pulsed power supply 3, and the current-voltage measuring device 6 (oscilloscope) forming the thermionic emission current measuring means, wherein the device 100 heats the cathode 15 by electron bombardment heating to cause it to emit thermal electrons, thereby measuring an emission current.

Accordingly, it is possible to accurately heat the cathode 15 to a temperature high enough for thermionic emission and thus to accurately measure a thermionic emission current at an arbitrary temperature.

Since the thermionic emission current can be accurately measured, it is possible to accurately grasp the work function of only the cathode 15. That is, as is clear from the above-mentioned Examples, it is possible to evaluate and compare the cathode properties between a cathode material whose operating temperature is high and which contains a radioactive substance such as thorium and a substitute material for thorium.

Further, it is possible to accurately measure the temporal change of the thermionic emission properties of the cathode.

Further, it is possible to accurately and easily grasp the evaluation of the electron emission properties of the cathode without manufacturing a lamp.

Further, by preparing a sample (cathode 15) with an accurately defined area, it is possible to accurately measure a thermionic emission current at an arbitrary temperature.

INDUSTRIAL APPLICABILITY

A tungsten electrode material of this invention can be used not only as a cathode of a discharge lamp, but also as an electrode and filament of various lamps which require the phenomenon of thermionic emission, a cathode for magnetron, an electrode for TIG (Tungsten Inert Gas) welding, an electrode for plasma welding, and so on.

It is generally known that when oxide particles are contained in a tungsten material, it is possible to improve the high-temperature strength/impact resistance by the suppression of the dislocation of the tungsten grain boundaries and thus to apply the tungsten material also to a high-temperature member.

A thermionic emission current measuring device of this invention can accurately measure the thermionic emission properties in a vacuum. Further, since it is also possible to measure the temporal change in thermionic emission current, the device can be used for evaluating not only an electrode for a lamp, but also an electrode for electric discharge machining and an electrode for welding.

DESCRIPTION OF SYMBOLS

1 measuring device body
2 DC power supply
3 pulsed power supply
4 filament power supply
5 temperature measuring portion
6 current-voltage measuring device
13 vacuum chamber
15 cathode
17 sample stage
19 anode
21 filament
23 isolation transformer
32 screw
33 temperature measuring hole
35 guard ring
100 thermionic emission current measuring device

The invention claimed is:

1. A tungsten electrode material comprising
a tungsten base alloy, and
oxide particles dispersed in the tungsten base,
wherein each oxide particle is an oxide solid solution in which a Zr oxide and/or a Hf oxide and at least one or more kinds of rare earth oxides selected from Sc, Y, La, Ce, Pr, Nd, Sm, Eu, Gd, Tb, Dy, Ho, Er, Tm, Yb, and Lu are solid-dissolved, and
wherein in a cross-section in an axial direction of the tungsten electrode material, an area ratio of those oxide solid solutions, each having a cross-section whose aspect ratio is 6 or more, is 4% or more of a cross-sectional area of all the oxide solid solutions.

2. The tungsten electrode material according to claim 1, wherein the content of the oxide solid solutions is 0.5 mass % to 5 mass % and the balance is substantially tungsten.

3. The tungsten electrode material according to claim 1, wherein a ratio of the rare earth oxides to a total amount of the Zr oxide and/or the Hf oxide and the rare earth oxides is 65 mol % or less (excluding 0 mol %).

4. The tungsten electrode material according to claim 1, wherein
in a cross-section in an axial direction of the tungsten electrode material, a cross-sectional area of those oxide solid solutions, each having a cross-section whose long axis direction forms an angle of 20° or less with the axial direction, is 50% or more of a cross-sectional area of all the oxide solid solutions.

5. The tungsten electrode material according to claim 1, wherein
in a cross-section in an axial direction of the tungsten electrode material, a total area of those oxide solid solutions, each having a cross-section with a circle-converted particle size of 5 μm or less, is less than 50% of an area of all the oxide solid solutions.

6. The tungsten electrode material according to claim 1, wherein the tungsten electrode material contains the oxide solid solutions which show a relationship where, in the elements forming the oxide solid solutions, a standard deviation σ of ratios of total moles of Sc, Y, La, Ce, Pr, Nd, Sm, Eu, Gd, Tb, Dy, Ho, Er, Tm, Yb, and Lu to total moles of the elements in the oxide solid solutions excluding oxygen is $\sigma \leq 0.025$.

* * * * *